US008397738B2

(12) United States Patent
Livacich et al.

(10) Patent No.: US 8,397,738 B2
(45) Date of Patent: Mar. 19, 2013

(54) MODULAR SYSTEM FOR CONCEALMENT AND SHELTER

(75) Inventors: John Livacich, Sunnyvale, CA (US); Kendyl Allen Roman, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 322 days.

(21) Appl. No.: 11/155,398

(22) Filed: Jun. 16, 2005

(65) Prior Publication Data

US 2006/0000499 A1 Jan. 5, 2006

Related U.S. Application Data

(63) Continuation-in-part of application No. 11/045,736, filed on Jan. 28, 2005, now Pat. No. 7,828,038, and a continuation-in-part of application No. 10/161,986, filed on Jun. 4, 2002, now Pat. No. 7,100,626.

(60) Provisional application No. 60/295,956, filed on Jun. 4, 2001.

(51) Int. Cl.
*E04H 15/04* (2006.01)

(52) U.S. Cl. ..... 135/90; 135/95; 135/114; 135/115

(58) Field of Classification Search ..... 135/94, 135/93, 91, 901, 90, 127, 125, 124, 120.1, 135/119, 118, 117, 115, 114, 120.3; 403/296, 403/343; 285/32, 390, 392
See application file for complete search history.

(56) References Cited

U.S. PATENT DOCUMENTS

| | | | | |
|---|---|---|---|---|
| 74,933 A | | 2/1868 | Palmer | |
| 891,622 A | | 6/1908 | Kroder | |
| 926,945 A | | 7/1909 | Howland | |
| 1,079,431 A | | 11/1913 | Nitka | |
| 1,288,518 A | | 12/1918 | Collier | |
| 1,298,634 A | | 4/1919 | Allen | |
| 1,435,110 A | | 11/1922 | Efford | |
| 1,516,372 A | | 11/1924 | Brooks | |
| 1,528,910 A | | 3/1925 | Carlson | |
| 1,572,845 A | | 2/1926 | Efford et al. | |
| 1,619,740 A | | 3/1927 | Long et al. | |
| 1,649,219 A | | 3/1927 | Goldberg | |
| 2,159,273 A | * | 5/1939 | Killinger | 135/125 |
| 2,175,501 A | | 10/1939 | Bergh | |
| 2,179,193 A | * | 11/1939 | Parrish | 285/390 |
| 2,186,482 A | | 1/1940 | Frank | |
| 2,188,747 A | * | 1/1940 | Bittick | 135/157 |
| 2,573,414 A | | 10/1951 | Dunn | |
| 2,619,101 A | * | 11/1952 | McGerry et al. | 135/87 |

(Continued)

FOREIGN PATENT DOCUMENTS

| | | |
|---|---|---|
| EP | 222048 | 11/1985 |
| GB | 475811 | 11/1937 |

(Continued)

*Primary Examiner* — Noah C Hawk

(57) ABSTRACT

An easy to use, universal, simple, lightweight, compact, portable and modular system of concealment and shelter. An operator can configure a number of concealment blinds or shelters using brackets, supports, segmented shafts, covers, curtains, and skirts, and more complex modules. The segmented shafts have both the ability to make an attachment to retain a particular configuration while being able to break down the shafts for transportation or storage. The brackets and supports can be used to secure a configuration to a tree, the ground, or a hand held device. More advanced modules include cover caps including domes, cylindrical arches, and pyramids. A configuration can include a removable floor. Guyline modules allow for sliding panels to be positioned over openings in a configuration. The system can be configured for placement on a hillside or over rough terrain and obstacles. Multiple modules can be carried by separate members of a group and combined together to form a more complex structure to meet the needs of the group.

33 Claims, 72 Drawing Sheets

U.S. PATENT DOCUMENTS

| | | | | | |
|---|---|---|---|---|---|
| 2,826,758 | A | | 3/1958 | Kahn | |
| 2,835,262 | A | | 5/1958 | Collins | |
| 2,865,386 | A | | 12/1958 | Burns | |
| 2,888,021 | A | | 5/1959 | Adams | |
| 2,928,404 | A | * | 3/1960 | Klages | 135/98 |
| 3,039,478 | A | | 6/1962 | Timmons | |
| 3,068,046 | A | | 12/1962 | Bourgoin | |
| 3,095,886 | A | * | 7/1963 | Frommelt et al. | 135/123 |
| 3,116,746 | A | | 1/1964 | Bird | |
| 3,165,110 | A | | 1/1965 | Brooks | |
| 3,195,898 | A | * | 7/1965 | Respini | 473/197 |
| 3,239,254 | A | * | 3/1966 | Campbell | 285/390 |
| 3,441,037 | A | * | 4/1969 | Transeau | 135/97 |
| 3,468,299 | A | | 9/1969 | D'Amato | |
| 3,515,194 | A | | 6/1970 | Carhart et al. | |
| 3,537,688 | A | | 11/1970 | Stein | |
| 3,590,864 | A | * | 7/1971 | Vechesloff | 135/95 |
| 3,610,323 | A | | 10/1971 | Troyer | |
| 3,794,054 | A | | 2/1974 | Watts | |
| 3,855,635 | A | | 12/1974 | Ramirez | |
| 3,911,499 | A | | 10/1975 | Benevento et al. | |
| 3,950,789 | A | | 4/1976 | Konz et al. | |
| 3,957,069 | A | | 5/1976 | Denaro | |
| 4,055,173 | A | | 10/1977 | Knab | |
| 4,084,599 | A | | 4/1978 | Matthews | |
| 4,146,933 | A | | 4/1979 | Jenkins et al. | |
| 4,175,576 | A | | 11/1979 | Iby | |
| 4,263,925 | A | | 4/1981 | Arganbright | |
| 4,352,362 | A | | 10/1982 | Nichols | |
| 4,369,528 | A | | 1/1983 | Vest et al. | |
| 4,449,542 | A | | 5/1984 | McSwain et al. | |
| 4,494,248 | A | | 1/1985 | Holder | |
| 4,524,463 | A | | 6/1985 | Ogden | |
| 4,558,468 | A | | 12/1985 | Landry et al. | |
| 4,576,364 | A | | 3/1986 | O'Fearna | |
| 4,578,825 | A | | 4/1986 | Vote | |
| 4,587,671 | A | | 5/1986 | Rodriguez et al. | |
| 4,651,727 | A | | 3/1987 | Howorth | |
| 4,653,120 | A | | 3/1987 | Leaf | |
| 4,696,066 | A | | 9/1987 | Ball et al. | |
| 4,718,210 | A | | 1/1988 | McCourt et al. | |
| 4,750,509 | A | | 6/1988 | Kim | |
| 4,773,437 | A | * | 9/1988 | Glutting | 135/117 |
| 4,787,101 | A | | 11/1988 | Feinberg | |
| 4,914,752 | A | | 4/1990 | Hinson et al. | |
| 4,945,936 | A | | 8/1990 | Surrendi | |
| 4,964,282 | A | | 10/1990 | Wagner | |
| 4,979,531 | A | * | 12/1990 | Toor et al. | 135/127 |
| 5,062,234 | A | * | 11/1991 | Green | 43/1 |
| 5,062,424 | A | | 11/1991 | Hooker | |
| 5,180,143 | A | | 1/1993 | Brower | |
| 5,218,982 | A | * | 6/1993 | Kenji | 135/90 |
| 5,255,390 | A | | 10/1993 | Gross et al. | |
| 5,259,077 | A | | 11/1993 | Hager et al. | |
| 5,299,331 | A | | 4/1994 | Badillo | |
| 5,301,706 | A | * | 4/1994 | Jones | 135/125 |
| 5,304,213 | A | | 4/1994 | Berke et al. | |
| 5,333,634 | A | | 8/1994 | Taylor | |
| 5,360,439 | A | | 11/1994 | Dickerhoff et al. | |
| 5,367,710 | A | | 11/1994 | Karmin | |
| 5,411,541 | A | | 5/1995 | Bell et al. | |
| 5,443,488 | A | | 8/1995 | Namenmye et al. | |
| 5,479,954 | A | | 1/1996 | Lin | |
| 5,564,232 | A | | 10/1996 | Callaway | |
| 5,572,742 | A | | 11/1996 | McFadden | |
| 5,575,006 | A | | 11/1996 | Wolfe | |
| 5,609,176 | A | | 3/1997 | Weeks | |
| 5,611,087 | A | | 3/1997 | Adkins | |
| 5,620,482 | A | | 4/1997 | Augustine et al. | |
| 5,647,660 | A | * | 7/1997 | Lee | 362/249 |
| 5,697,963 | A | | 12/1997 | Augustine | |
| 5,746,555 | A | | 5/1998 | McEvoy | |
| 5,785,716 | A | | 7/1998 | Bayron | |
| 5,865,355 | A | * | 2/1999 | Camara | 224/153 |
| 5,871,026 | A | | 2/1999 | Lin | |
| 5,876,011 | A | | 3/1999 | Blasing | |
| 5,891,187 | A | | 4/1999 | Winthrop et al. | |
| 5,934,628 | A | | 8/1999 | Bosnakovic | |
| 5,937,883 | A | | 8/1999 | Camara | |
| 5,970,519 | A | | 10/1999 | Weber | |
| 5,974,605 | A | | 11/1999 | Dickerhoff et al. | |
| 6,049,907 | A | | 4/2000 | Palomo | |
| 6,148,836 | A | * | 11/2000 | Cananzey | 135/87 |
| 6,154,883 | A | | 12/2000 | Spann et al. | |
| 6,199,572 | B1 | | 3/2001 | Rousselle et al. | |
| 6,200,060 | B1 | | 3/2001 | Vernay | |
| 6,216,270 | B1 | | 4/2001 | Moquin et al. | |
| 6,230,728 | B1 | | 5/2001 | Reese | |
| 6,230,928 | B1 | | 5/2001 | Hanna et al. | |
| 6,235,659 | B1 | | 5/2001 | McAmish et al. | |
| 6,243,979 | B1 | * | 6/2001 | Seats et al. | 42/94 |
| 6,279,877 | B1 | * | 8/2001 | Davis | 254/134.3 FT |
| 6,286,531 | B1 | * | 9/2001 | Joo-Tai | 135/114 |
| 6,336,465 | B1 | | 1/2002 | Surrendi et al. | |
| 6,354,316 | B1 | | 3/2002 | Chen | |
| 6,378,136 | B2 | | 4/2002 | Matsushita | |
| 6,434,877 | B1 | * | 8/2002 | Shelton | 43/1 |
| 6,450,187 | B1 | * | 9/2002 | Lin et al. | 135/114 |
| 6,484,321 | B1 | | 11/2002 | Shamam | |
| 6,511,501 | B1 | | 1/2003 | Augustine et al. | |
| 6,523,558 | B1 | | 2/2003 | Gillis | |
| 6,524,332 | B1 | | 2/2003 | Augustine et al. | |
| 6,551,347 | B1 | | 4/2003 | Elkins | |
| 6,571,574 | B1 | | 6/2003 | Blackstone | |
| 6,581,617 | B2 | | 6/2003 | Ham et al. | |
| 6,596,019 | B2 | | 7/2003 | Turner et al. | |
| 6,647,552 | B1 | | 11/2003 | Hogan | |
| 6,662,492 | B2 | * | 12/2003 | Oliver | 47/41.1 |
| 6,694,522 | B1 | | 2/2004 | Neal | |
| 6,766,623 | B1 | | 7/2004 | Kalnay | |
| 6,776,177 | B2 | | 8/2004 | Wu | |
| 6,792,622 | B2 | | 9/2004 | Graves | |
| 6,799,332 | B2 | | 10/2004 | Hatton | |
| 6,851,125 | B2 | | 2/2005 | Fujikawa et al. | |
| 6,876,884 | B2 | | 4/2005 | Hansen et al. | |
| 6,997,199 | B1 | | 2/2006 | Wright | |
| 7,001,416 | B2 | | 2/2006 | Augustine et al. | |
| 7,044,145 | B2 | | 5/2006 | Bouchard | |
| 7,100,626 | B2 | | 9/2006 | Livacich | |
| 7,152,614 | B2 | | 12/2006 | Kalnay | |
| 7,226,454 | B2 | | 6/2007 | Albrecht et al. | |
| 7,264,011 | B2 | | 9/2007 | Cohen | |
| 7,276,076 | B2 | | 10/2007 | Bieberich | |
| 7,364,584 | B2 | | 4/2008 | Anderson | |
| 2002/0020439 | A1 | | 2/2002 | Tate | |
| 2002/0026742 | A1 | * | 3/2002 | Washington | 43/1 |
| 2004/0099299 | A1 | | 5/2004 | Wu | |
| 2004/0159346 | A1 | | 8/2004 | Huang | |
| 2005/0015127 | A1 | | 1/2005 | Bieberich | |
| 2005/0016573 | A1 | | 1/2005 | Wu | |
| 2005/0143796 | A1 | | 6/2005 | Augustine et al. | |
| 2005/0161069 | A1 | | 7/2005 | Wu | |
| 2005/0183761 | A1 | | 8/2005 | Livacich | |
| 2005/0252541 | A1 | | 11/2005 | Chen | |
| 2006/0016467 | A1 | | 1/2006 | Bae | |
| 2006/0037636 | A1 | | 2/2006 | Lin | |
| 2006/0047332 | A1 | | 3/2006 | Malmberg et al. | |
| 2006/0122671 | A1 | | 6/2006 | Albrecht et al. | |
| 2006/0122672 | A1 | | 6/2006 | Anderson | |
| 2006/0147320 | A1 | | 7/2006 | Hansen et al. | |
| 2006/0162756 | A1 | | 7/2006 | Gao | |
| 2006/0184216 | A1 | | 8/2006 | Van Duren | |
| 2006/0184217 | A1 | | 8/2006 | Van Duren | |
| 2006/0184218 | A1 | | 8/2006 | Bieberich | |
| 2006/0185704 | A1 | | 8/2006 | Guo et al. | |
| 2006/0259104 | A1 | | 11/2006 | Panser | |
| 2006/0283491 | A1 | | 12/2006 | Livacich | |
| 2006/0283492 | A1 | | 12/2006 | Livacich | |
| 2007/0000533 | A1 | | 1/2007 | Tseng | |
| 2007/0093882 | A1 | | 4/2007 | Anderson et al. | |
| 2007/0093883 | A1 | | 4/2007 | Anderson et al. | |
| 2007/0093884 | A1 | | 4/2007 | Anderson et al. | |
| 2007/0093885 | A1 | | 4/2007 | Anderson et al. | |
| 2007/0175504 | A1 | | 8/2007 | Tseng | |
| 2007/0239239 | A1 | | 10/2007 | Albrecht et al. | |
| 2008/0006317 | A1 | | 1/2008 | Livacich | |
| 2008/0027521 | A1 | | 1/2008 | Bieberich | |

| | | | |
|---|---|---|---|
| 2008/0027522 | A1 | 1/2008 | Bieberich |
| 2008/0125840 | A1 | 5/2008 | Anderson |
| 2009/0065039 | A1 | 3/2009 | Livacich |

FOREIGN PATENT DOCUMENTS

| | | |
|---|---|---|
| GB | 2054002 | 2/1981 |
| GB | 2259927 | 3/1993 |
| GB | 2265165 | 9/1993 |
| GB | 1 462 033 | 1/1997 |
| JP | 5113059 | 5/1993 |
| SE | 525 415 | 2/2005 |
| WO | WO 97/14381 | 4/1997 |
| WO | WO 98/48652 | 11/1998 |
| WO | WO 00/62726 | 10/2000 |
| WO | WO 03/086500 | 10/2003 |
| WO | WO 03/106897 | 12/2003 |
| WO | WO 2004/004500 | 1/2004 |
| WO | WO 2006/020170 | 2/2006 |
| WO | WO 2006/062910 | 6/2006 |
| WO | WO 2006/063027 | 6/2006 |
| WO | WO 2006/086587 | 8/2006 |
| WO | WO 2007 047917 | 4/2007 |
| WO | WO 2008 013603 | 1/2008 |
| WO | WO 2008 091486 | 7/2008 |

* cited by examiner

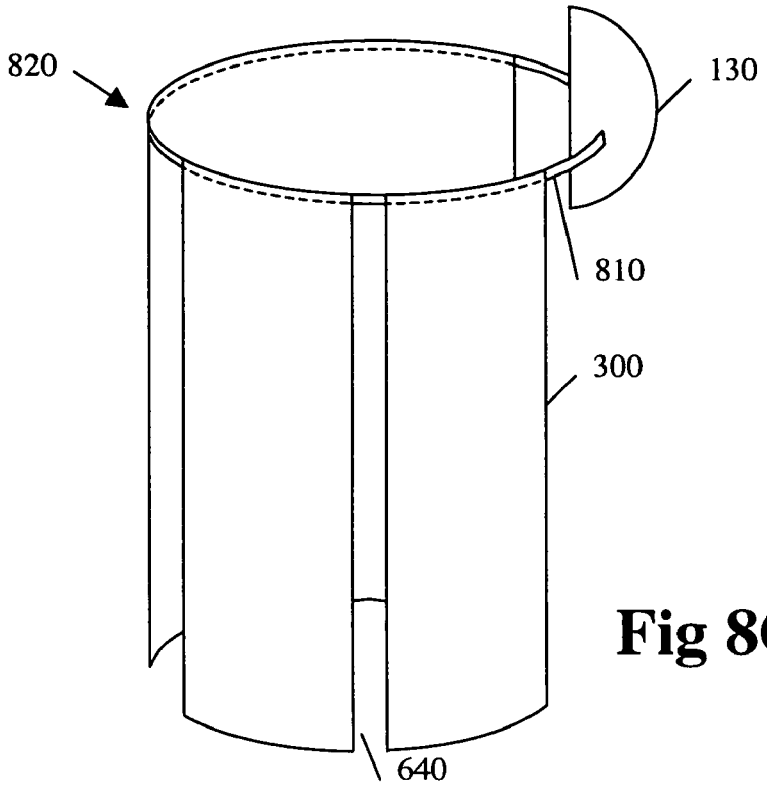
Fig 8C
Fig 8D
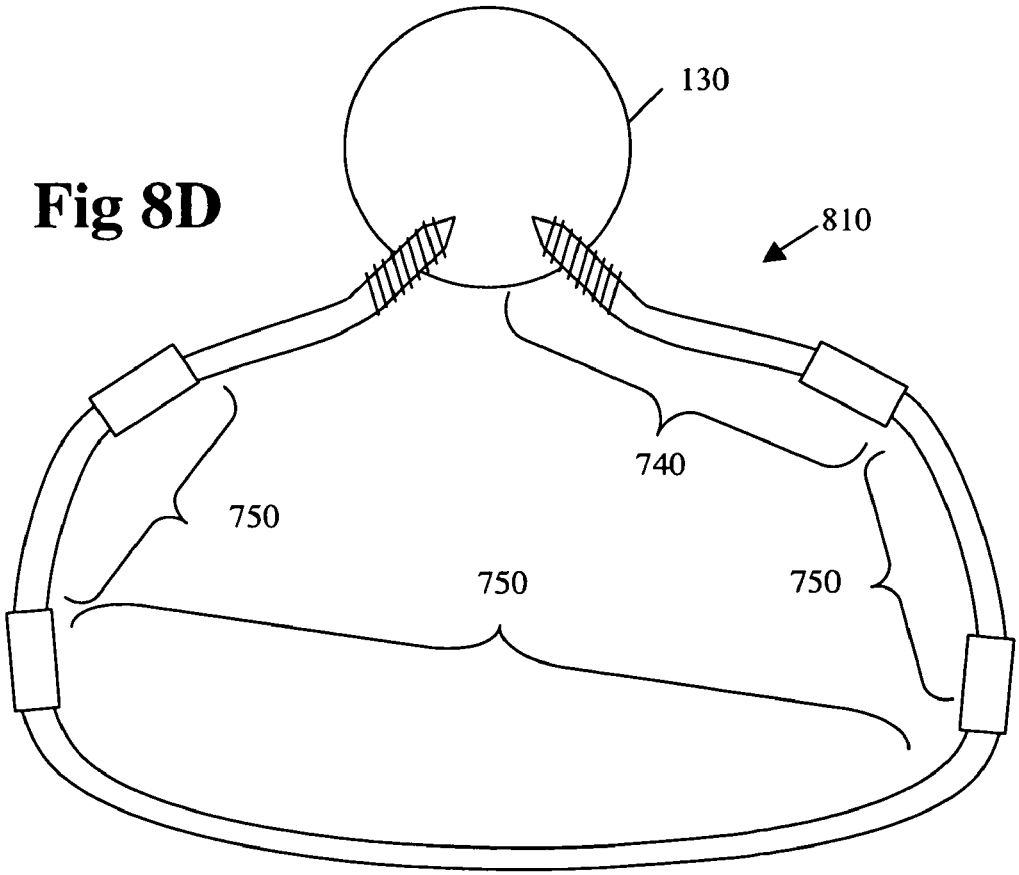

MODULAR SYSTEM FOR CONCEALMENT AND SHELTER

RELATED APPLICATIONS

This application is a continuation-in-part of, and claims priority based on, U.S. patent application Ser. No. 11/045,736, filed Jan. 28, 2005 now U.S. Pat. No. 7,828,038, entitled "LIGHTWEIGHT PORTABLE CONCEALMENT MEANS AND METHODS". The parent application is a continuation-in-part of U.S. patent application Ser. No. 10/161,986, filed 2002 Jun. 4 now U.S. Pat. No. 7,100,626. This application, as well as its parent and grandparent, claim priority under 35 U.S.C. § 199(e) of U.S. provisional application Ser. No. 60/295,956, filed 2001 Jun. 4, entitled "LIGHTWEIGHT PORTABLE CONCEALMENT MEANS AND METHODS".

BACKGROUND

1. Field of the Invention

This invention relates to lightweight portable concealment and shelter systems and methods.

2. Description of Prior Art

There is often a need to conceal oneself when researching wildlife, hunting, camping, working on construction projects, or working in the outdoors. Wildlife researchers conceal themselves so that they can film and study wildlife without disturbing the behavior of the animals. Hunters often conceal themselves in various hunting blinds to avoid being detected by their prey. Campers often conceal themselves to bathe, change clothes, and perform other personal or hygiene activities. Construction workers, military, law enforcement, and others who work in the outdoors also have similar needs for concealment. Various methods have been employed to accomplish these tasks.

In the past, quite complex, heavy structures have been built or constructed for concealment. Hunters have built permanent hunting blinds. Portable huts, shower stalls, dressing shelters, tents, canopies, and complex tree blind structures have been carried into the great outdoors.

The parent application provided a list patents relating to this field of invention. The discussion of these prior art references is included by reference.

The use of such devices has several disadvantages such as being heavy, bulky, noisy, expensive, and complicated to assemble or use. Most of these devices have only a single use with poor performance. There is a need for a simple, lightweight, compact, portable, multi-use means of concealment.

To avoid being detected by their scent, hunters and other wildlife observers climb trees using tree steps and then remain for hours in a tree stand watching and waiting for animals to pass by. However, a person in a tree stand makes a silhouette against the sky or background and is exposed to a 360 degree view. Animals can easily detect the human silhouette or movement. Further, if the person or equipment makes a noise the animal will know where to look. There is a need for a device that eliminates the silhouette.

Complicated equipment or procedures create a situation where a person may drop equipment or, even worse, fall from the tree stand. Most of the existing devices block the view or mobility of the person.

Metal objects screwed into trees are sometimes forgotten and become over grown by the tree. Later when the lumber is harvested and cut, the saw strikes the metal object and can cause severe damage. Some states have banded the use of metal tree screws or spikes. Any device used for attaching to trees in the forest needs an embodiment that attaches to the outside of the tree and can be easily removed.

The following ground blinds are known in the art:

Hunter's Specialties' "Lightweight Portable Ground Blind"

Avery' "Avery Quick Carry Ground Blind"

U.S. Pat. No. 5,062,234, entitled "Portable Blind"

Double Bull "Matrix"

However, these ground blinds are limited in that they are designed for a single use or application.

There are a number of very old patents relating to curtain support brackets. These are associated with hanging curtains inside a building on a wall and fail to anticipate many novel features of the present invention.

It is also desirable to have a blind that can provide shelter from the elements. Light weight portable tents with nylon shells, rain flies, and external fiberglass poles are well known, but there have not been major innovations in basic structure and configuration of such tents in the last two decades. Each tent comes with a predetermined number of parts and is limited to a single configuration.

What is needed is a modular system of components that could be used to construct a wide variety of outdoor blinds and shelters. With such a modular system, the same components could be used to create tree blinds, ground blinds, water fowl blinds, blinds attached to vessels and vehicles, and various shelters.

SUMMARY OF THE INVENTION

Accordingly, it is an objective of the present invention to provide an easy to use, universal, simple, lightweight, compact, portable, quiet, multi-use modular system for concealment and shelter.

Objects and Advantages

Accordingly, beside the objects and advantages described above, some additional objects and advantages of the present invention are:

1. To provide a modular system of components that can be used construct a variety of outdoor blinds and shelters.
2. To provide a basic module that can be used to create a tree blind, ground blind, and water fowl blind by reconfiguring the same components.
3. To provide advanced modules that can be used with one or more basic modules to form more complex structures for use as both blinds and shelters.
4. To provide bind and shelter modules that can be interconnected with other modules to accommodate the needs of larger groups.
5. To provide overhead cover to enhance the effectiveness of an otherwise open blind.
6. To provide modular components that can be assembled in a specific configuration and then can be broken down without disassembly, so that the specific configuration can be quickly put up at a later time.
7. To provide a bracket that can be attached to either a vertical or horizontal structure, or that can be inserted into the ground.
8. To provide a multi-legged bracket wherein the legs can be configured and then held at any angle.
9. To provide a method of removeably attaching shaft segments whereby shafts can pass through and hold flexible materials such as shelter covers, floors, and panels.
10. To provide a method of removeably attaching shaft segments whereby shafts can pass through a material whereby portions of the shaft can be inside a structure and other portions of the same shaft can be outside the structure.

11. To provide a method of removeably attaching shaft segments whereby the shaft segments are held together regardless of whether an external pressure is forcing them towards or away from each other.
12. To provide a method of assembling an outdoor structure wherein the supports for the structure are secured to the ground independent of having the supports interconnected or covered.
13. To provide a blind or shelter structure with a removable floor component wherein the configuration of the structure prevents the entry of water, dirt, or debris.
14. To provide a structure with a removable floor that can be independently cleaned.
15. To provide a structure with a removable floor that can be omitted to reduce weight and complexity.
16. To provide modular system wherein a camouflaged removable floor component can be used as roof or extended side component.
17. To provide a modular system that be used on steep terrain.
18. To provide a blind or shelter structure with a relatively flatter top to increase useable space within the structure.
19. To provide a method of tightening a skin of a blind to reduce undesired motion.
20. To provide a method of tightening a shoot through panel to reduce the drag or other effect on a projectile as it passes through the panel.
21. To provide a covered structure with unobstructed openings.
22. To provide a blind or shelter structure with an overhead window whereby a rain fly can be installed and removed without leaving the structure.
23. To provide a blind with a lower window and an overhead window, in addition to other horizontal openings, whereby the operators line of sight is not obstructed down nor up steep terrain.
24. To provide a cover module that can be used alone or as part of a more complex combination of components.
25. To provide a method of holding cover shafts taut within a cover component whereby the cover can be used alone or placed and secured on other basic modules.
26. To provide a method of holding cover shafts taut within a cover component wherein the cover shafts can have more than one predetermined length.
27. To provide a method of holding the end of a cover shaft inside a cover without damaging the cover during repetitive use.
28. To provide a method of using a basic tree blind module to form a rain fly or cover for another basic tree blind module.
29. To provide a smooth handle for a threaded bracket can be more easily be attached.
30. To provide a method of converting a basic blind into a covered shelter.
31. To provide of a camouflaged shield module that can be attached to a tree, a vessel, a vehicle, or to the ground.
32. To provide a camouflaged shield module that can be attached to a weapon or camera whereby the operator can move freely through open space.
33. To provide a camouflaged shield module with a shoot through section.
34. To provide shoot through or blackout sections that can be moved to cover opening in a blind or shelter structure.
35. To provide a shaft segment or guyline to which shoot through and blackout sections can be slideably attached, whereby the sections can be moved passed each other to cover the same opening.
36. To provide a method of moving shoot through or blackout sections horizontally in a opening to form a small vertical opening at any desired position within the opening.
37. To provide horizontally sliding sections, whereby the gap between the horizontally sliding sections form a relatively small vertical slit.
38. To provide a fully enclosed blind that allows unobstructed line of sight in 360 degrees of a substantially horizontal plane.
39. To provide a fully enclosed blind that allows unobstructed line of sight in 180 degrees in a substantially vertical plane on steep terrain.
40. To provide a method of removably attaching a thinner or more flexible shaft to components of a system that commonly use thicker shafts and connectors, whereby the more flexible shaft will bend more than the commonly used shafts and allow to commonly used shafts to form a straighter line for wall or ceiling structural support.
41. To provide an improved wildlife research blind.
42. To provide an improved hunting blind.
43. To provide an improved outdoor shower concealment means.
44. To provide an improved outdoor latrine concealment means.
45. To provide an improved tree stand concealment means.
46. To provide a quick, silent means of lowering or raising a screen.
47. To provide a pivotal means of attachment that maintains its frictional force.
48. To provide an option for attaching to the outside of a tree.
49. To provide unobstructed vision or shooting lanes.
50. To provide a means of concealment by hiding in front of a similar pattern.
51. To provide a system that can be used as a ground blind as well as a tree blind.
52. To provide a universal support with multiple legs which can be used with a curtain to form various configurations to meet the needs of various environments and uses.
53. To provide improved means of construction with lower cost and longer reliability.

These and other features and advantages of the present invention will become apparent upon consideration of the following specification, claims, and drawings.

DRAWING FIGURES

In the drawings, closely related figures have the same number but different alphabetic suffixes.

FIG. 1A through FIG. 1H show various embodiments of the support of the present invention.

FIG. 1I through FIG. 1M and FIG. 1DD show various embodiments of the alternate support of the present invention.

Figure 1A:
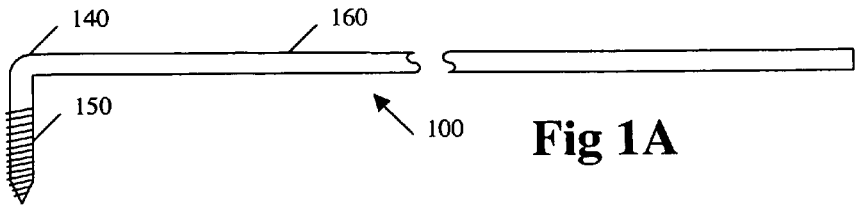
FIG. 1L through FIG. 1M show details of the alternate support.
FIG. 1N through FIG. 1T show various embodiments of the alternate dimpled connector.
FIGS. 1U and 1V show embodiments of the alternate support.
FIGS. 1W and 1X show embodiments of the threaded support.
Figure 1B:
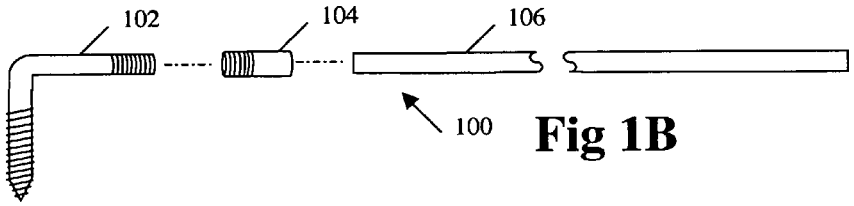
Figure 1C:
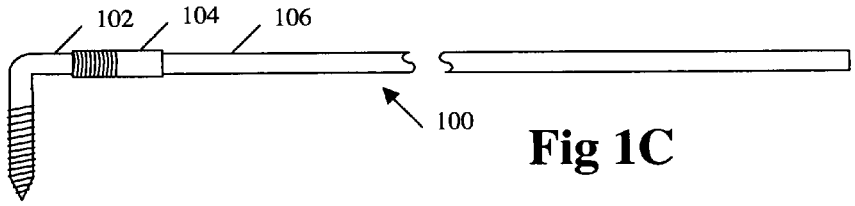
Figure 1D:
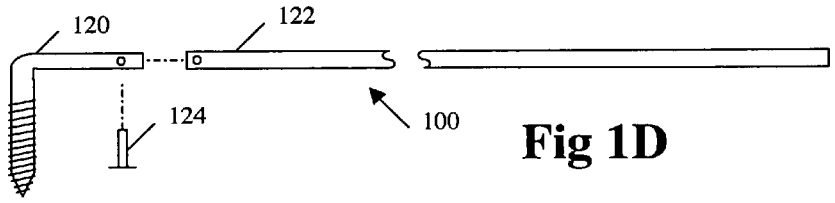
Figure 1E:
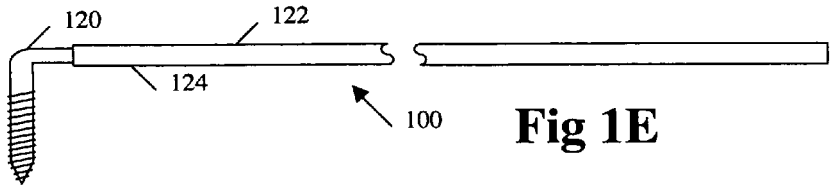
Figure 1F:
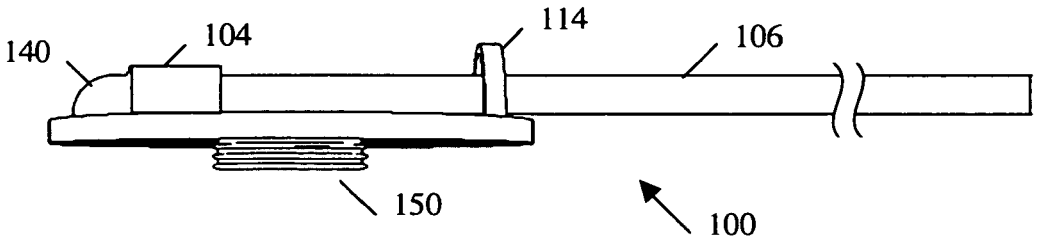
Figure 1G:
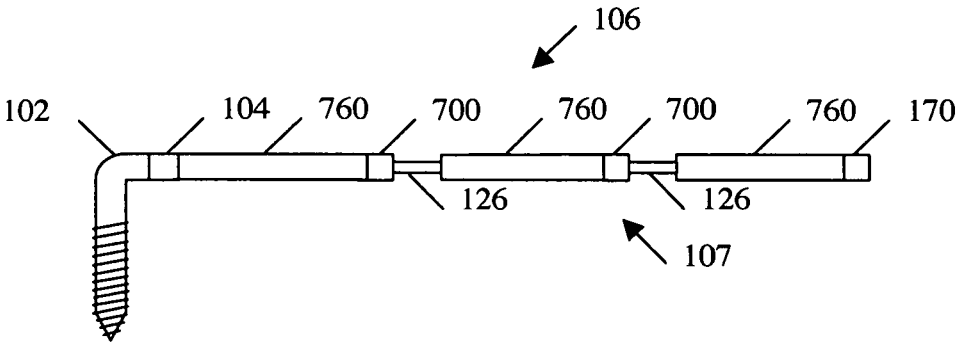
Figure 1H:
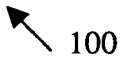
Figure 1H:
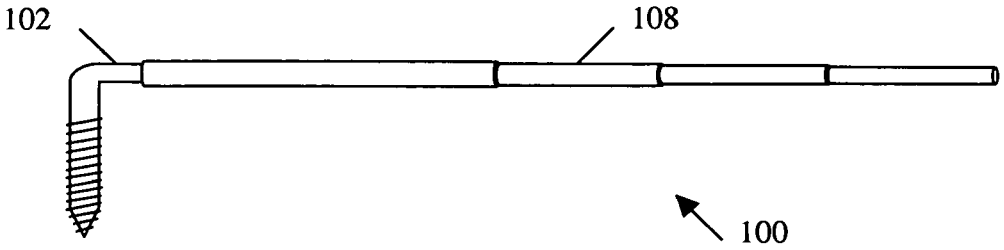
Figure 1I:
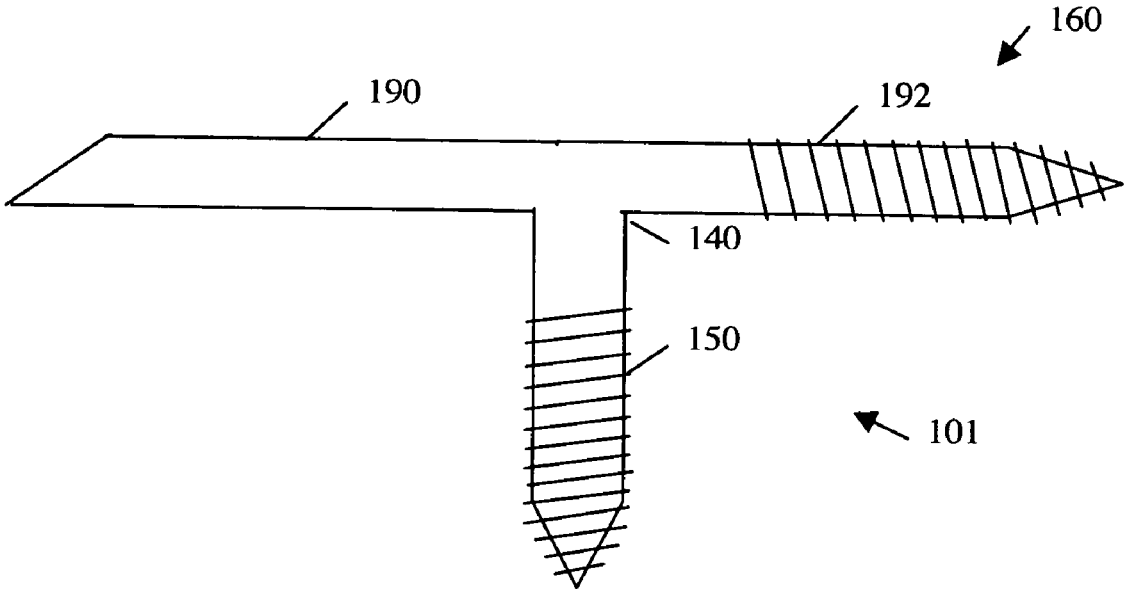
Figure 1J:
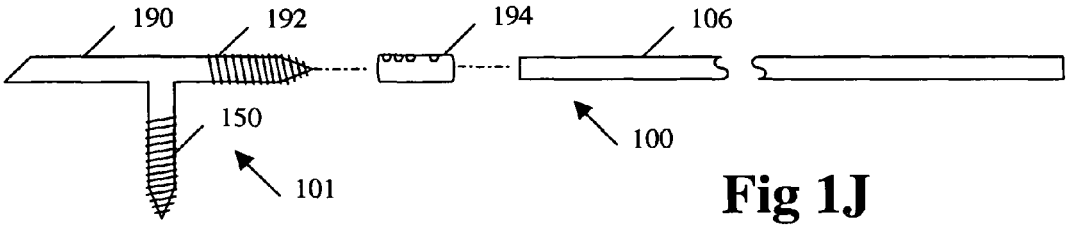
Figure 1K:
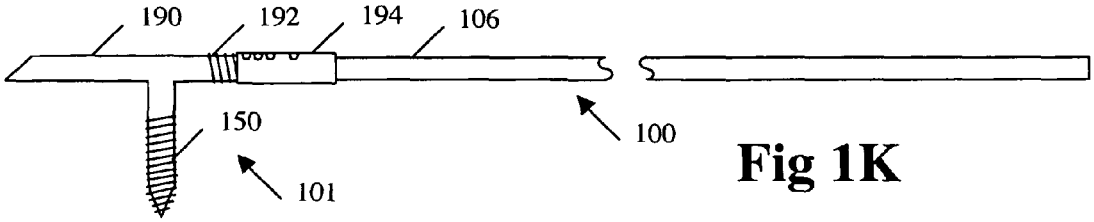
Figure 1L:
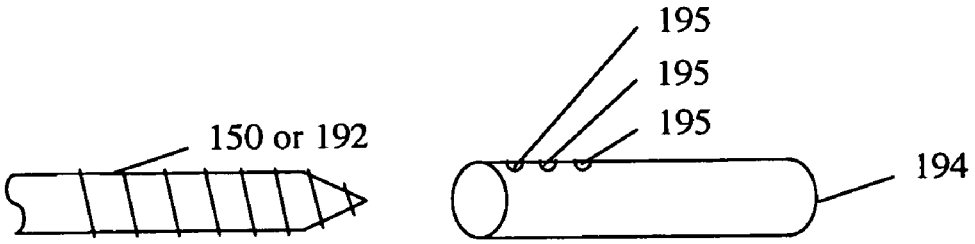
Figure 1M:
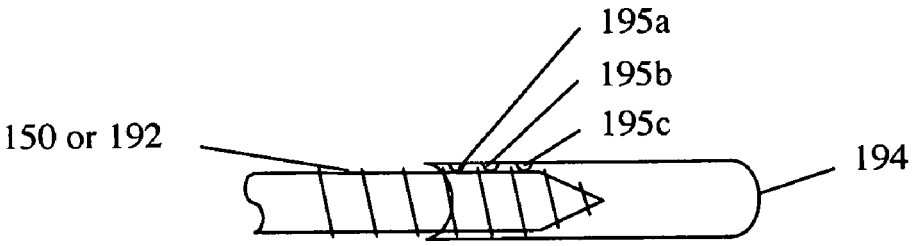
Figure 1N:
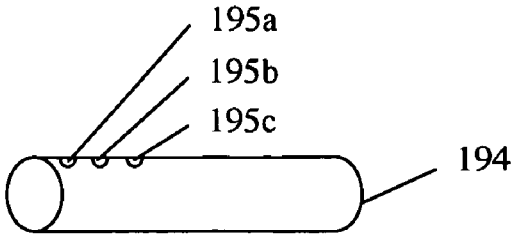
Figure 1O:
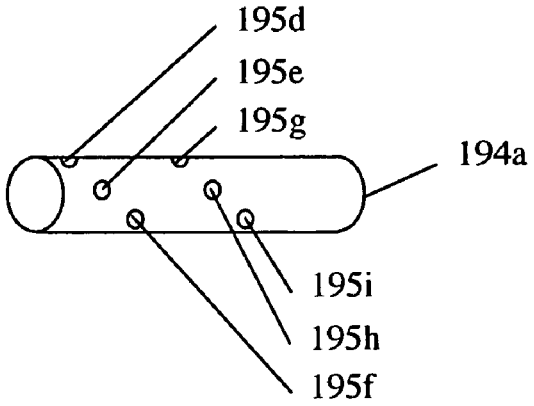
Figure 1P:
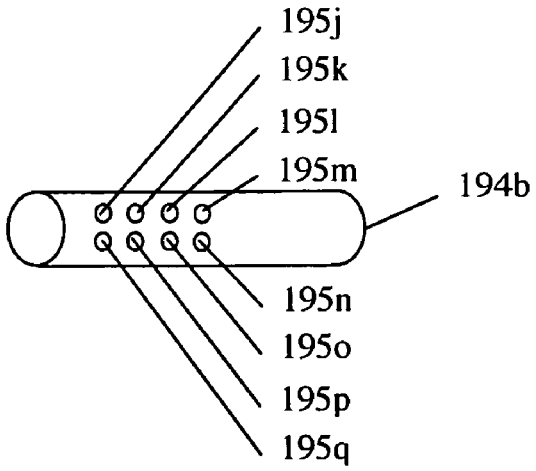
Figure 1Q:
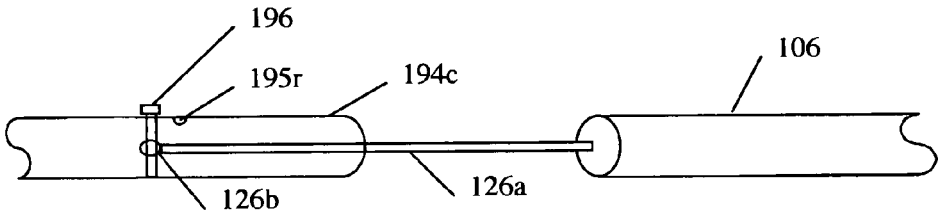
Figure 1R:
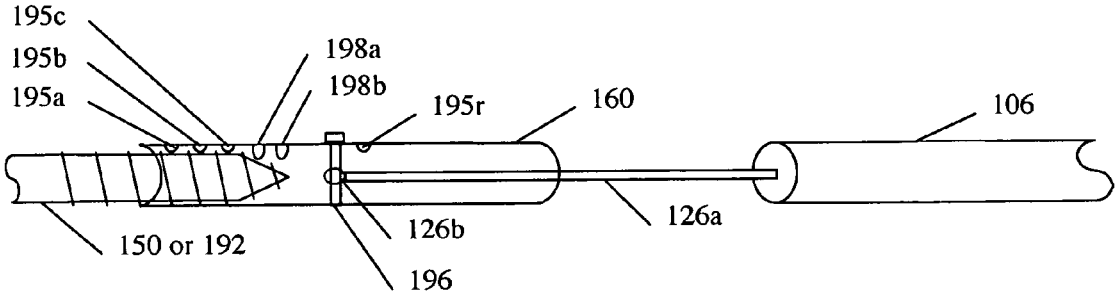
Figure 1S:
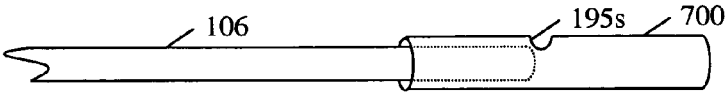
Figure 1T:
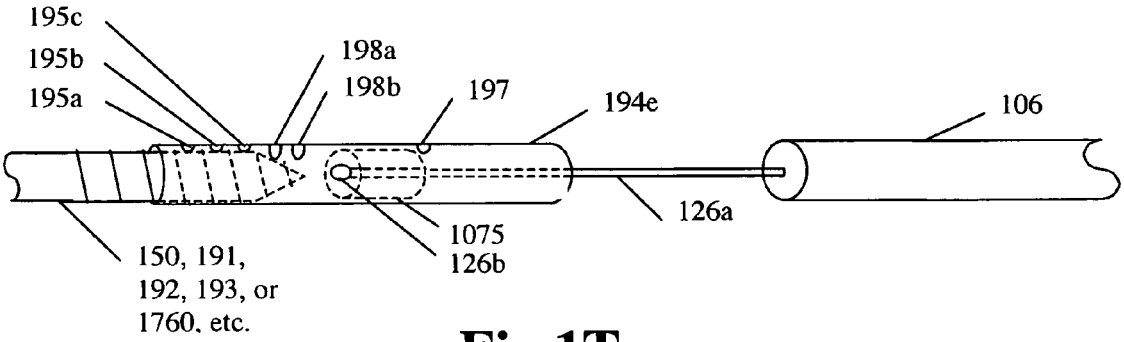
Figure 1U:
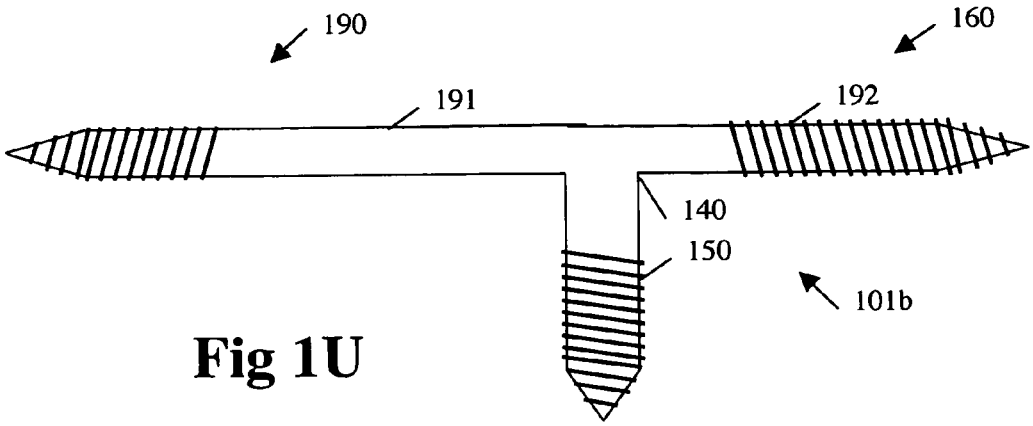
Figure 1V:
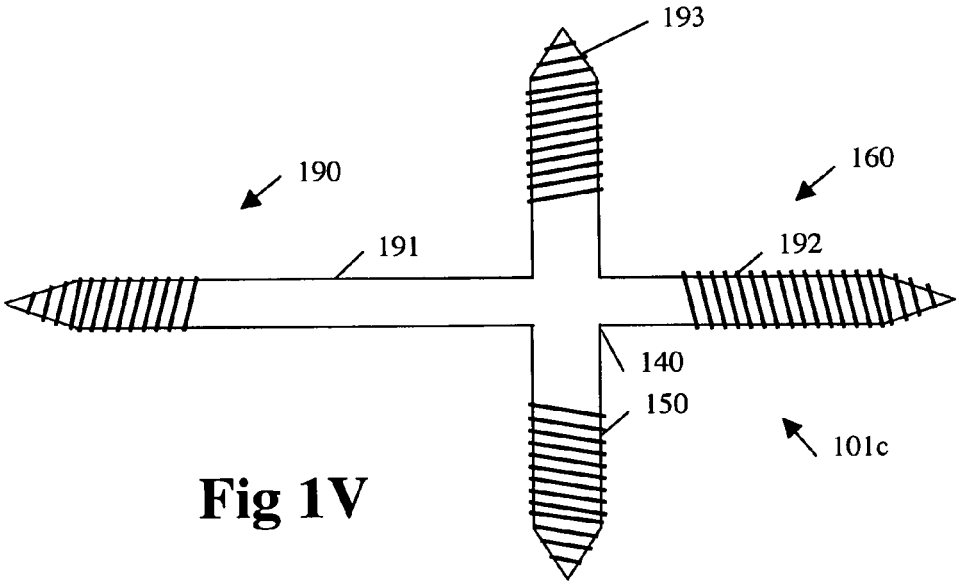
Figure 1W:
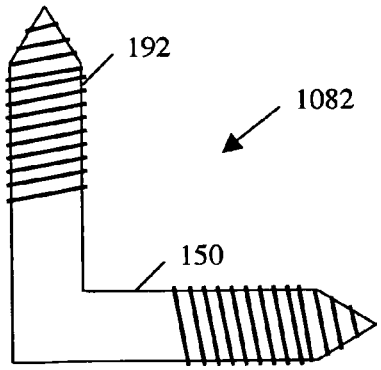
Figure 1X:
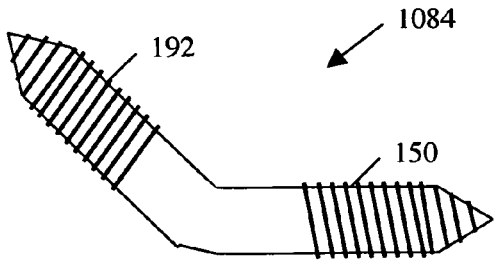
Figure 1Y:
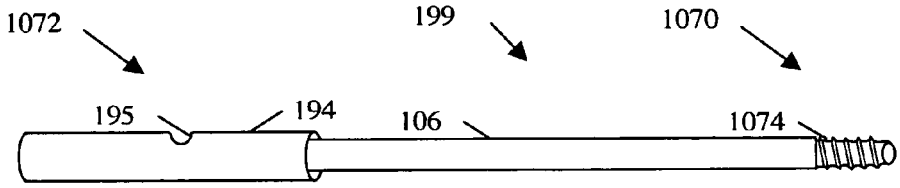

FIG. 1Y through 1QQ show various details of shaft segments and their construction and use.

Figure 2A:
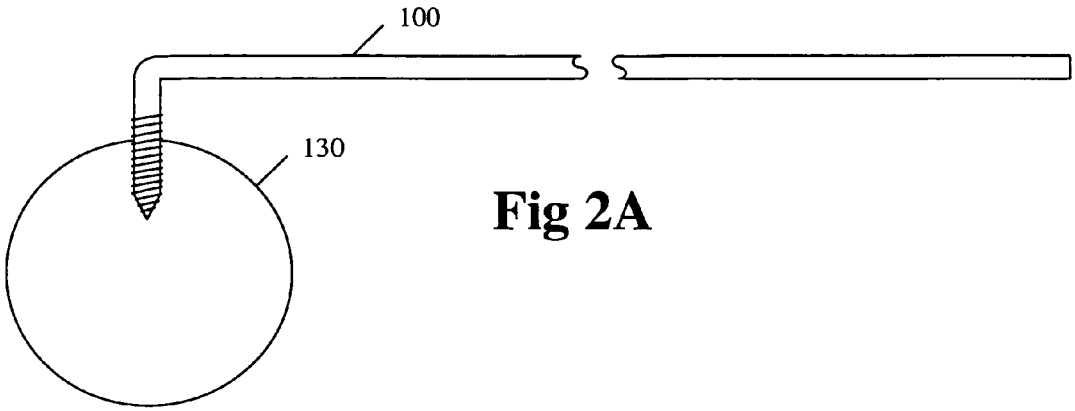
Figure 2B:
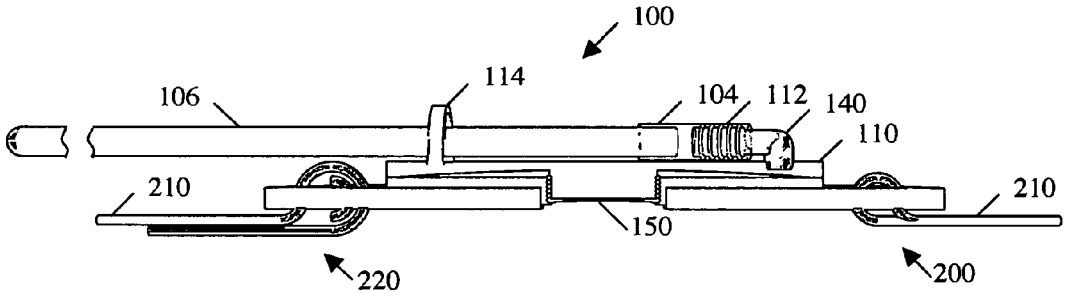

FIG. 2A and FIG. 2B show the support attached to an attaching support.

Figure 2C:
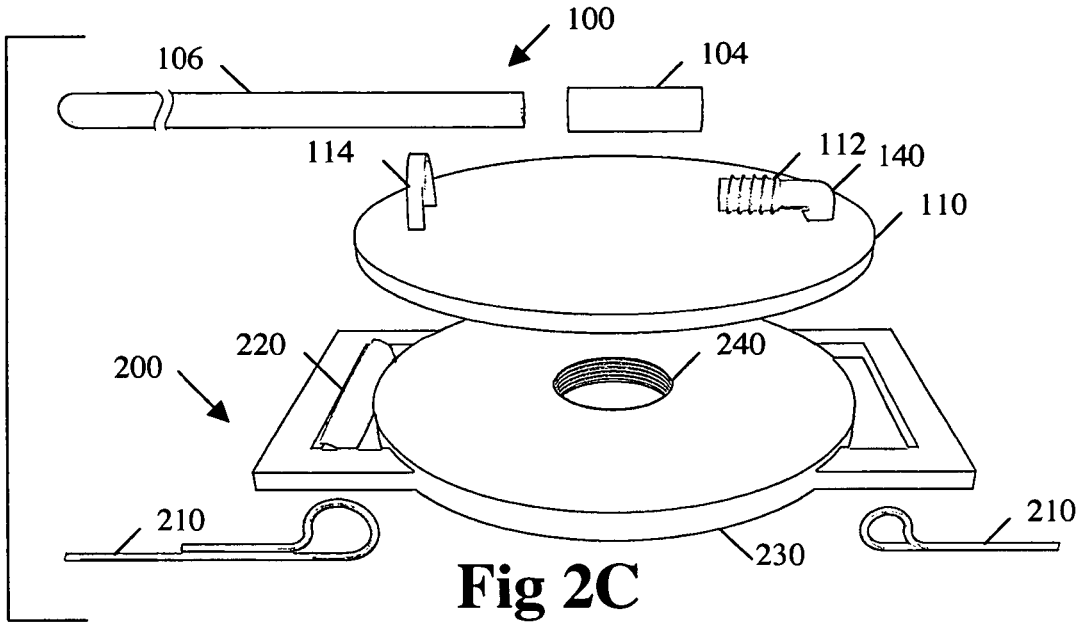
Figure 2D:
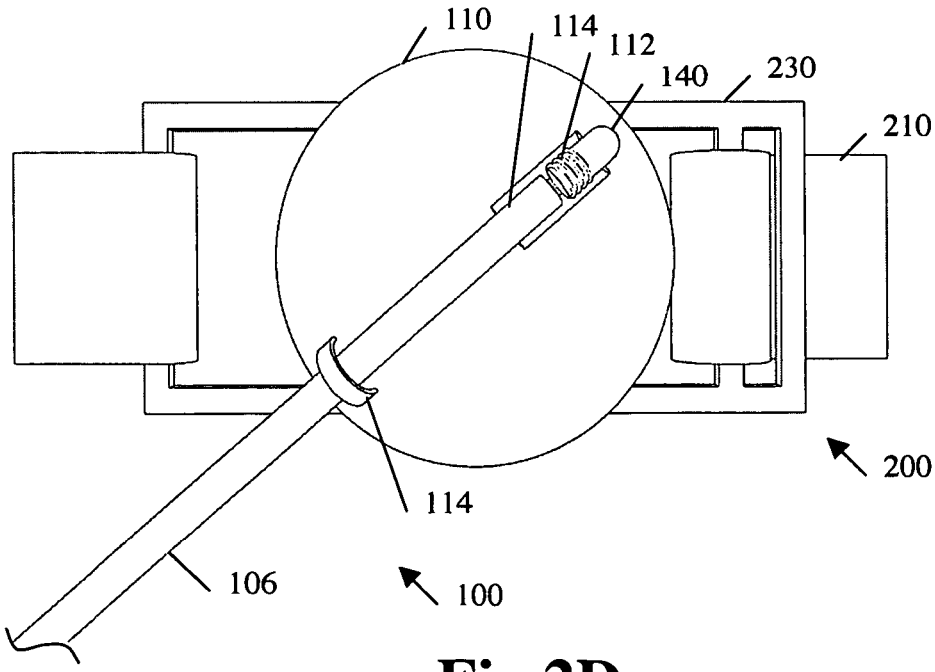

FIG. 2C and FIG. 2D show views of the embodiment of FIG. 2B.

Figure 3A:
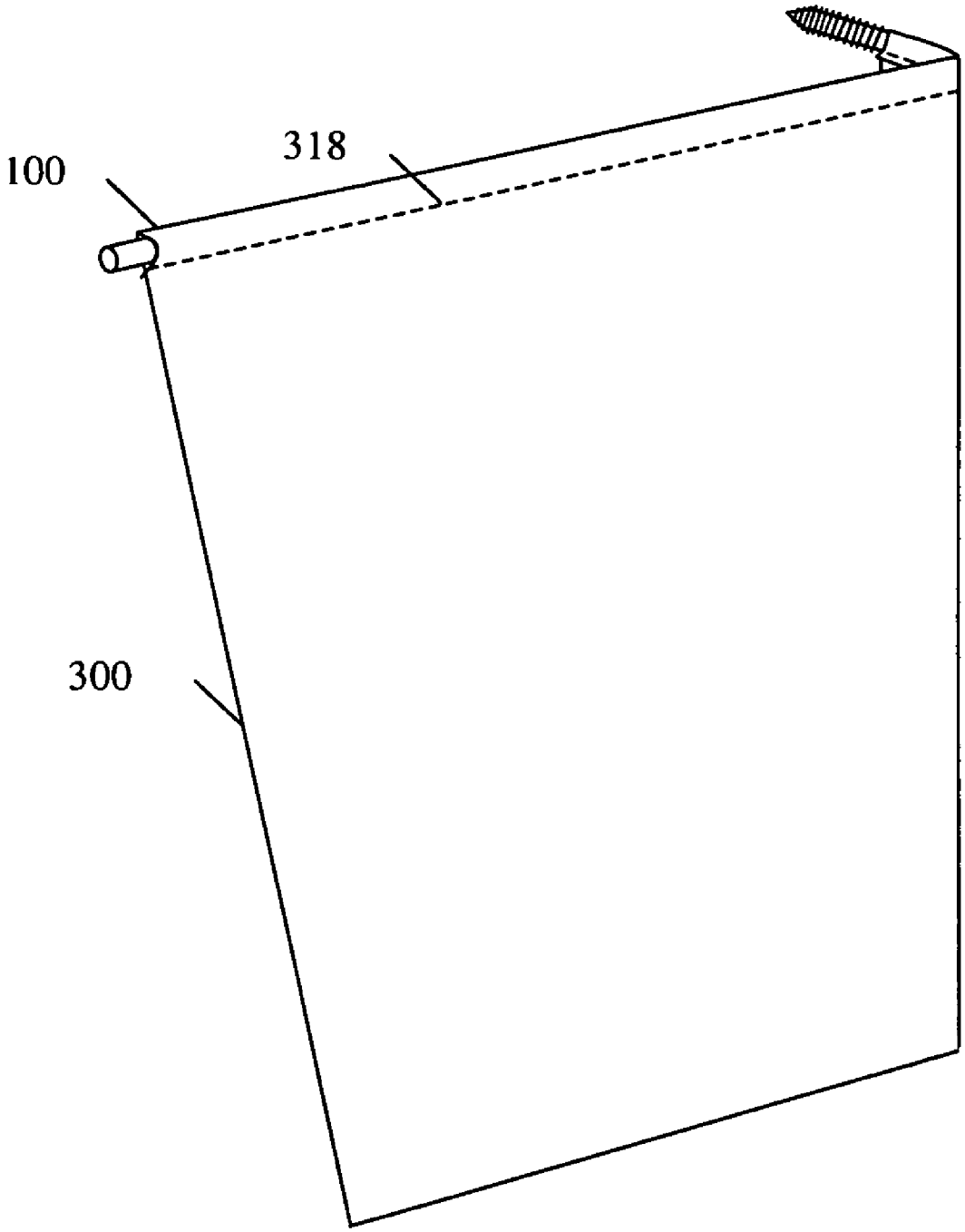

FIG. 3A shows the support combined with a curtain.

FIG. 3B through FIG. 3L show details of curtain embodiments.

Figure 3B:
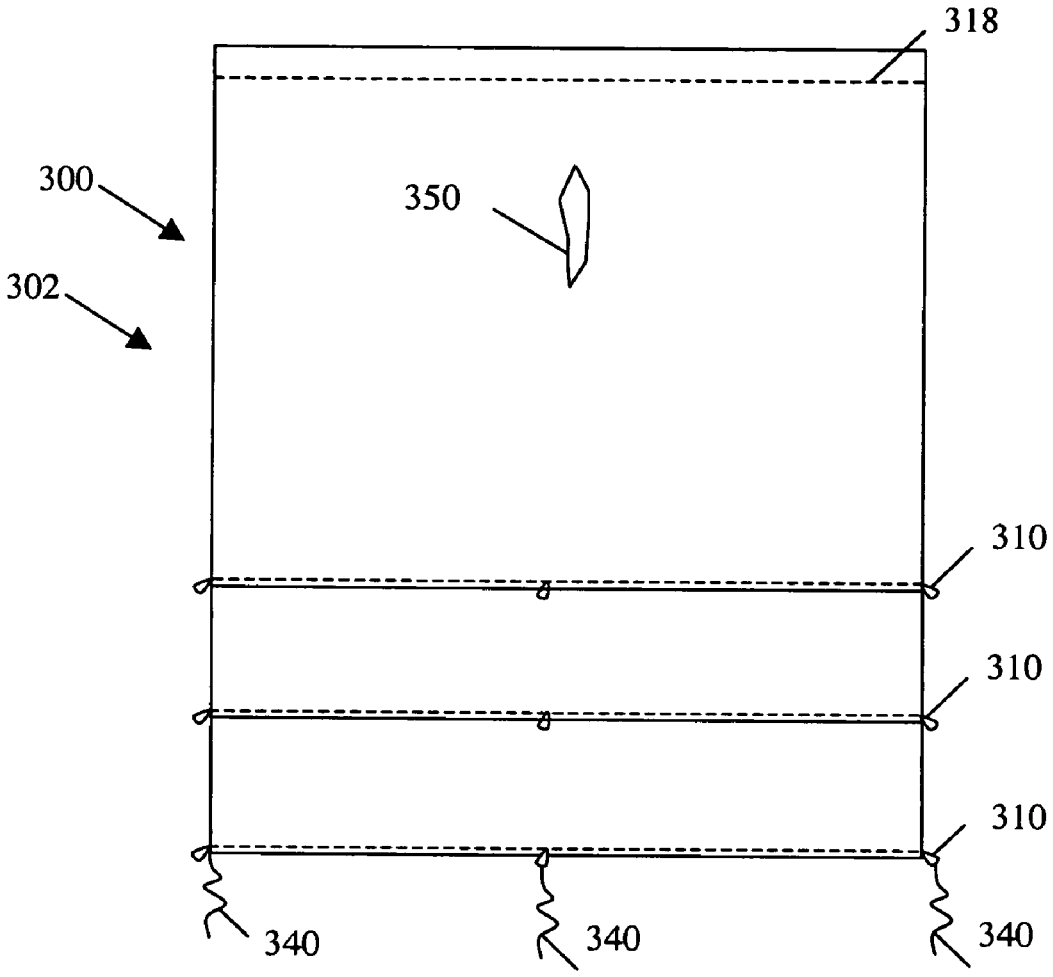
Figure 3C:
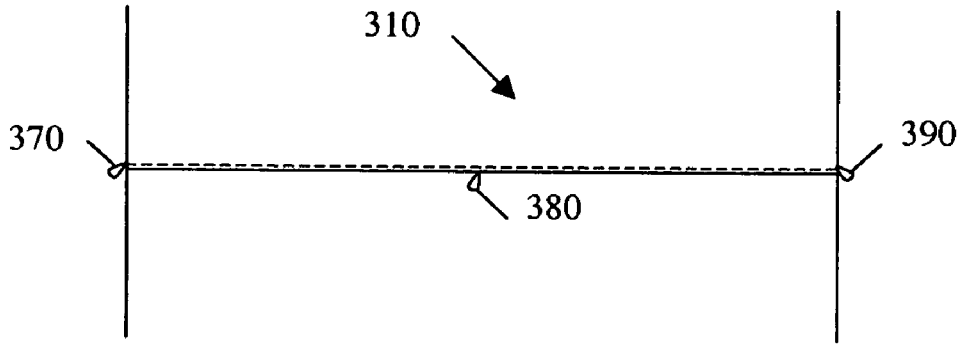
Figure 3D:
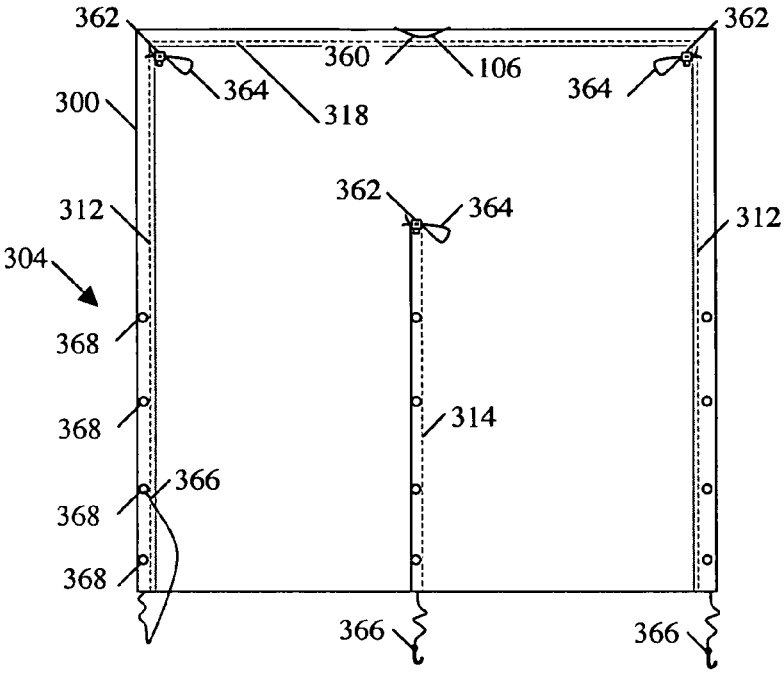
Figure 3G:
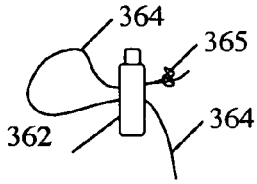
Figure 3H:
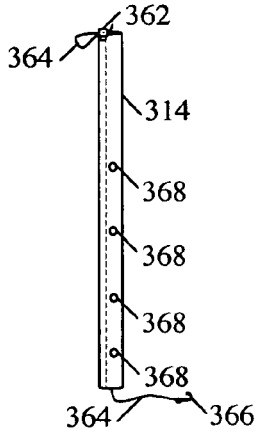
Figure 3E:
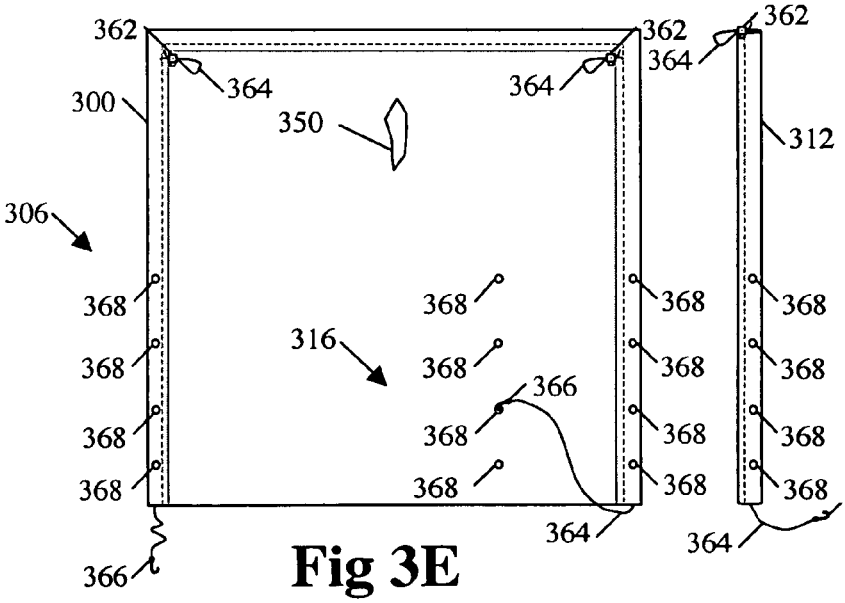
Figure 3F:
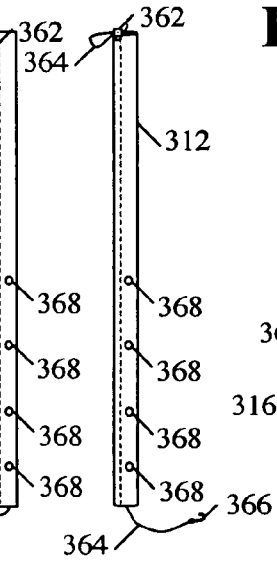
Figure 3I:
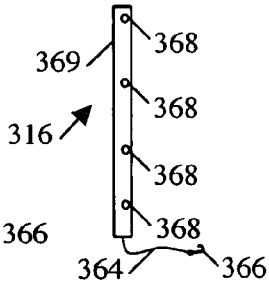
Figure 3J:
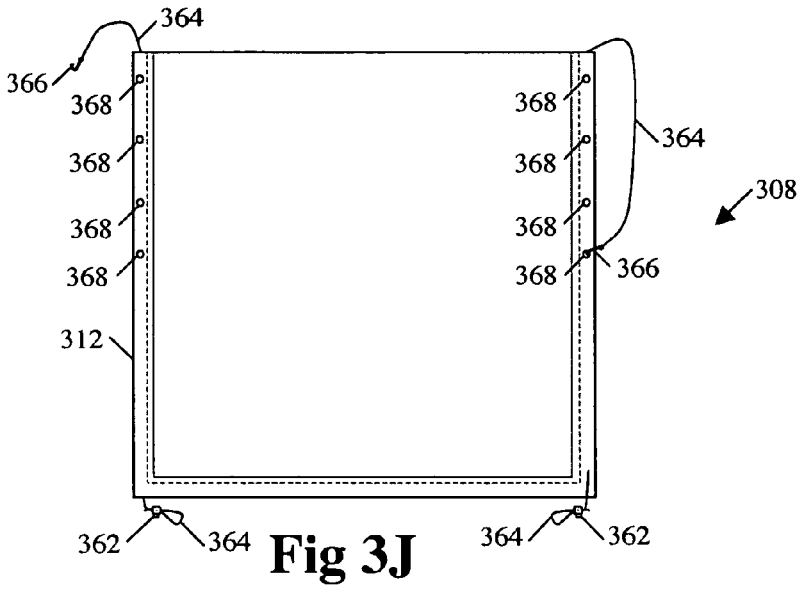
Figure 3K:
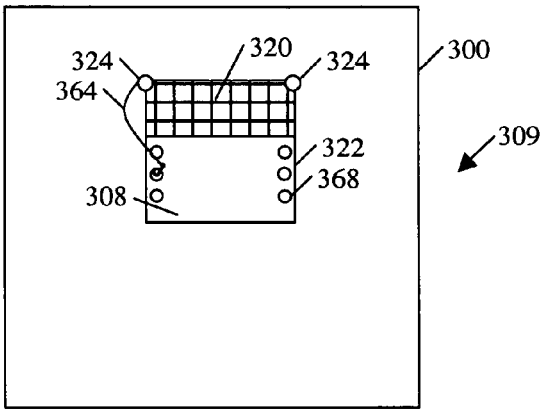
Figure 3L:
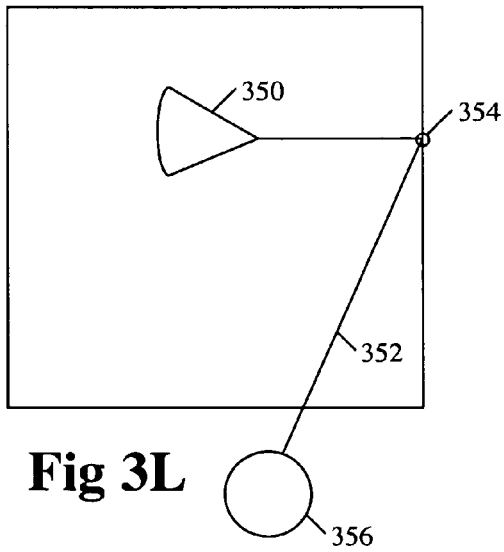
Figure 3M:
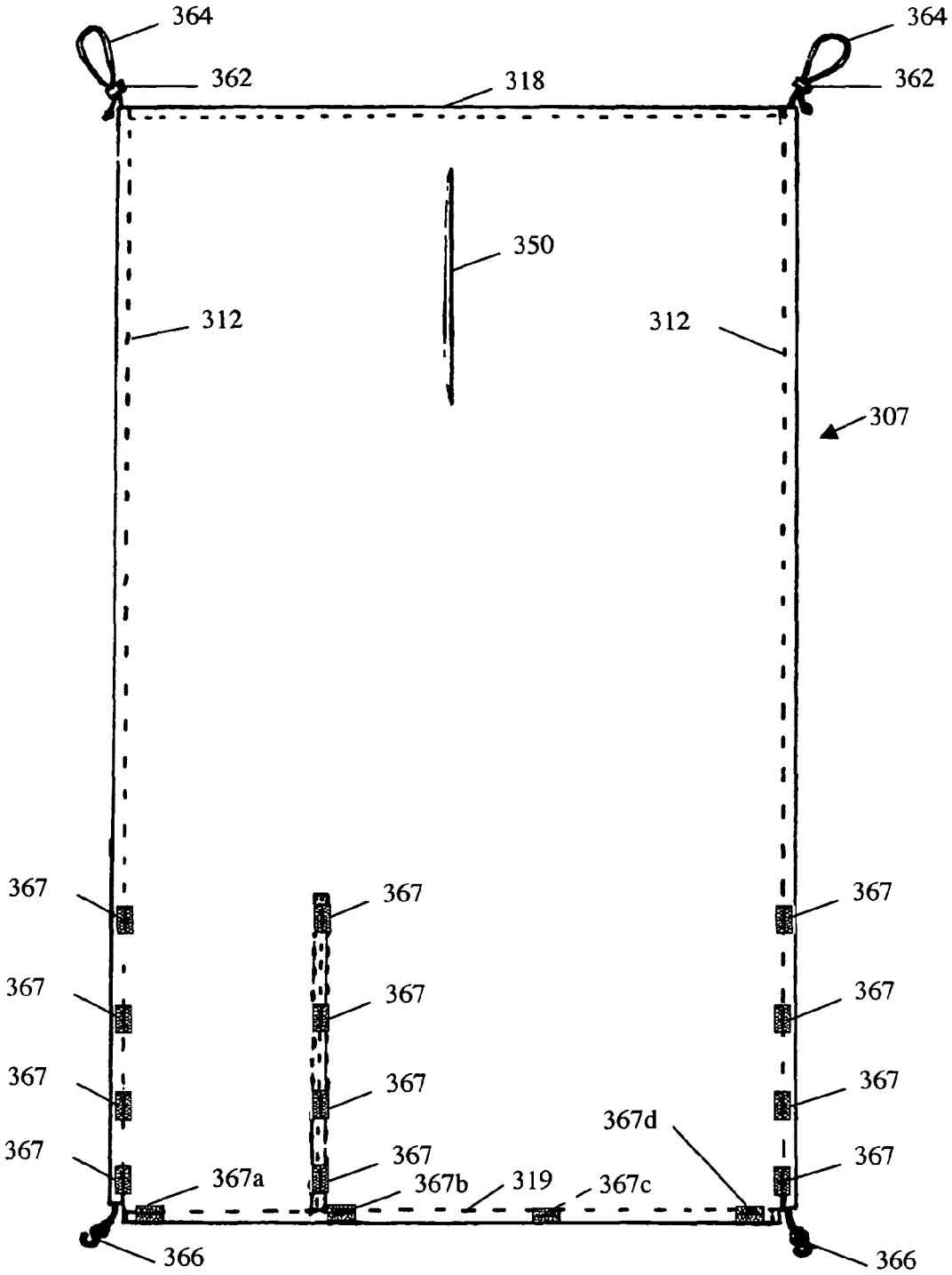

FIG. 3M shows an alternate curtain embodiment.

FIG. 4A through 4E show exemplary uses of the present invention.

Figure 4A:
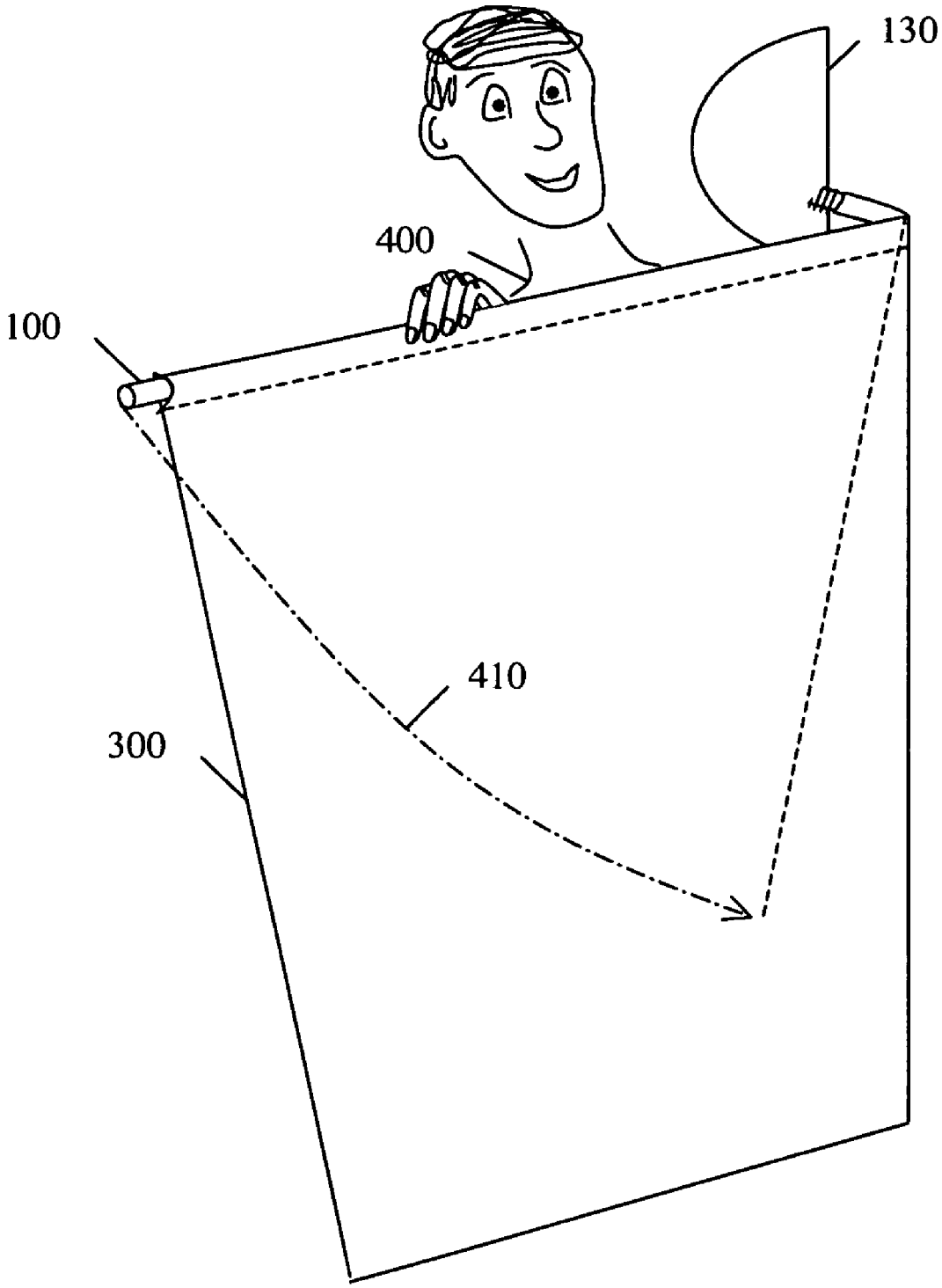
Figure 4B:
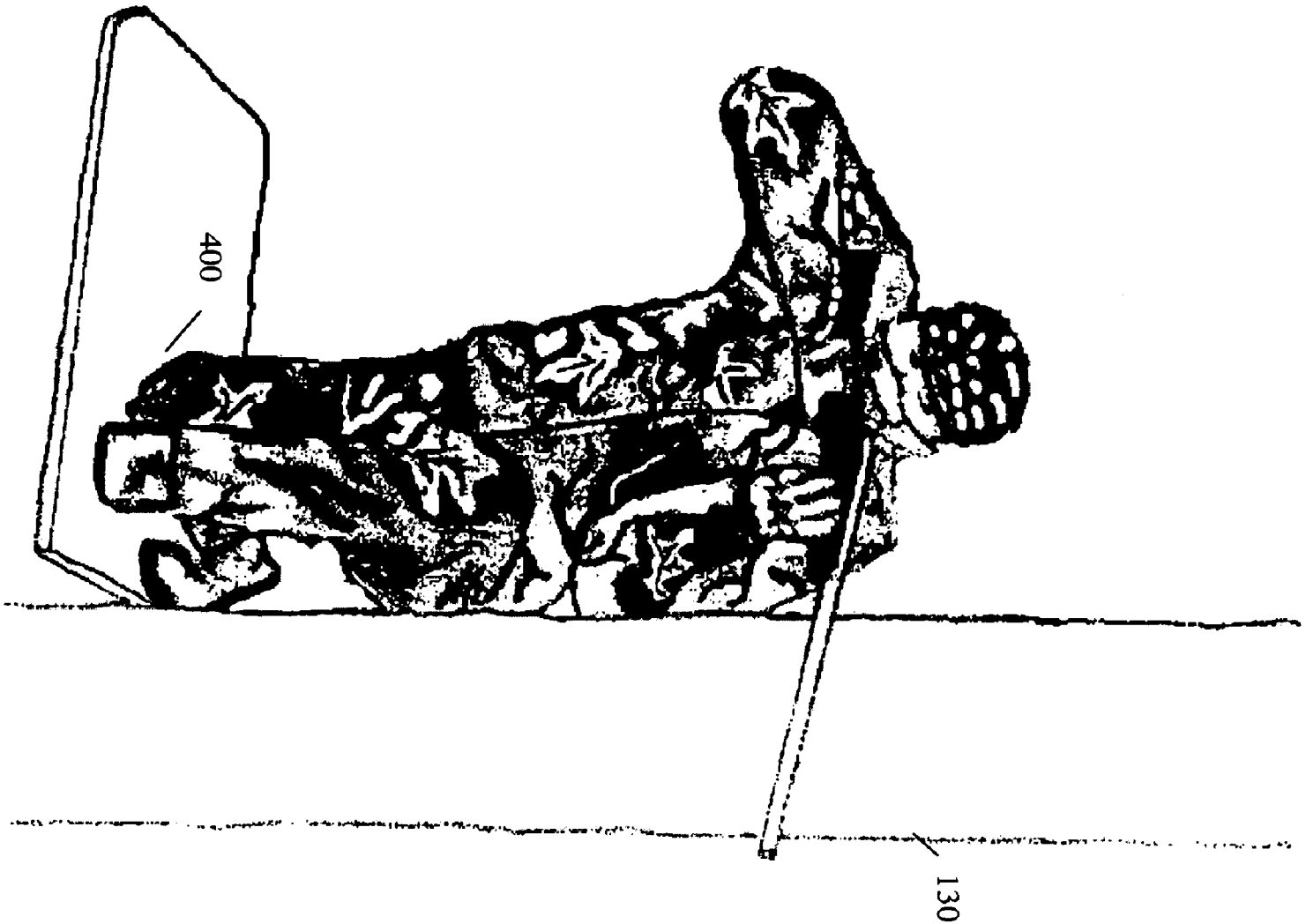
Figure 4C:
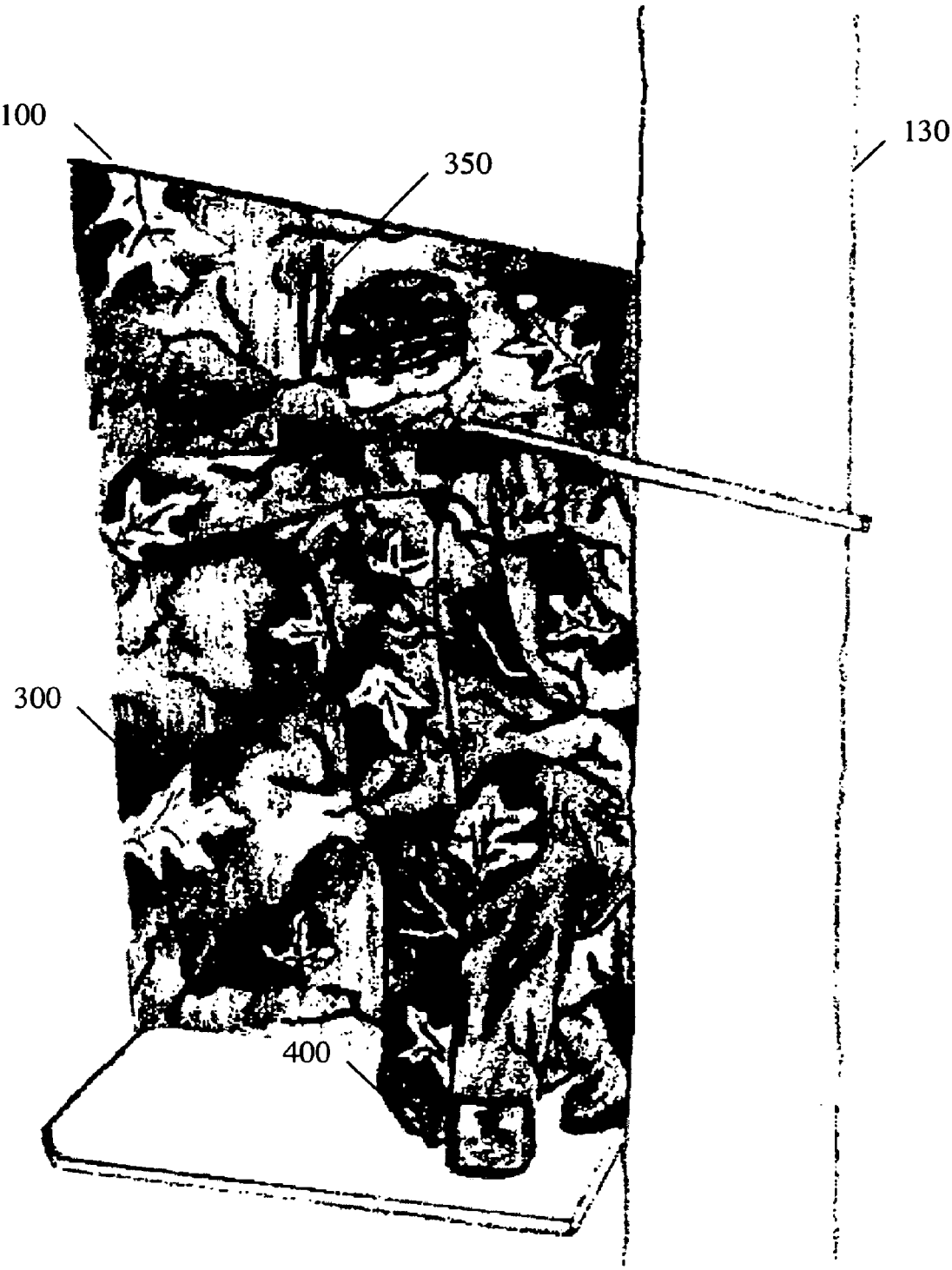
Figure 4D:
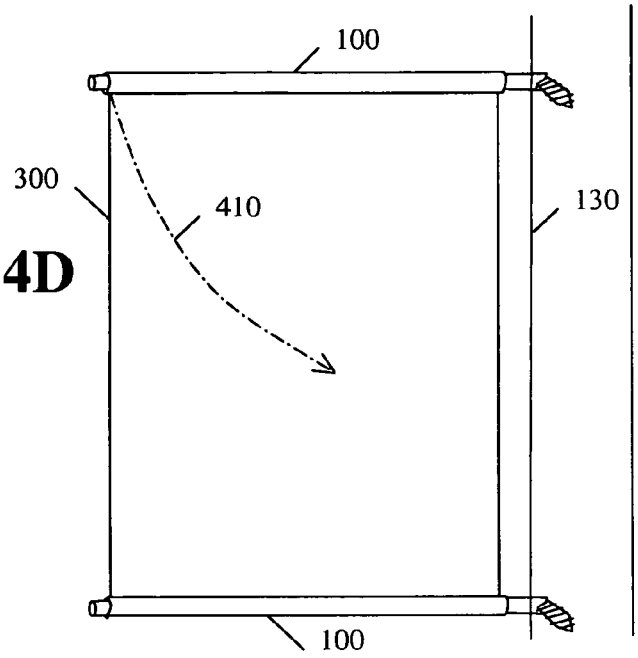
Figure 4E:
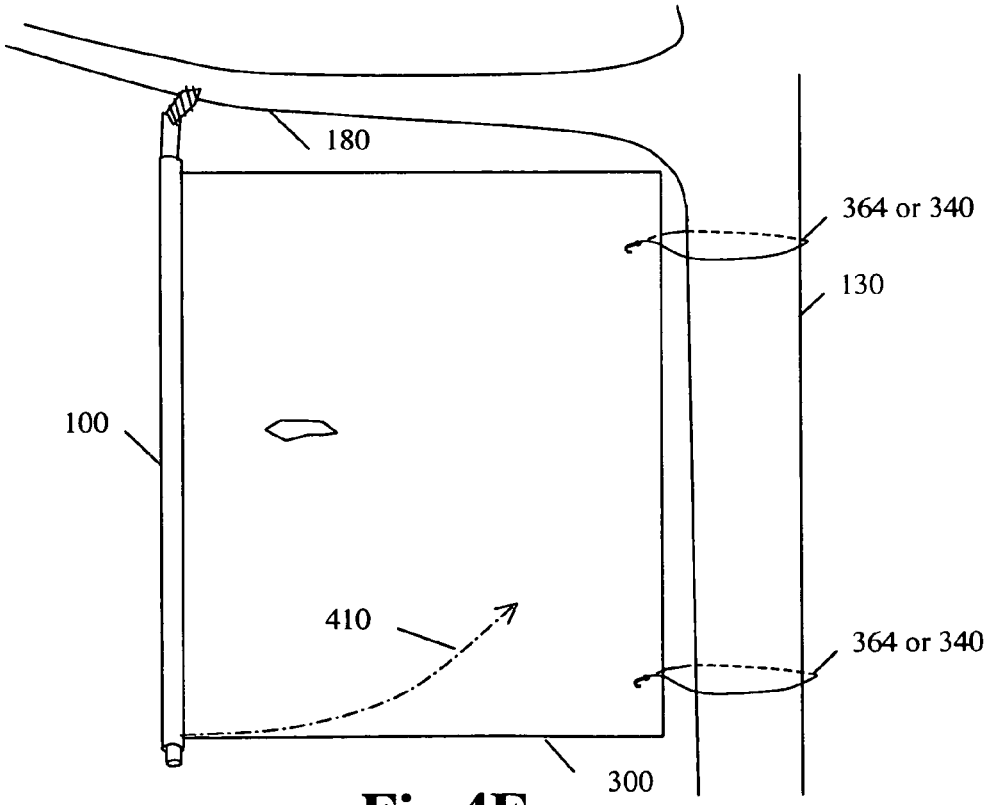
Figure 4F:
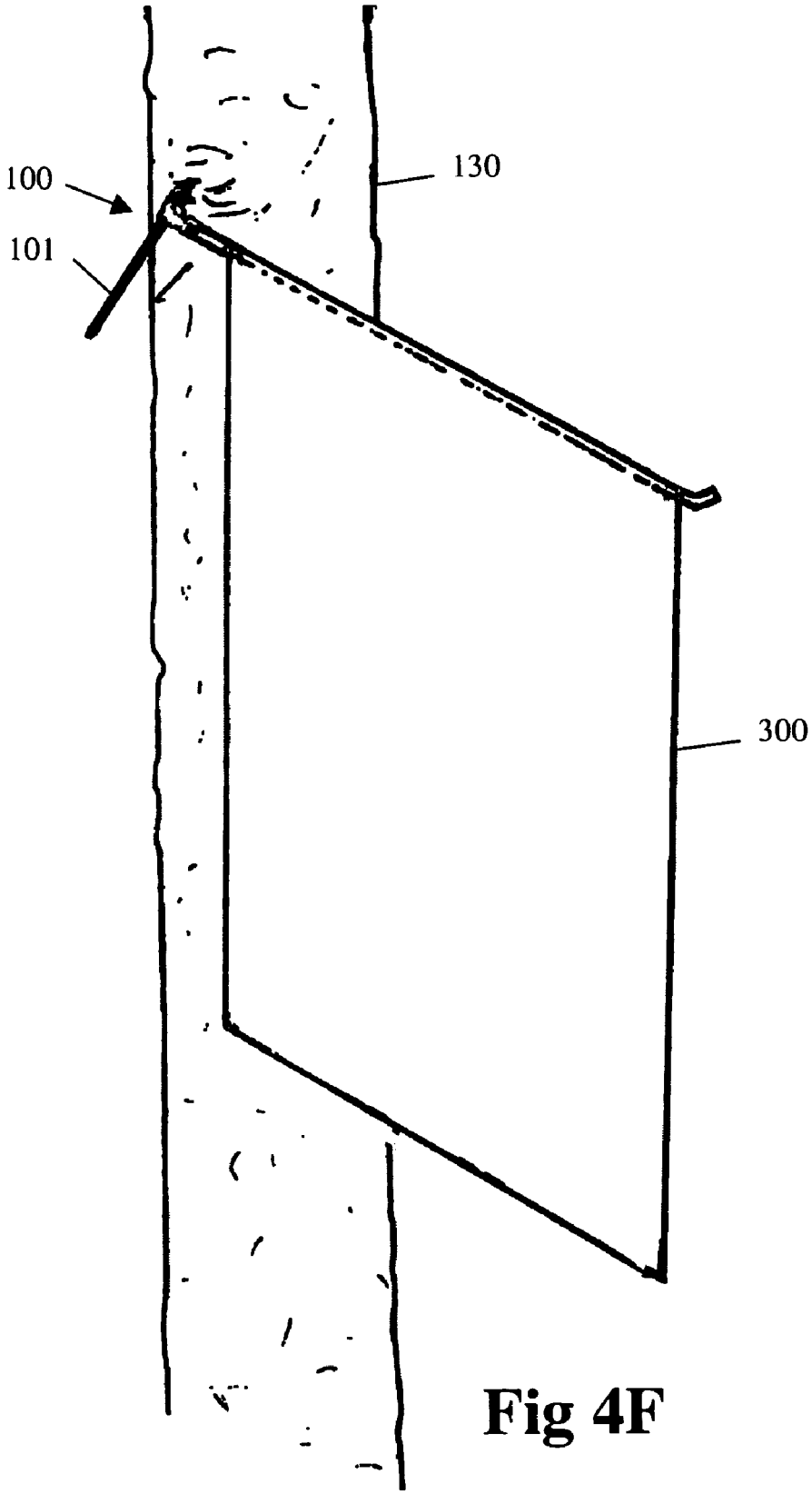

FIG. 4F shows exemplary use of the alternate support embodiment.

Figure 5A:
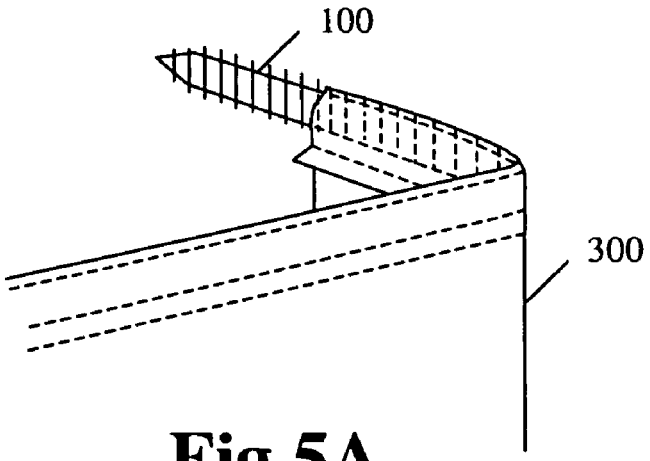
Figure 5B:
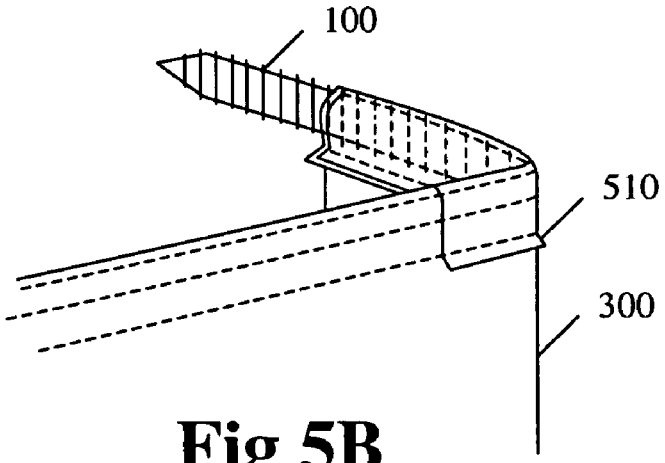
Figure 5C:
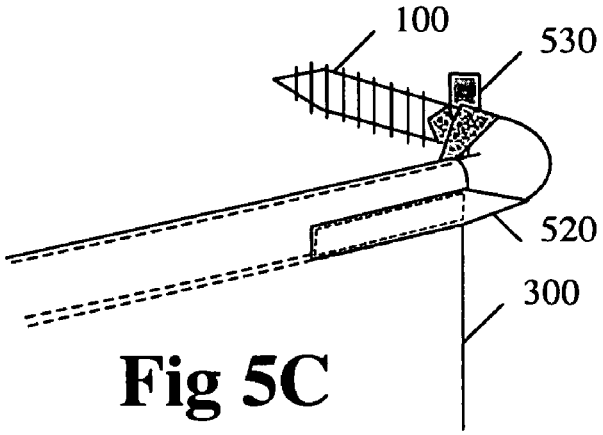

FIG. 5A through FIG. 5C show embodiments of curtain attachments.

FIG. 6A through FIG. 6D show T-shaped embodiments of the present invention.

FIG. 7A through FIG. 7G show connectors and their use.

FIG. 8A through FIG. 8E show loop support embodiments.

FIG. 9A through FIG. 9E show details of loop support with a supporting cord.

FIG. 10A through FIG. 10F show alternate embodiments.

FIG. 11A through FIG. 11H show alternate embodiments.

Figure 12:
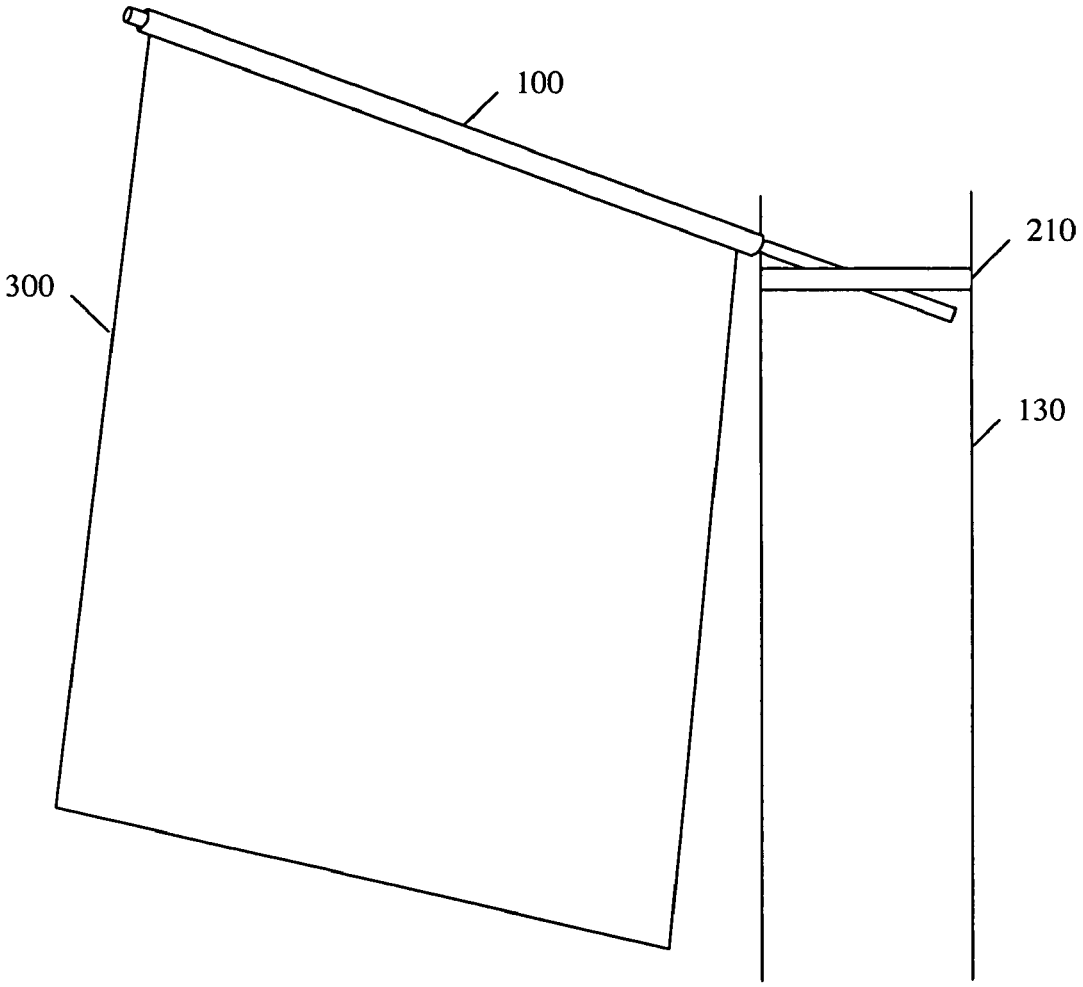

FIG. 12 shows an alternate embodiment.

Figure 13:
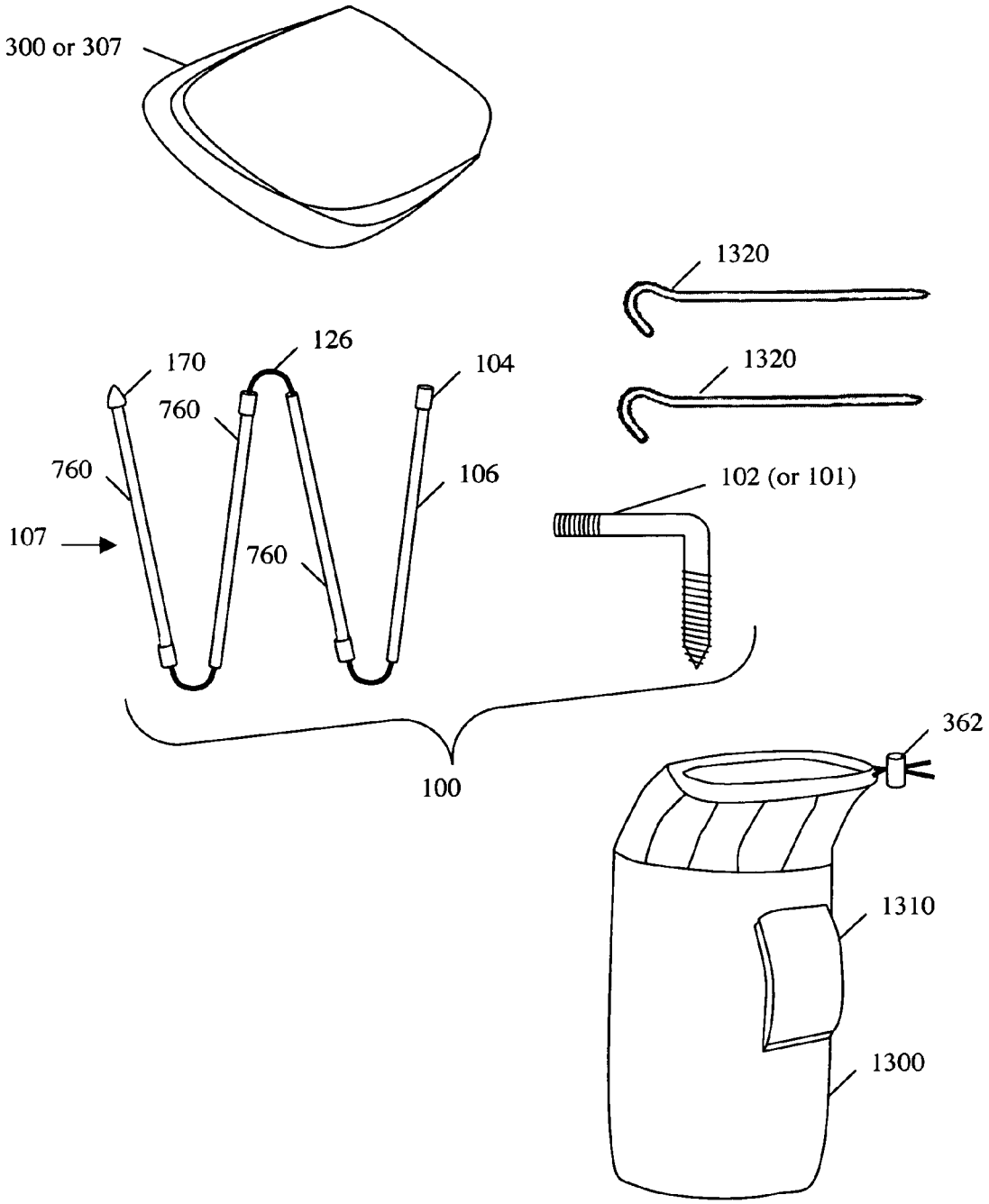

FIG. 13 shows an exemplary lightweight portable embodiment.

Figure 14A:
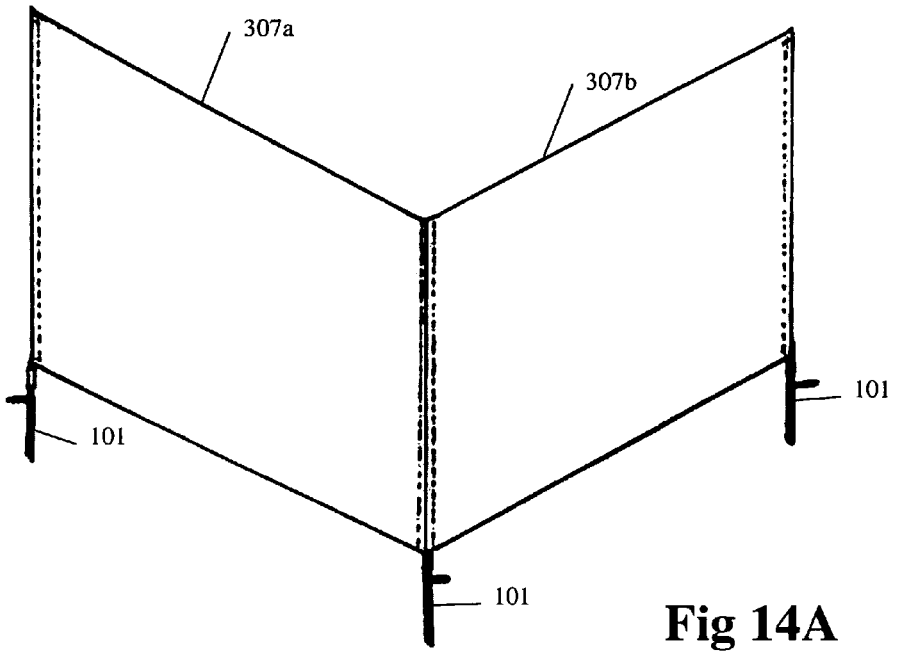
Figure 14B:
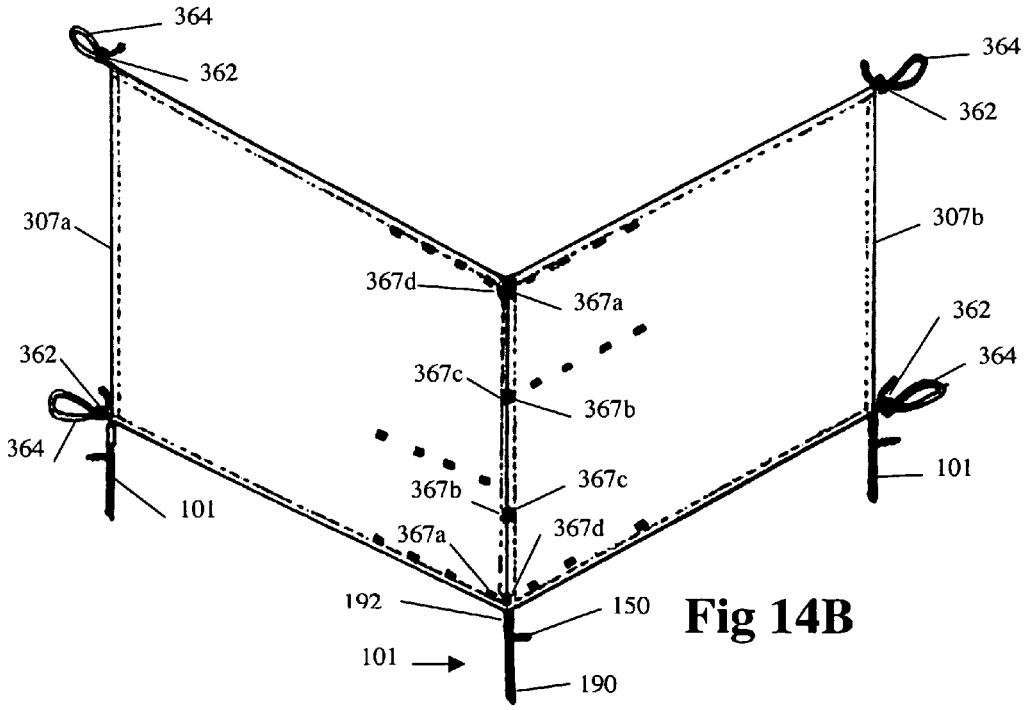

FIG. 14A and FIG. 14B show ground blind embodiments.

Figure 14C:
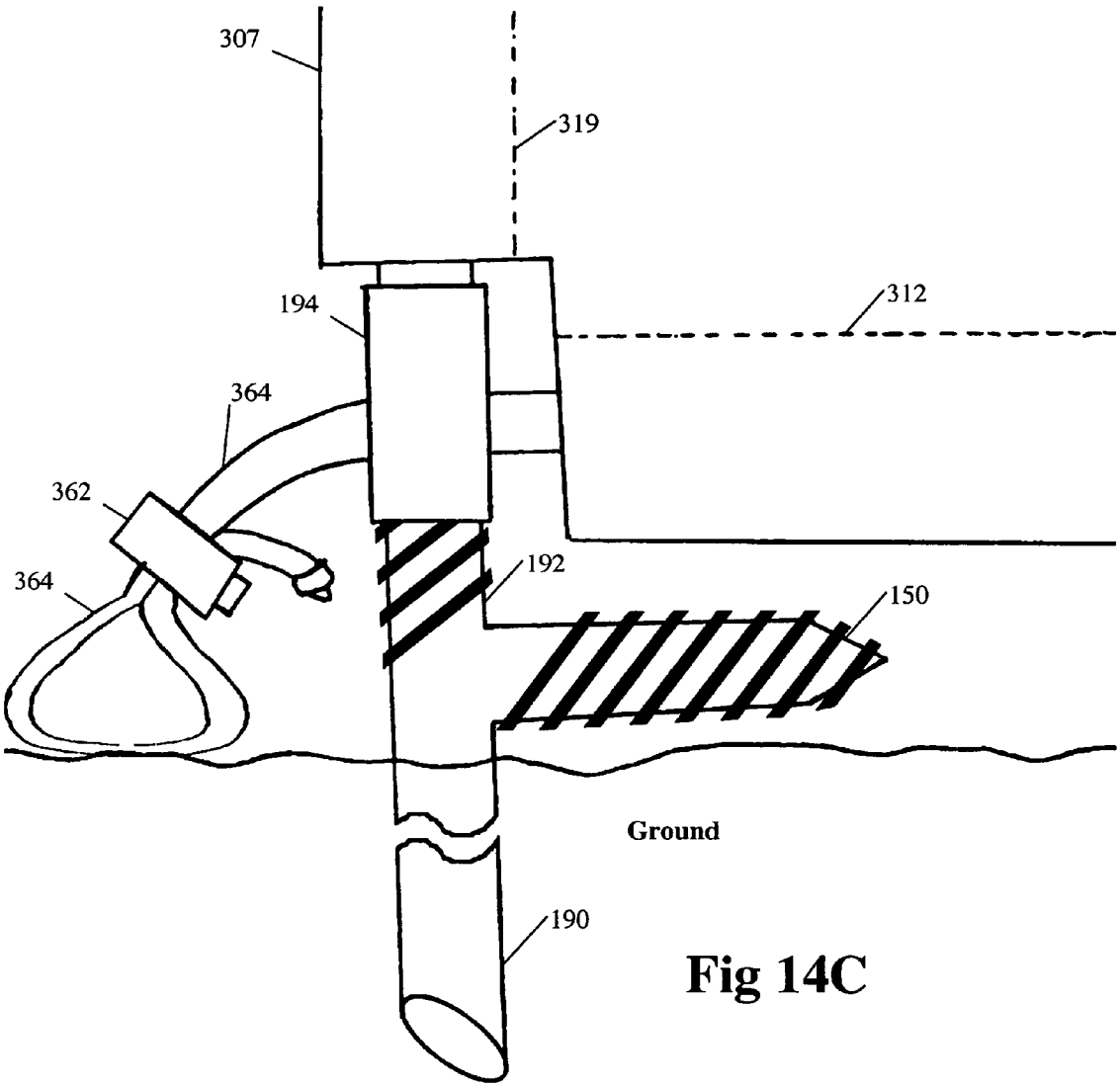
Figure 14D:
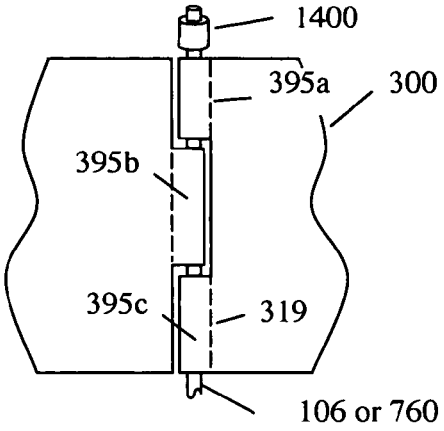
Figure 14E:
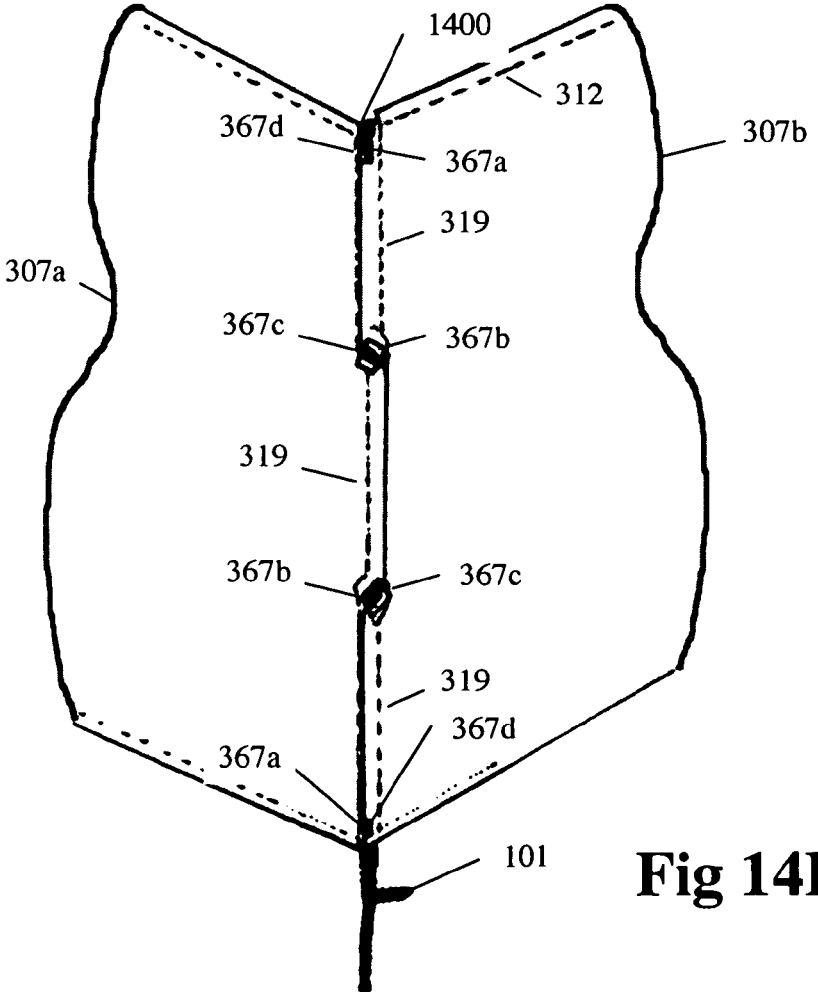
Figure 14F:
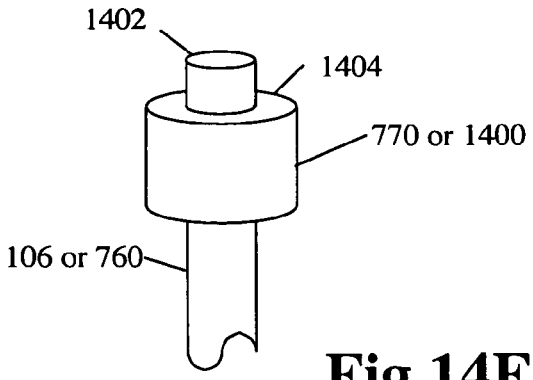
Figure 14G:
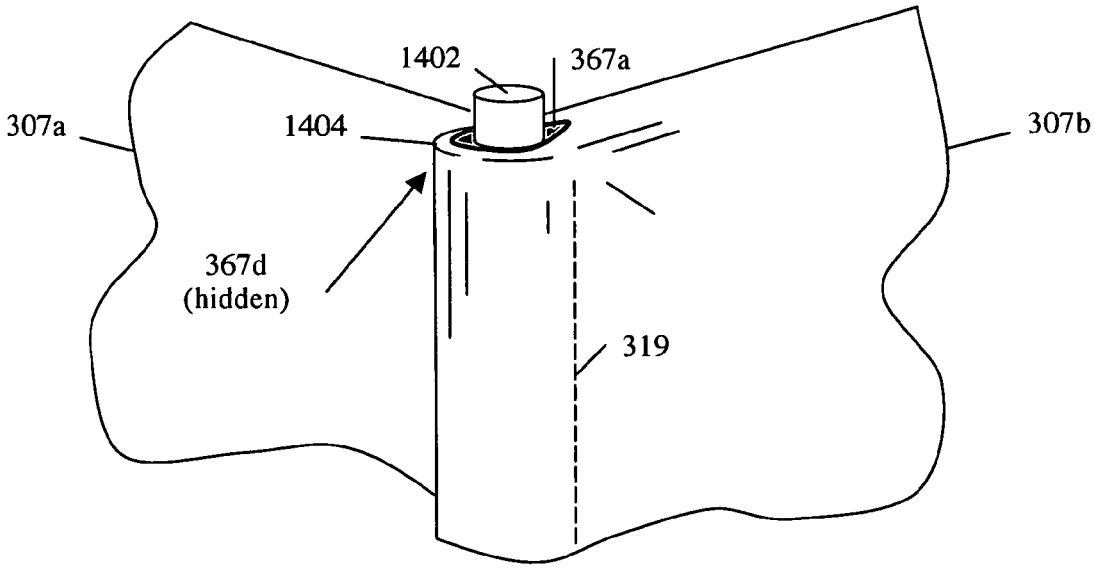
Figure 14H:
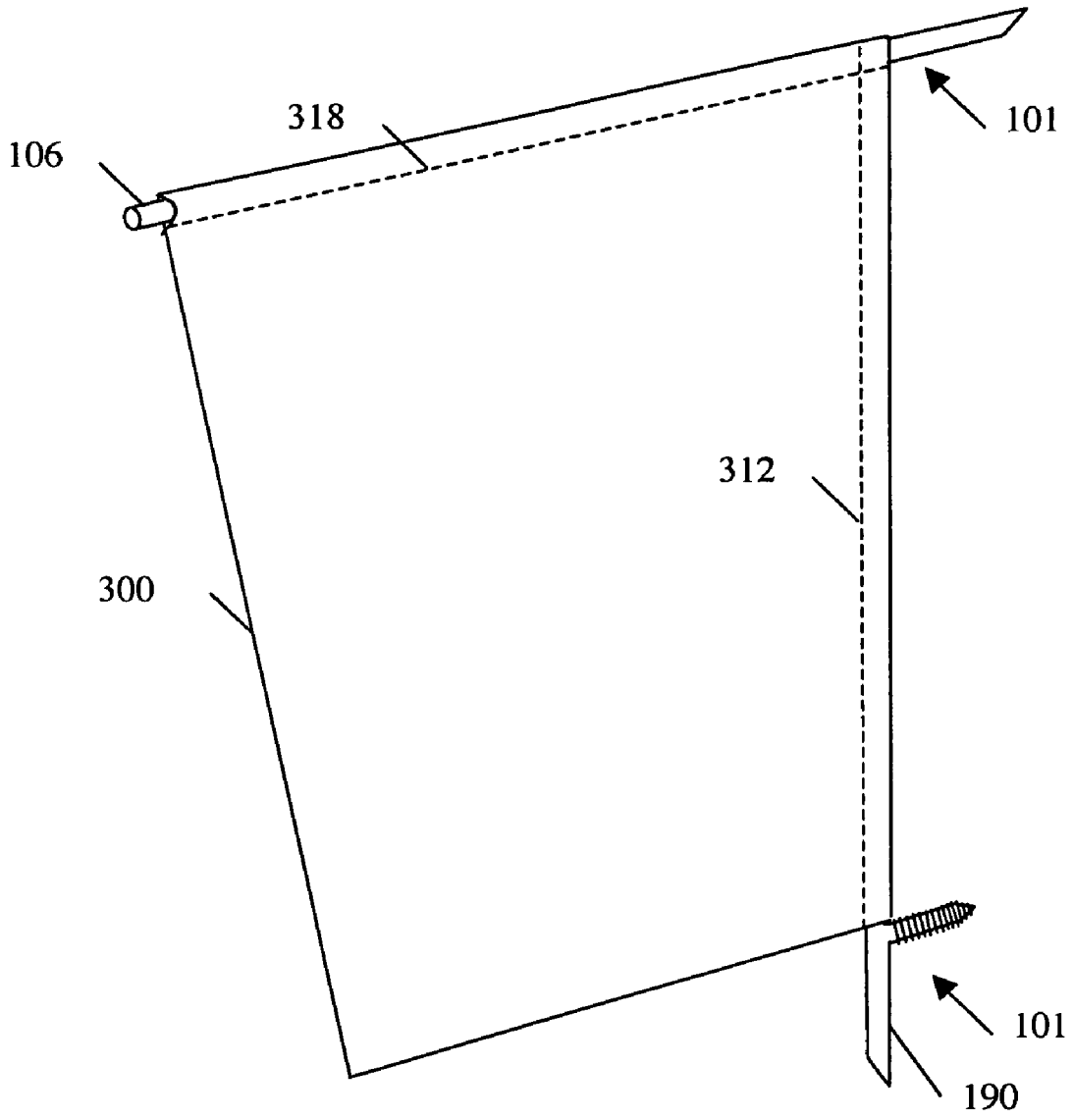

FIG. 14C though FIG. 14H shows details of the ground blind embodiments.

FIG. 15A through FIG. 15J show modular components of a covered blind or shelter structure.

FIG. 16A through FIG. 16G show various configurations of the modular system.

FIG. 16H through FIG. 16Q and FIG. 16SS shows various embodiments of the rain fly and cover components.

Figure 16A:
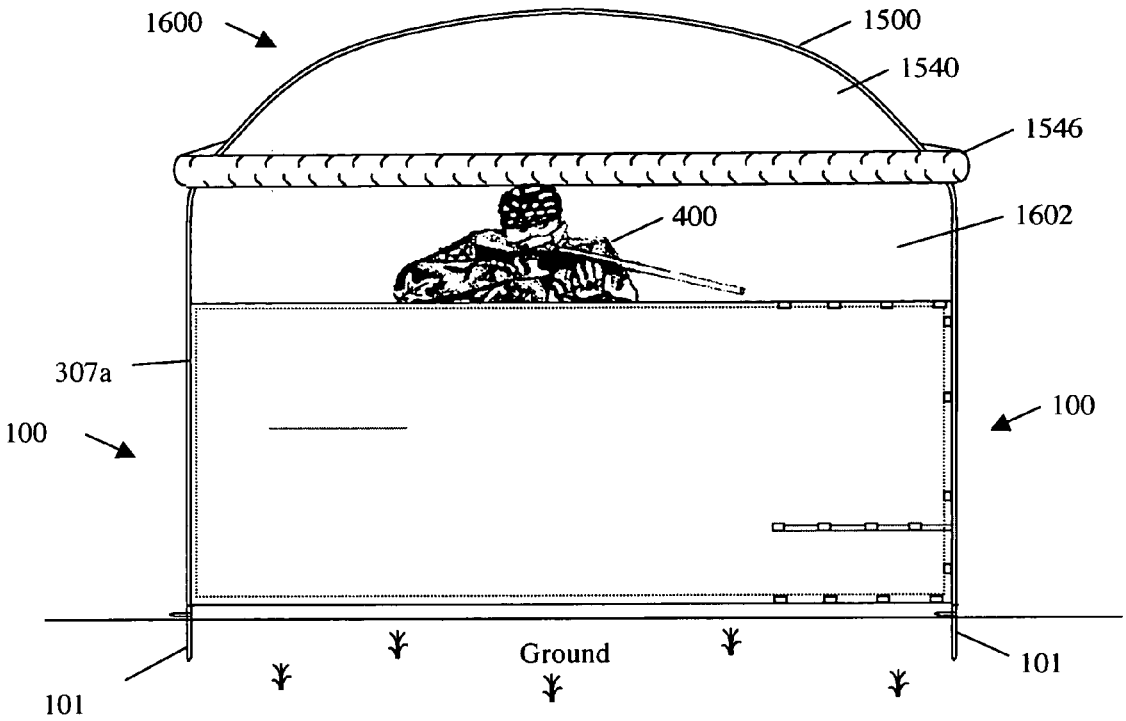
Figure 16B:
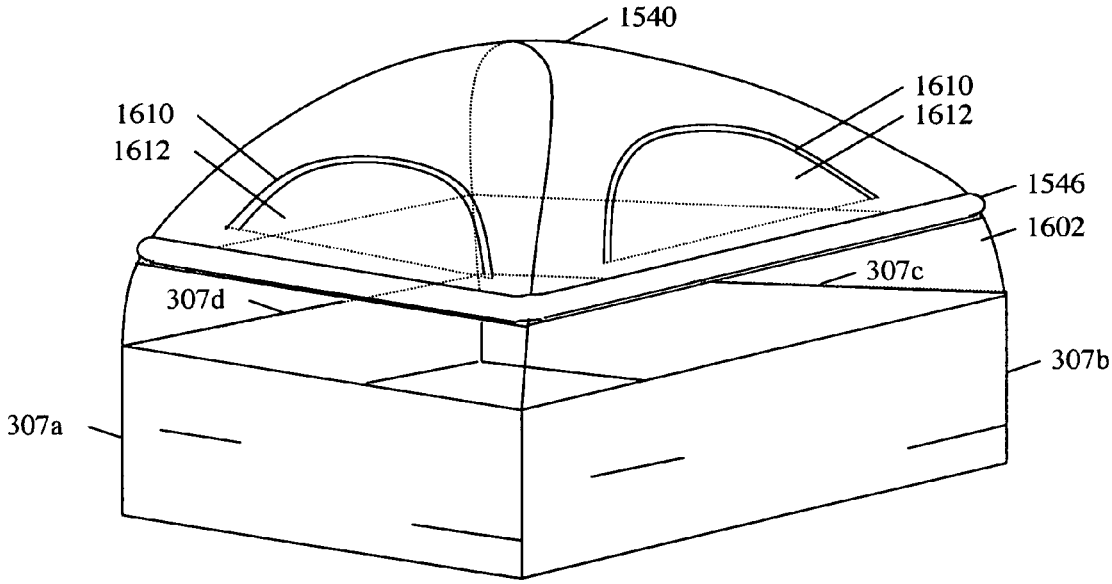
Figure 16C:
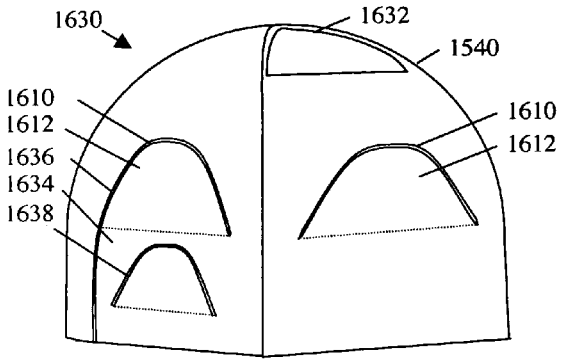
Figure 16D:
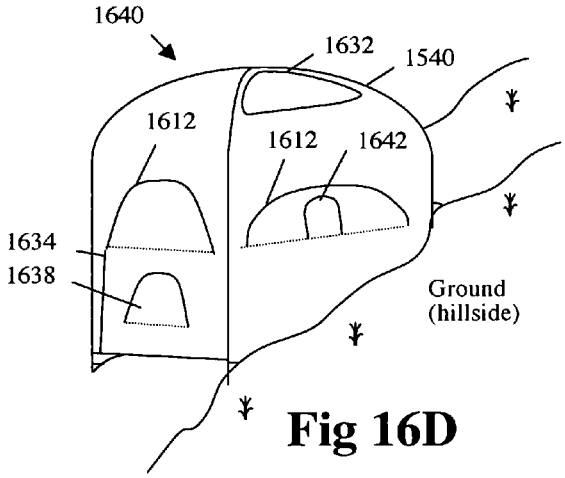
Figure 16E:
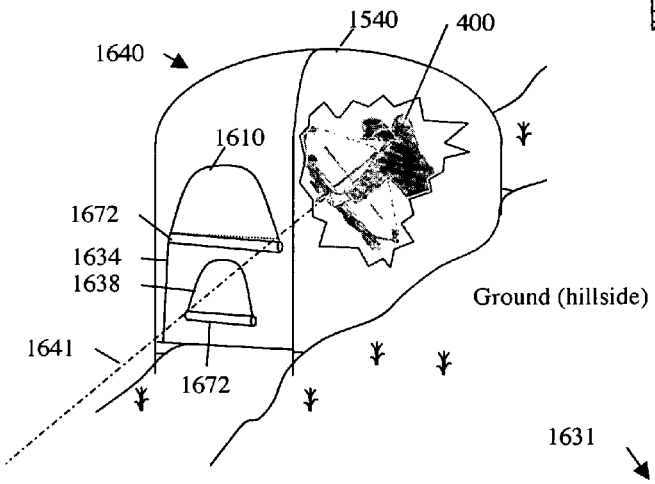
Figure 16F:
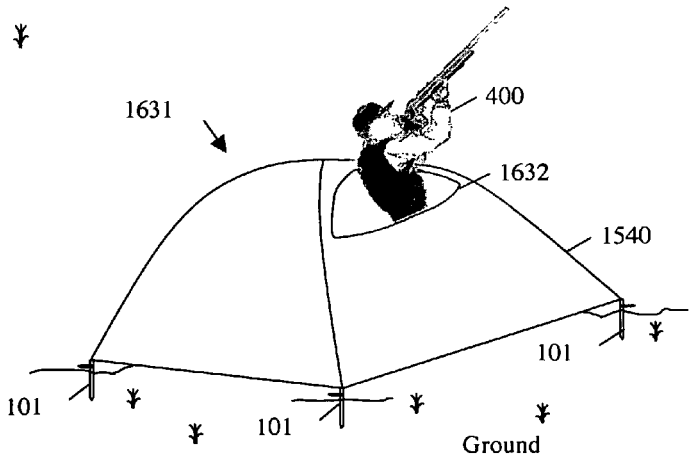
Figure 16G:
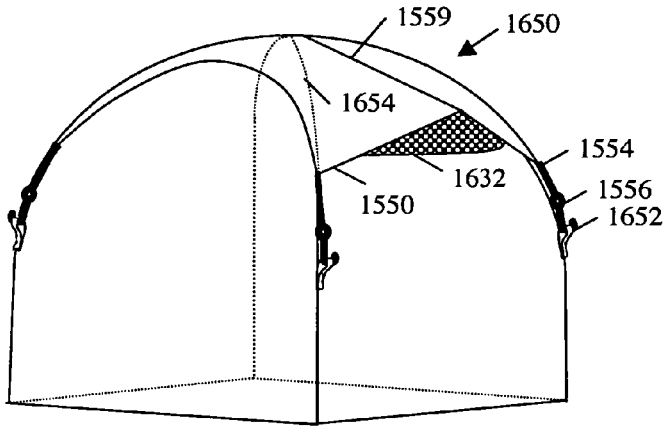
Figure 16H:
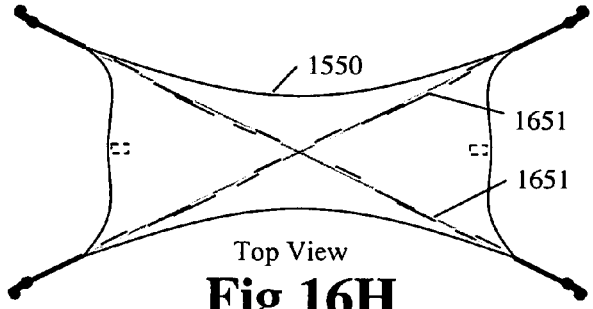
Figure 16I:
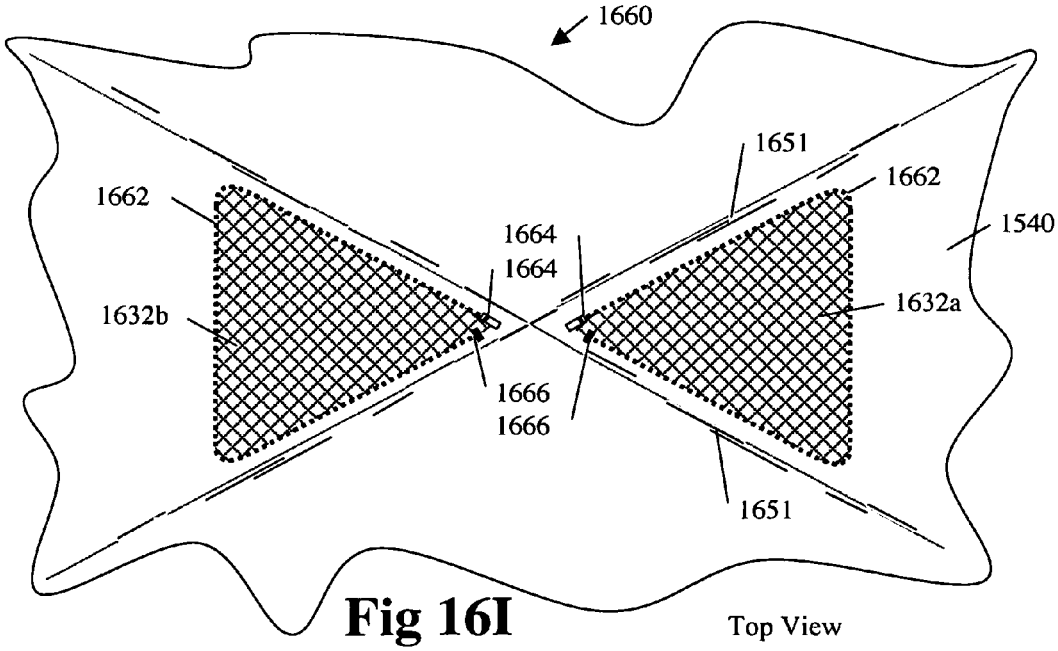
Figure 16J:
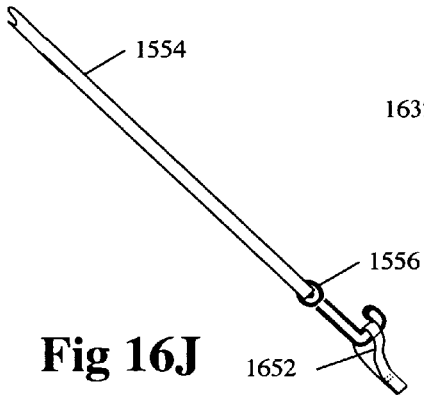
Figure 16K:
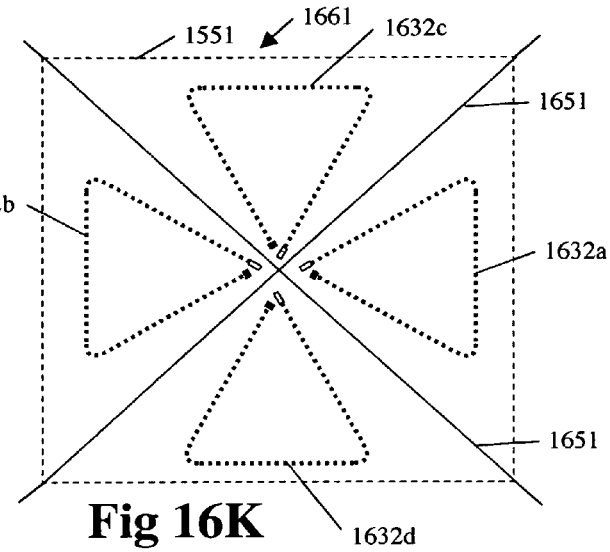
Figure 16L:
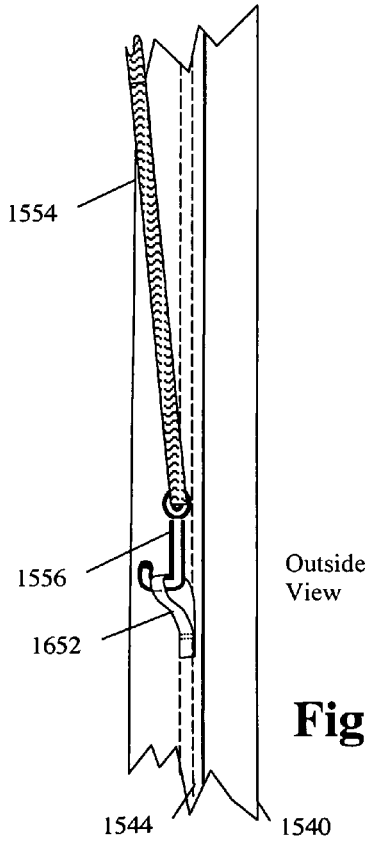
Figure 16M:
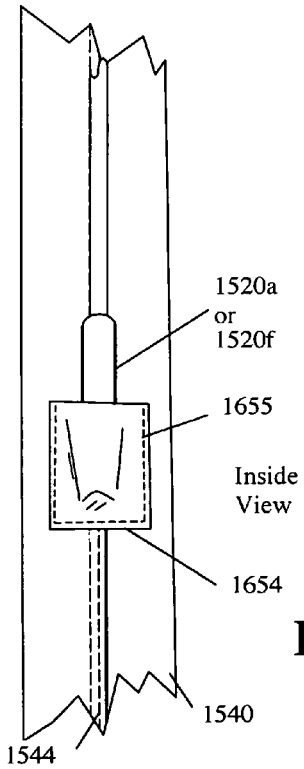
Figure 16N:
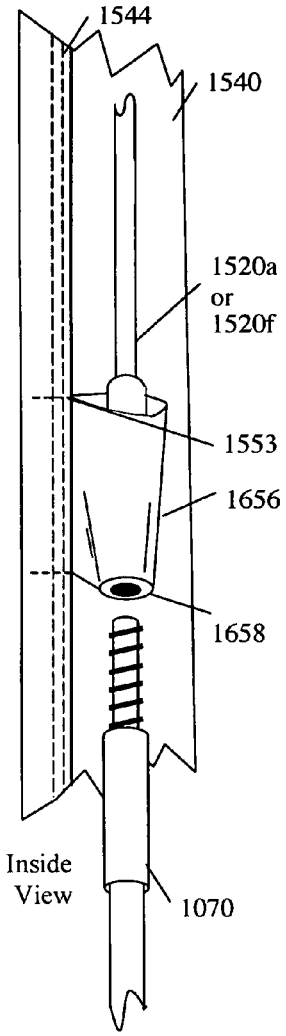
Figure 16O:
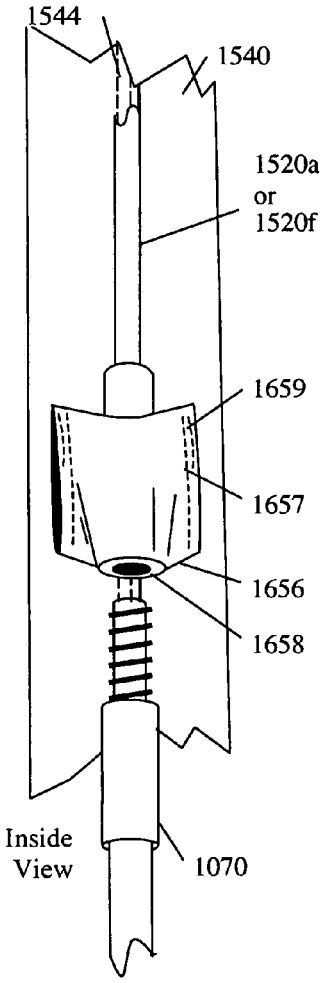
Figure 16P:
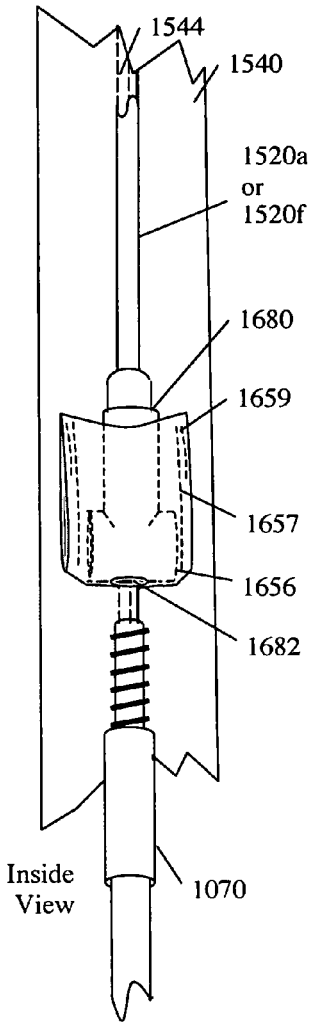
Figure 16Q:
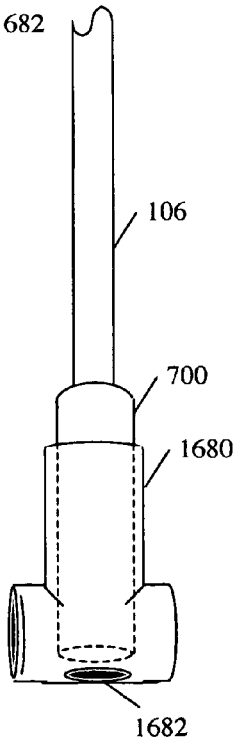
Figure 16R:
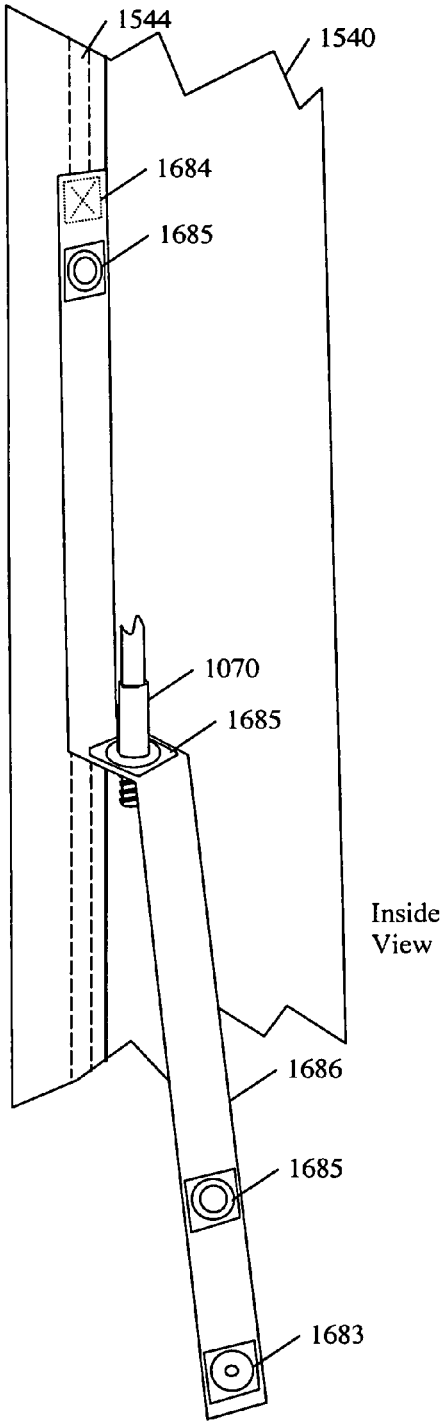
Figure 16S:
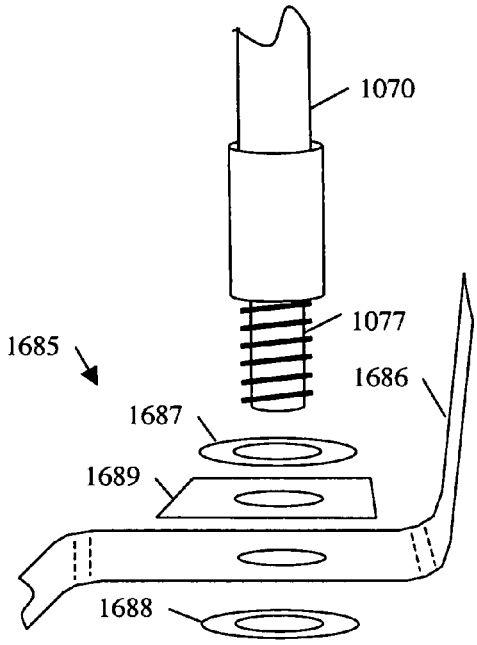
Figure 16T:
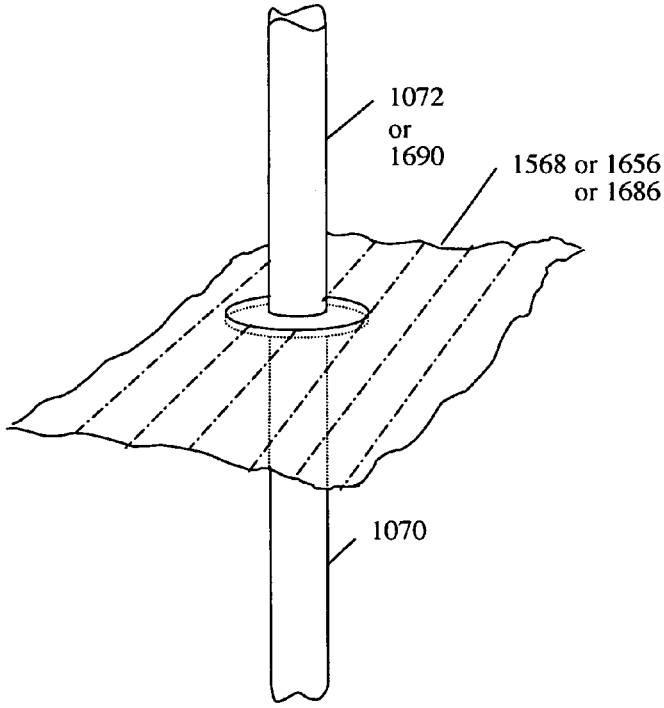

FIG. 16R through 16T show how the shaft segments can pass through and hold blind or shelter material or straps.

Figure 16U:
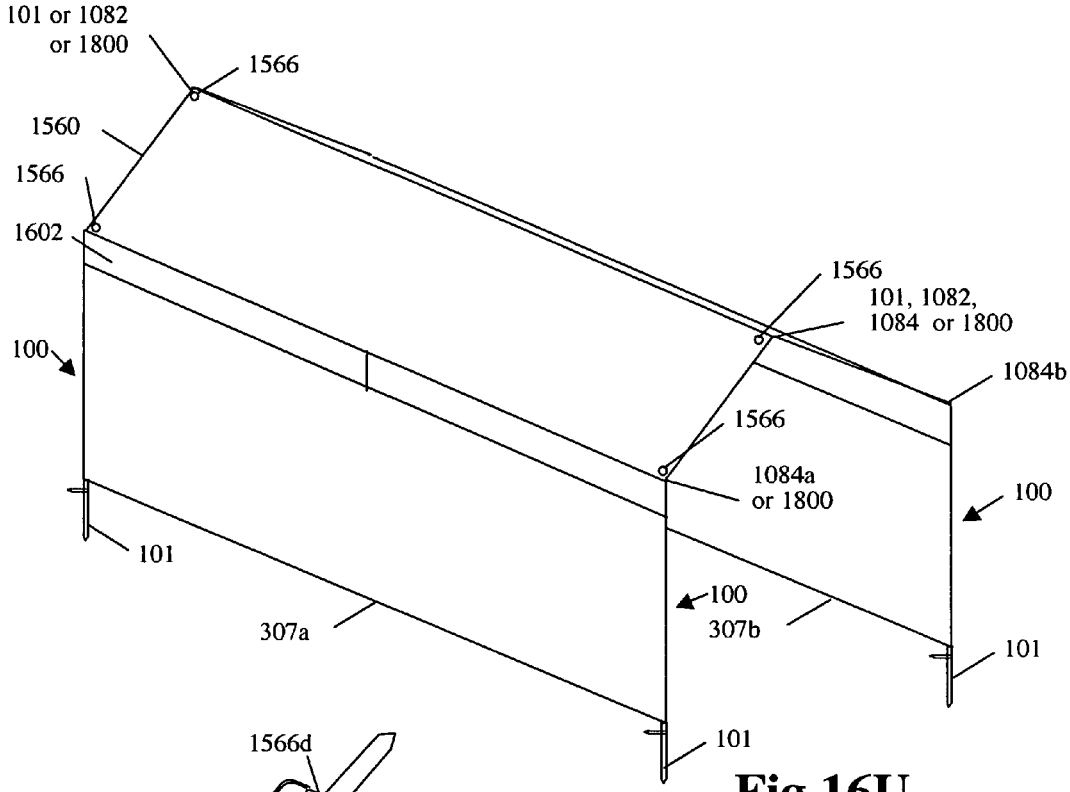

FIG. 16U through FIG. 16CC show various configurations that can be constructed using the module components of the present invention.

FIG. 16DD through FIG. 16KK show various arched configurations and features.

FIG. 16LL through FIG. 16RR show various pyramid configurations and features.

FIG. 17A through FIG. 17D show various embodiments of flies and shields components.

FIG. 17E through FIG. 17H shows various connectors.

FIG. 18A through FIG. 18J show an adjustable multi-legged bracket and its use with various modules.

FIG. 19A through FIG. 19H show various embodiments for allowing shoot-through or blackout panels to be positioned in the openings.

FIG. 20A through 20D shows an embodiment with a cover, a skirt, and horizontally movable panels in the openings between the cover and the skirt and various details skirt and door attachements.

FIG. 21A through FIG. 21G show various embodiments and operation of hinged inserting ends.

Figure 22A:
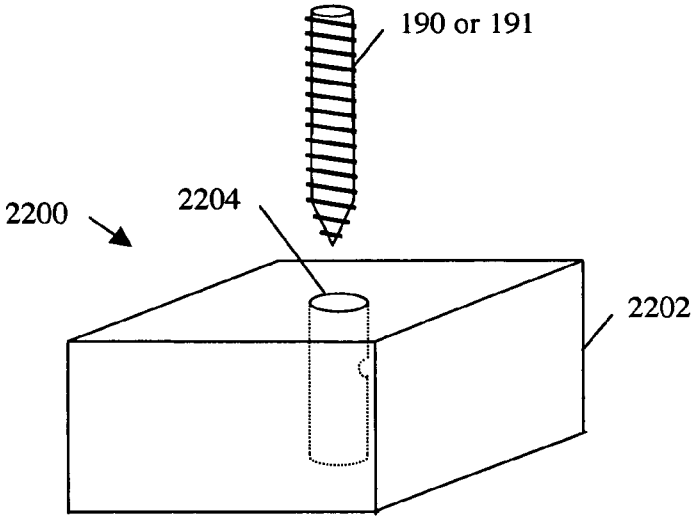
Figure 22B:
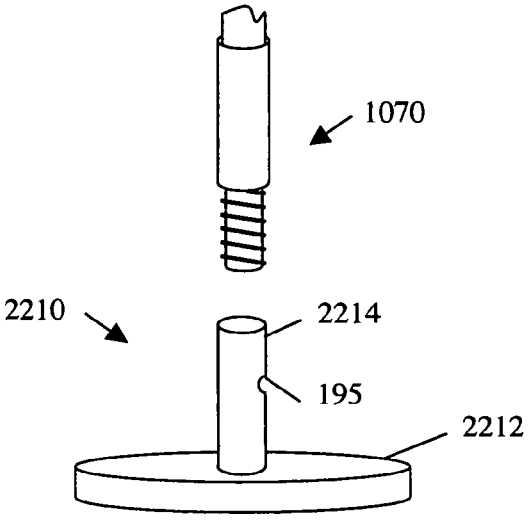
Figure 22C:
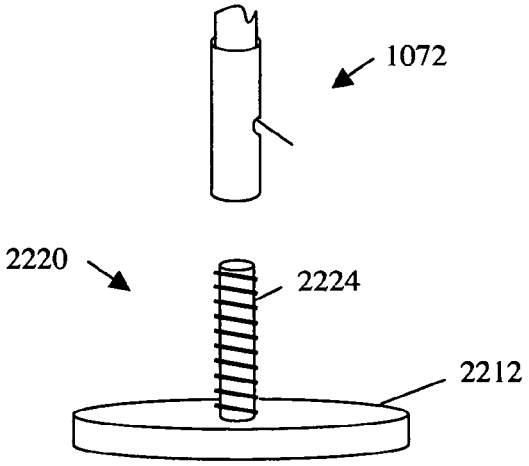

FIG. 22A through FIG. 22C show various base supports for placing a modular structure on a hard surface.

REFERENCE NUMERALS IN DRAWINGS

| | |
|---|---|
| 100 | attaching pivoting support |
| 101 | (b) 3-legged alternate support |
| 101 | (c) 4-legged alternate support |
| 101 | alternate support |
| 102 | threaded support |
| 104 | threaded connector |
| 106 | shaft |

-continued

| | |
|---|---|
| 107 | segmented shaft |
| 108 | telescoping shaft |
| 109 | threaded segmented shaft |
| 110 | plate |
| 112 | plate connection |
| 114 | plate sleeve |
| 120 | drilled support |
| 122 | drilled receiving shaft |
| 124 | fastener |
| 126 | (a) cord |
| 126 | (b) cord attachment or knot |
| 126 | elastic cord |
| 130 | attaching structure |
| 140 | bend |
| 150 | first leg |
| 160 | second leg |
| 170 | end-cap |
| 180 | horizontal structure |
| 190 | third leg |
| 191 | threaded third leg |
| 192 | alternate second leg |
| 193 | fourth leg |
| 194 | dimpled connector |
| 194 | (a) spirally dimpled connector |
| 194 | (b) parallel dimpled connector |
| 194 | (c) partial dimpled connector |
| 194 | (d) enhanced dimpled connector |
| 194 | (e) alternate dimpled connector |
| 194 | (f) slot attaching dimpled connector |
| 194 | dimpled connector |
| 195 | (a-r) dimple |
| 195 | (s) midpoint dimple |
| 196 | pin |
| 197 | (a-c) retaining dipple |
| 198 | (a-b) deeper dimple |
| 199 | shaft segment |
| 200 | attaching belt |
| 210 | strap |
| 220 | tension means |
| 230 | attaching fastener |
| 240 | threaded receptor |
| 300 | curtain |
| 302 | anchored curtain |
| 304 | draw-curtain |
| 306 | enhanced draw-curtain |
| 307 | (a-d) alternate curtain |
| 308 | window cover |
| 309 | windowed curtain |
| 310 | anchor point |
| 312 | edge hem |
| 314 | interior hem |
| 316 | grommet group |
| 318 | support hem |
| 319 | alternate support hem |
| 320 | see-through |
| 322 | window |
| 324 | window grommet |
| 340 | tie |
| 350 | slit |
| 352 | slit cord |
| 354 | side grommet |
| 356 | pull loop |
| 360 | cord cutout |
| 362 | drawstring clip |
| 364 | drawstring |
| 365 | drawstring knot |
| 366 | drawstring fastener |
| 367 | (a-d) reinforced holes |
| 368 | grommet |
| 369 | grommet reinforcement |
| 370 | first anchor point |
| 380 | second anchor point |
| 390 | third anchor point |
| 395 | (a-c) hem segment |
| 400 | operator |
| 410 | path |
| 510 | hem reinforcement |
| 520 | fastening strap |
| 530 | hook and loop fastener |
| 600 | T-shaped support |

-continued

| | |
|---|---|
| 605 | cross bar |
| 610 | first ring end |
| 620 | second ring end |
| 630 | ring |
| 640 | curtain opening |
| 700 | straight connector |
| 710 | angled connector |
| 720 | reinforced angled connector |
| 730 | connector reinforcement |
| 740 | support with angled connector |
| 750 | shaft with angled connector |
| 760 | (a-e) connected shaft |
| 770 | connector insert |
| 780 | top rail |
| 782 | bottom rail |
| 784 | rail ring |
| 790 | flexible connector |
| 800 | double support ring |
| 810 | segmented ring |
| 820 | curtained ring |
| 900 | supporting cord |
| 910 | hoop |
| 915 | overhead structure |
| 920 | eye fastener |
| 925 | knotted connector |
| 930 | connector with eye loop |
| 935 | eye loop |
| 940 | second cord |
| 1010 | first example |
| 1020 | second example |
| 1025 | friction pivot joint |
| 1030 | third example |
| 1040 | fourth example |
| 1050 | fifth example |
| 1060 | sixth example |
| 1070 | inserting end (male) |
| 1072 | receiving end (female) |
| 1074 | machined end |
| 1075 | cord retainer |
| 1076 | threaded connector |
| 1077 | connector threads |
| 1082 | 2-legged threaded support |
| 1084 | obtuse threaded support |
| 1086 | angled threaded connector |
| 1088 | bolt |
| 1090 | thinner shaft inserting end |
| 1091 | thinner shaft receiving end |
| 1092 | thinner shaft (more flexible segment) |
| 1094 | (a-c) locking slot |
| 1096 | slot mark |
| 1099 | alternate shaft segment |
| 1100 | strap hole |
| 1110 | attaching material |
| 1120 | attaching hole |
| 1130 | tooth |
| 1150 | stopper |
| 1300 | case |
| 1310 | belt loop |
| 1320 | stake |
| 1400 | alternate cap |
| 1402 | tip |
| 1404 | rim |
| 1500 | (a-b) cover shafts |
| 1500 | segmented cover shaft |
| 1510 | alternate cover shaft |
| 1520 | (a-f) cover shaft segment |
| 1530 | shelter frame |
| 1532 | shelter cord |
| 1540 | cover |
| 1542 | (a-d) cover panels |
| 1544 | cover seam |
| 1546 | cover roll |
| 1550 | rain fly |
| 1551 | alternate fly boundary |
| 1552 | fly material |
| 1553 | pocket seam attachment |
| 1554 | fly cord |
| 1556 | fly fasterner |
| 1558 | fly pocket |
| 1559 | rain fly shaft |

-continued

| | |
|---|---|
| 1560 | tarp (removable floor) |
| 1562 | first side |
| 1563 | tarp corner |
| 1564 | corner fold |
| 1565 | second side |
| 1566 | (a-b) corner grommets |
| 1566 | (c-e) side grommets |
| 1566 | firm grommet (or eyelet) |
| 1566 | (f-i) skirt grommets |
| 1568 | tarp material |
| 1600 | covered blind/shelter |
| 1601 | 2-walled covered blind/shelter |
| 1602 | opening |
| 1603 | cylindrical arched roof |
| 1604 | cylindrical arched roof unit |
| 1605 | basic module |
| 1606 | vessel |
| 1607 | (a-b) pyramid unit |
| 1608 | bow arch |
| 1610 | window fastener |
| 1612 | cover window |
| 1620 | pyramid cover |
| 1621 | pyramid cap |
| 1626 | bow cord |
| 1630 | alternate cover |
| 1631 | cover cap |
| 1632 | (a-d) overhead window |
| 1633 | (a-b) zipper |
| 1634 | door |
| 1636 | door fastener |
| 1638 | lower window |
| 1640 | extended configuration |
| 1641 | line of sight (trajectory) |
| 1642 | shoot-through panel |
| 1650 | rain fly configuration |
| 1651 | ridge |
| 1652 | fly loop |
| 1654 | cover shaft pocket |
| 1655 | 3-sided attachment |
| 1656 | grommetted pocket |
| 1657 | pocket seam |
| 1658 | pocket grommet |
| 1659 | pocket attachment |
| 1660 | cover with windows |
| 1661 | alternate cover with windows |
| 1662 | overhead window fastener |
| 1664 | zipper start |
| 1665 | pocket seam |
| 1666 | zipper end |
| 1672 | window roll |
| 1680 | channelled plug |
| 1681 | alternate plug |
| 1682 | plug hole |
| 1683 | skirt fastener |
| 1684 | strap attachment |
| 1685 | reinforced strap hole |
| 1686 | strap |
| 1687 | eyelet top |
| 1688 | eyelet bottom |
| 1689 | reinforcement |
| 1690 | 2-receptor shaft |
| 1691 | pyramid cover shaft |
| 1692 | extended pyramid shaft |
| 1700 | tree fly |
| 1703 | curtain fly |
| 1710 | alternate tree fly |
| 1712 | alternate fly material |
| 1720 | ground shield |
| 1730 | 3-shafted shield |
| 1732 | 3-shafted fly material |
| 1734 | side shafts |
| 1736 | fly tiedown |
| 1740 | receiving-to-receiving connector |
| 1750 | 6-way receiving end connector |
| 1760 | inserting-to-inserting connector |
| 1770 | hinged connector |
| 1772 | (a-b) threaded leg |
| 1774 | hinge |
| 1800 | adjustable bracket |
| 1810 | (a-d) bracket leg |

-continued

| | |
|---|---|
| 1812 | bracket leg threads |
| 1814 | bracket leg base |
| 1816 | bracket leg opening |
| 1820 | quick release |
| 1840 | (a-d) thicker based leg |
| 1842 | thicker base |
| 1844 | adjustable bracket bolt |
| 1846 | lower nut |
| 1848 | upper nut |
| 1850 | rectangular fly material |
| 1851 | fan fly material |
| 1852 | moving shield |
| 1853 | equipment attachment |
| 1854 | hand held equipment |
| 1858 | batten |
| 1860 | shoot-through section |
| 1910 | guyline module |
| 1911 | guyline shaft |
| 1912 | (a-d) guyline |
| 1914 | guyline base |
| 1915 | washer hole |
| 1916 | guyline capital |
| 1917 | guyline washer |
| 1918 | fixed capital |
| 1919 | (a-d) guyline slot |
| 1920 | blackout panel |
| 1922 | see-through panel |
| 1930 | retractable guyline |
| 1932 | coil attachment |
| 1934 | guyline coil |
| 1936 | guyline hook |
| 1938 | guyline lock |
| 2010 | skirt |
| 2020 | horizontal guyline |
| 2030 | horizontally sliding panel |
| 2032 | vertical slit |
| 2040 | skirt door hook |
| 2042 | skirt door flap |
| 2050 | skirt door |
| 2060 | door shaft |
| 2100 | hinged inserting end |
| 2102 | hinge pin |
| 2104 | tenon |
| 2106 | threaded hinge leg |
| 2108 | second hinge leg |
| 2120 | doubly hinged inserting connector |
| 2122 | middle hinge leg |
| 2124 | raised ring |
| 2130 | beveled hinged inserting end |
| 2132 | side face |
| 2134 | beveled face |
| 2200 | base block |
| 2202 | block |
| 2204 | embedded dimpled connector |
| 2210 | receiving base |
| 2212 | base plate |
| 2214 | base receiving end |
| 2220 | inserting base |
| 2224 | base inserting end |

Special Definitions cord—a flexible, and possibly elastic, filament including but not limited to a fiber, thread, string, rope, twine, wire, cable, yarn, thong, tendon, or line.

curtain—a concealing or protecting sheet of material.

grommet—a flexible loop that serves as a fastening, support, or reinforcement or an eyelet of firm material to strengthen or protect an opening or to insulate or protect something passed through it.

eyelet—a typically metal or plastic reinforcement for a hole.

shaft—a supporting member in construction including but not limited to any solid or hollow, round or rectangular bar, beam, pole, rod, spar, or tube composed of wood, plastic, metal, or composite material.

telescoping shaft—an expandable and collapsible shaft having parts that slip over each other.

DESCRIPTION OF THE INVENTION

The present invention comprises an easy to use, simple, lightweight, compact, portable modular system for concealment and shelter and methods for its construction and use. The main components of the basic module are various novel supports and a curtain. The support attaches to a structure and pivots at the attachment. Other modules include a novel cover with cover shafts, a removable floor, a rain fly, and various novel flies and shields. The modules can be combined to form various tree blinds, ground blinds, water fowl blinds, blinds attached to vessels or vehicles, and various shelter. The system uses novel shaft segments that can be attached in various configurations and then broken down without detaching the attachments. The present invention encompasses various embodiments of the attaching pivoting support as well as various embodiments of curtains with various features. A method of the present invention allows for 360 degree concealment. In addition to a method of being fully enclosed, a method of the present invention is based on the concept of "hiding in front" of a similar pattern.

FIG. 1A through FIG. 1H

FIG. 1A illustrates an attaching pivoting support 100. The support 100 is bent at an angle. The bend 140 results in two legs: a first leg 150 and a second leg 160. The first leg 150 has a threaded portion for threaded attachment to an attaching structure 130, such as a tree, pole, rock, wall, or attaching fastener 230. The bend 140 allows a user to exert a force on the second leg 160 that acts as a lever to screw the first leg 150 into the attaching structure 130.

The angle of the bend 140 is shown as a 90 degree angle; however, good results have also been obtained by using an obtuse angle. An obtuse angle still provides a leveraged force but is less likely to cause the second leg 160 to be blocked by tree branches or other obstructions.

In this exemplary embodiment, a portion of the threaded portion of the first leg 150 is cylindrical, not tapered, so that once attached to the attaching structure 130, the second leg 160 can be rotated up and down around the first leg 150 without losing frictional force necessary to hold the attaching pivoting support 100 in the position the operator leaves it (as will be explained below).

The attaching pivoting support 100 can be constructed of a single shaft. However, depending on construction materials, a lighter embodiment can be constructed by combining various components. This invention anticipates that any combination of parts can be used to make the attaching pivoting support 100 with equivalent structural features and functions. Examples of some embodiments are shown in FIG. 1B through FIG. 1F.

FIG. 1B shows an exploded view of the attaching pivoting support 100 comprised of a threaded support 102, a threaded connector 104, and a shaft 106. The threaded connector 104 screws onto the threaded support 102 and is attached to the shaft 106. Good results have been obtained by making the threaded support 102 from hardened steel, by making the threaded connector 104 from an aluminum alloy tube, and by making the shaft 106 from fiberglass. Good attachment results have been obtained by gluing or crimping the aluminum tube to the fiberglass.

FIG. 1C shows an assembled view of the example shown in FIG. 1B.

FIG. 1D shows an exploded view of the attaching pivoting support 100 comprised of a drilled support 120 and a drilled receiving shaft 122. The drilled support 120 is inserted into a cavity in the drilled receiving shaft 122 and is held in place by a fastener 124. Both the drilled support 120 and the drilled receiving shaft 122 are drilled to receive the fastener. The faster 124 could be a nail, screw, rivet, bolt and nut clasp, or similar means of attachment. Good results have been obtained by making the drilled support 120 from hardened steel and by making the drilled receiving shaft 122 from an aluminum alloy, plastic tube, or hollow fiberglass shaft.

FIG. 1E shows an assembled view of the example shown in FIG. 1D.

FIG. 1F shows an embodiment of the attaching pivoting support 100 comprised of a plate 110 with a plate connection 112 for attaching the shaft 106. The shaft 106 can be inserted through a plate sleeve 114 and attached by threads to the plate connection. The plate sleeve 114 provides added stability to the connection. The plate 110 is functionally equivalent to the bend 140 that connects the first leg 150 to the second leg 160. Good results have been obtained by making the plate 110 from a high polymer plastic, and by making the shaft 106 from fiberglass. It may be desirable to make the first leg 150 with a large diameter and a short length.

Good results have also been obtained by attaching the threaded connector 104 to the shaft 106 as shown in FIG. 1B and FIG. 1C. Good attachment results have been obtained by gluing or crimping the aluminum tube to the fiberglass. Gluing the aluminum tube to the fiberglass creates a weld that distributes the force more evenly across the fiberglass shaft; this reduces the breakdown of the fiberglass that can shatter or fray when the forces are applied to a smaller area.

FIG. 1G shows an embodiment of the attaching pivoting support 100 comprised of the threaded support 102, the threaded connector 104, and the shaft 106. As in FIG. 1B, the threaded connector 104 screws onto the threaded support 102 and is attached to the shaft 106. However, in this embodiment the shaft 106 is comprised of a plurality of connected shafts 760 each connected to a connector. In this embodiment each connected shaft 760 is connected to a straight connector 700. These form a segmented shaft 107.

FIG. 1G further shows an example where the shafts are hollow and connected with an elastic cord 126. The elastic cord 126 running through the centers of the shaft 106 components (such as 100, 700, 710, 720, 740, 750, 760, 770, or 780) can connect the components. This can prevent components from falling and makes it easier to assemble the shaft 106.

FIG. 1H shows an embodiment of the attaching pivoting support 100 comprised of the threaded support 102, the threaded connector 104, and the shaft 106. As in FIG. 1B, the threaded connector 104 screws onto the threaded support 102 and is attached to the shaft 106. However, in this embodiment the shaft 106 is comprised of a telescoping shaft 108 comprising a plurality of concentric shafts that slide inside each other to extend for use and to collapse inside the outer shaft for storage. The telescoping shaft 108 could be one as known in the art, such as is commonly used for car or portable radio antennae, or one of a new design.

The free end of the shaft 106 can optionally be covered with end-cap 170 that can protect the end of the shaft from breaking, protect the user, and make it easier to pass material over the end of the shaft 106.

FIG. 1I through FIG. 1T

FIG. 1I illustrates an alternate support 101 which is an embodiment of the attaching pivoting support 100. The support 101 is comprised of three legs: a first leg 150, an alternate second leg 192 and a third leg 190. The first leg 150 has a threaded portion for threaded attachment to an attaching structure 130, such as a tree, pole, rock, wall, or attaching fastener 230. The alternate second leg 192 is an embodiment of second leg 160, but has the same threaded portion as first leg 150. In this embodiment either the first leg 150 or alternate second leg 192 can be attached to the attaching structure. The unused leg can be attached to a shaft 106 or connected shaft 760. The bend 140 allows a user to exert a force on the alternate second leg 192 or the third leg 190 that act as a lever to screw the other leg into the attaching structure 130. The third leg 190 is sharpened at one end. It is shown with a diagonal cut in this figure, but could have two diagonal cuts like a screw driver, four tetrahedral cuts like a nail or a tapered point like an awl, without departing from the spirit of the present invention. The sharpened end of the third leg 190 can be easily inserted into the ground. This allows the same alternate support to be used to form a ground blind as well as various tree blind configurations.

FIG. 1J shows an exploded view of the attaching pivoting support 100 comprised of an alternate support 101, a dimpled connector 194, and a shaft 106. The dimpled connector 194 receives either the first leg 150 or the alternate second leg 192, and is attached to the shaft 106. An improved permanent attachment can be made by inserting shaft 106 then subsequently dimpling the dimpled connector such that the dimples mechanically engage the shaft 106 (see retaining dimple 197*a* in reference FIG. 1BB).

FIG. 1K shows an assembled view of the example shown in FIG. 1J.

FIG. 1L shows a leg either 150 or 192 being inserted into the dimpled connector 194. In this figure the dimple connector 194 is shown with three dimples 195.

FIG. 1M an assembled view of the example shown in FIG. 1L. The threads of the leg either 150 or 192 first engage the first dimple 195*a*, then the second dimple 195*b*, then the third dimple 195*c*. Good results have been found with three or more dimples; however one dimple 195 is sufficient for receiving a thread (as shown below in FIG. 1AA, 1DD through 1HH, and 1OO through 1PP).

A novel feature of the system of the present invention is that a dimpled connector 194 can receive either a left or right handed thread on an inserting end 1070, or even a shaft with a locking slot 1094 as will be explained below in reference to FIGS. 1LL and 1MM. A concave dimple can easily be made, for example, by striking the outside of a metal ferrule with a punch. The hemispherical dimple will result inside the ferrule and is sufficient to receive a threaded member, or a shaft with a locking slot 1094.

FIG. 1N through FIG. 1P shows three embodiments of the dimpled connector 194. In FIG. 1N the dimples (195*a* through 195*c*) form a single line. FIG. 10 shows a spirally dimpled connector 194*a*. Where the dimples 195*d* through 195*f* form a first spiral and dimples 195*g* through 195*i* form a second spiral. FIG. 1P a parallel dimple connector 194*b* where dimples 195*j* through 195*m* form a first line and dimples 195*n* through 195*q* for a parallel second line. One of ordinary skill in the art would understand that various dimpled arrangements could be used without departing from the spirit of the present invention.

FIG. 1Q shows an embodiment similar to the one shown in FIG. 1G where the dimpled connector 194 is connected to the shaft 106 with an elastic cord 126. In this example, the partial dimpled connector 194*c* further comprises a pin 196 to which is attached a cord 126*a* with a cord attachment or knot 126*b*. An additional dimple 195*r* stops the end of shaft 106 from being inserted beyond the dimple 195*r*. This increases the reliability of the shaft 106 and the elastic cord 126. For example, when the shaft is made from fiberglass, constant hitting of the pin 196 or the cord attachment or knot 126*b* will cause premature fraying of the fiberglass.

FIG. 1R shows an enhanced dimple connector 194*d*. This embodiment comprises the pin 196, the cord 126*a*, the stopping dimple 195*r* as well as the thread receiving dimples 195*a* through 195*c*. It also comprises deeper dimples 198*a* and 198*b*. When the leg 150 or 192 is threadedly attached to the enhance dimpled connector 194*d*, the point of the leg will engage the deeper dimples and stop point of the leg from being inserted beyond the deeper dimples 198 where it could damage the cord attachment or knot 126*b*.

FIG. 1S shows an example of use in a straight connector 700 of a midpoint dimple 195*s* as a guide for manufacturing. When permanently attaching a connector, such as 700 or 710, the shaft 106 can be inserted up to the midpoint dimple. The permanent attachment can be made using glue or crimping as discussed above in relation to FIG. 1F, or by making a retaining dimple 197*a*, as shown in FIG. 1BB.

FIG. 1T shows an alternate dimpled connector 194*e*. This embodiment comprises the cord retainer 1075, the cord 126*a*, and a retaining dimple 197. Instead of using the pin 196, the cord 126*a* passes through the shaft segment and is secured with cord attachment or knot 126*b*. The cord retainer 1075 is held inside the dimpled connecter 194*e* by the retaining dimple 197, and optionally with glue. This embodiment is easier to assemble and requires fewer specialized parts or tools than the embodiment shown in FIG. 1R. It will also strengthen the connector rather than weaken it by drilling holes. The force on the cord 126*a* or shaft 106 is distributed more evenly as well.

The cord retainer 1075 can be made by cutting a relatively thin slice of a solid cylinder and drilling a hole to pass cord 126*a*. Once the cord 126*a* is passed through the hole, a knot 126*b* can be tied in the cord 126*a*. The cord retainer 1075 could be made with a short segment of hollow fiberglass; however, better results have been found by making the cord retainer from plastic, such as polyoxymethylene or acetal. While the hole can be drilled in the center, as shown here, to avoid having a sharp screw point damage the knot 126*b*, the hole can be advantageously drilled off center as will be shown later in FIG. 1NN.

In FIG. 1T, the thread receiving dimples 195*a* through 195*c* and deeper dimples 198*a* and 198*b* as described in relation to FIG. 1R are also shown but are optional. Note that any threaded leg could be removably attached to a dimpled connector 194, such as 194*a* through 194*e*.

FIG. 1U through FIG. 1X

FIG. 1U illustrates an embodiment of alternate support 101 which is an embodiment of the attaching pivoting support 100. The 3-legged alternate support 101*b* is similar to the alternate support 101 described relation to FIG. 11 except that the third leg 190 is a threaded third leg 191. Threaded third leg 191 has the same threaded portion as first leg 150. In this embodiment either the first leg 150, alternate second leg 192, or the threaded third leg 191 can be attached to the attaching structure. The unused legs can be attached to a shaft 106 or connected shaft 760. The bend 140 allows a user to exert a force on the alternate second leg 192 or the first leg 150 that act as a lever to screw the threaded third leg 191 into the attaching structure 130. The threaded third leg 191 is sharpened end. The sharpened end of the threaded third leg 191 can be easily inserted into the ground. This allows the same alternate support 101*b* to be used to form a ground blind as well as various tree blind configurations.

FIG. 1V illustrates yet another embodiment of alternate support 101. A 4-legged alternate support 101*c* has the first leg 150, alternate second leg 192, and the threaded third leg 191 of the 3-legged alternate support 101*b* and adds a fourth leg 193. Threaded fourth leg 193 has the same threaded portion as the other three legs.

The alternate supports 101*b* and 101*c* are interchangeable because of the common threading and can be used to comprise a number of modules in the modular system for concealment and shelter of the present invention. Any of the 3 or 4 legs can be attached to a dimpled connector 194 or to an attaching structure 130. Preferably, the third leg 190 is longer and is inserted into the ground. Force can be applied to the first leg 150 (or the fourth leg 193) to facilitate ground insertion and removal. Once inserted into the ground, the alternate support 101 provides a solid anchor for various modules that will be discussed below.

FIGS. 1W and 1X illustrate two embodiments of brackets with two legs, namely a 2-legged threaded support 1082, and an obtuse threaded support 1084. The first leg 150 and the second leg 192 have the same threaded portions so both legs can be attached to a dimpled connector 194 or to an attaching structure 130. These threaded supports can be used to connect components in various configurations. FIGS. 1W and 1X are shown with pointed ends, however, in some embodiments the ends do not need to be pointed.

FIG. 1Y through FIG. 1HH

FIG. 1Y illustrates a shaft segment 199. A plurality of shaft segments 199 may be attached to form a threaded segmented shaft 109. For example, FIG. 1DD shows a threaded segmented shaft 109 comprised of two shaft segments 199. Many of the modules of the present invention are comprised of shaft segments 199 of various lengths that can be connected in various configurations.

Figure 1Z:
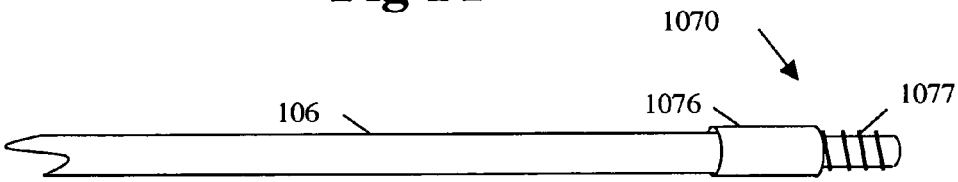
Figure 1A:
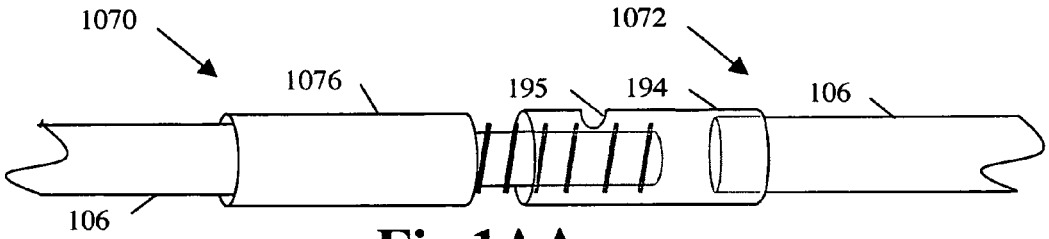
Figure 1B:
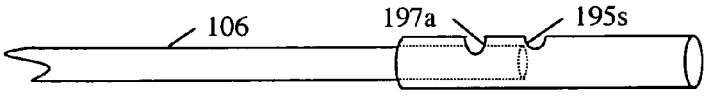
Figure 1C:
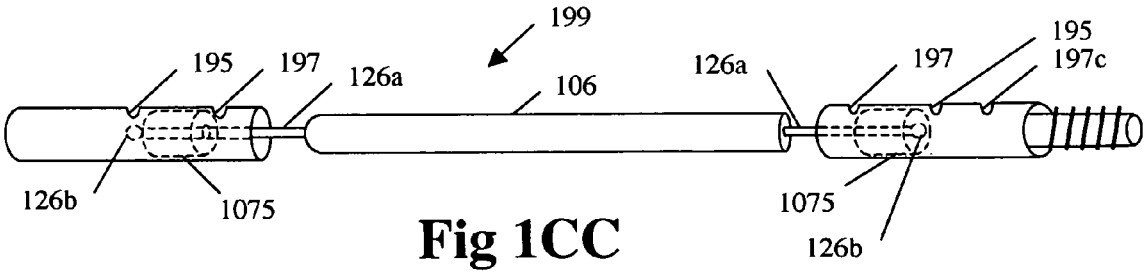
Figure 1D:
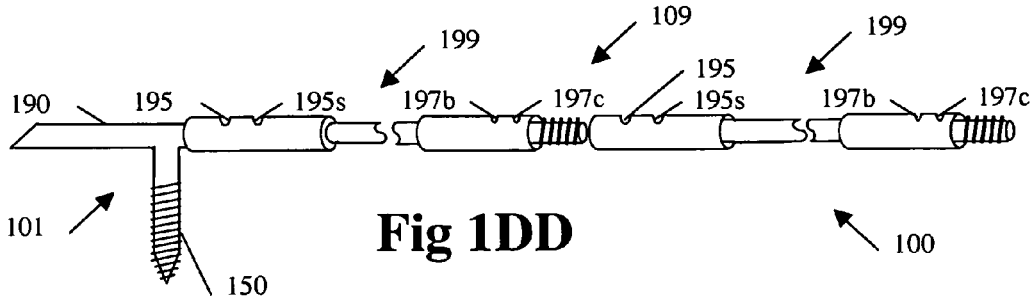
Figure 1E:
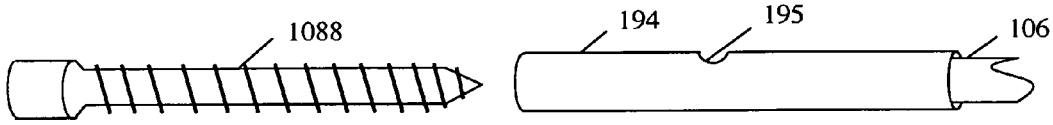
Figure 1F:
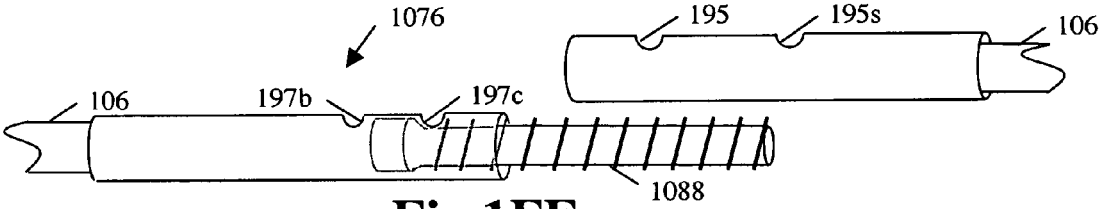
Figure 1G:
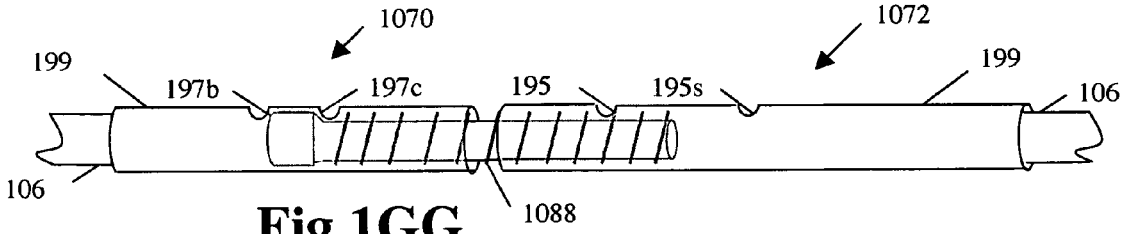
Figure 1H:
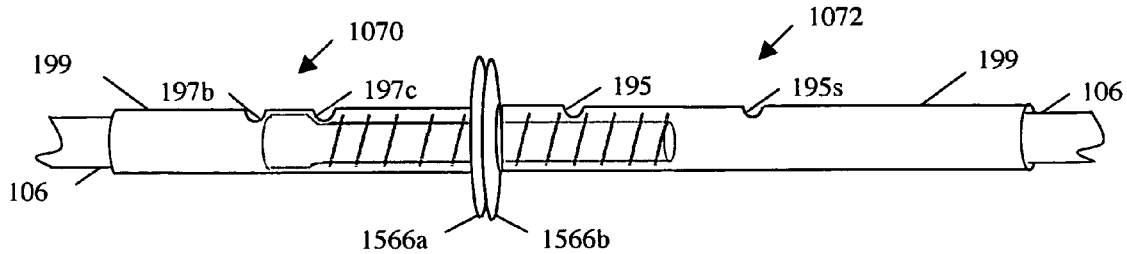
Figure 1I:
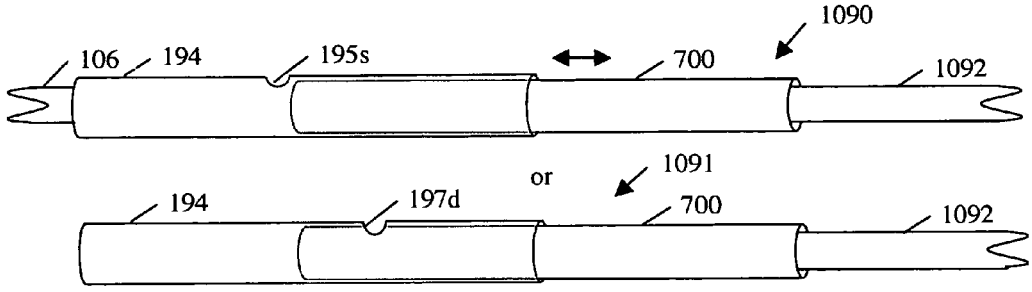
Figure 1J:
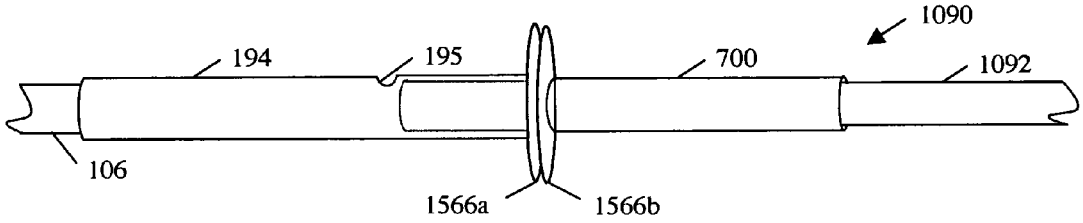
Figure 1K:
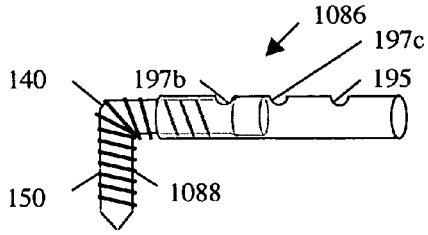
Figure 1L:
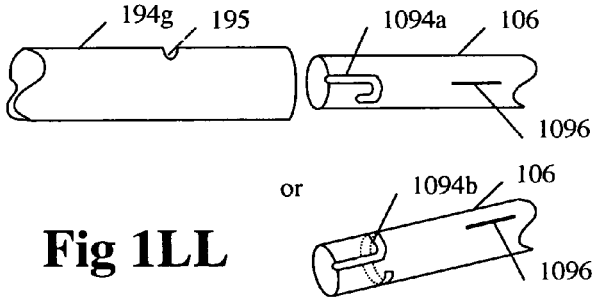
Figure 1M:
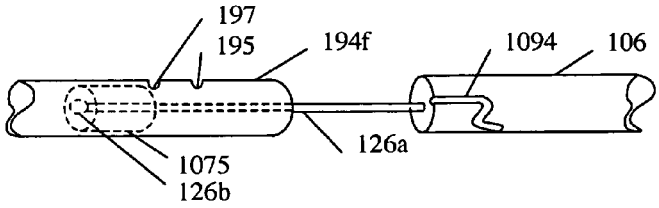
Figure 1N:
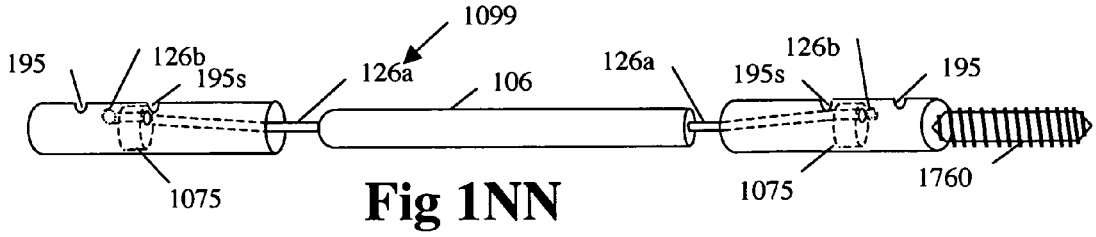
Figure 1O:
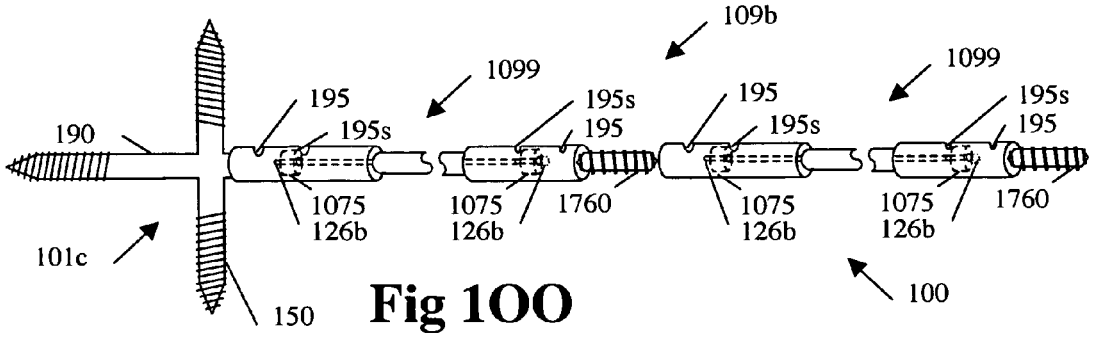
Figure 1P:
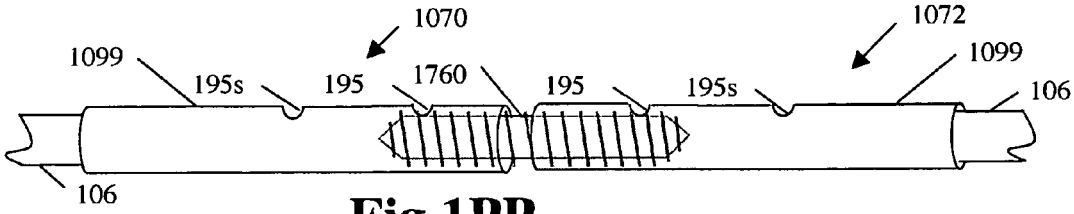
Figure 1Q:
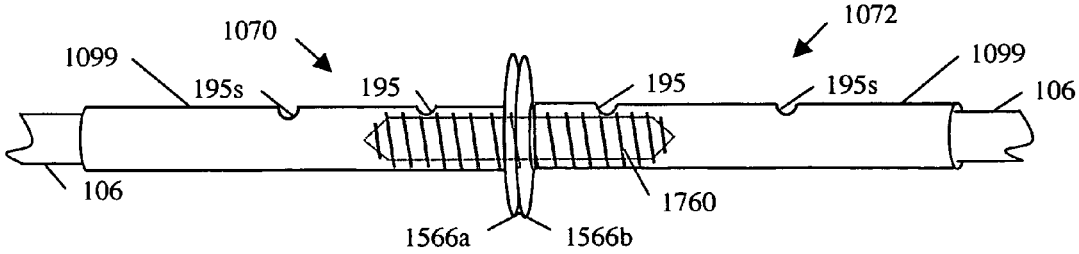

As shown in FIG. 1Y a shaft segment 199 has an inserting end 1070 (also called in the art a male end) and a receiving end 1072 (also called in the art a female end). The inserting end 1070 has threads. The threads can be formed by machining the end of the shaft 106 resulting in a machined end as shown in FIG. 1Y. Alternatively, the threads can be part of a threaded connector 1076 as shown in FIG. 1Z. The threaded connector 1076 has connector threads 1077.

The receiving end 1072 as shown in FIG. 1Y can be any dimpled connector 194 having at least one thread receiving dimple 195.

As shown in FIG. 1AA the inserting end 1070 of one shaft segment 199 can be threadedly attached to the receiving end 1072 of a second shaft segment 199. Two or more shaft segments 199 can be connected to form a threaded segmented shaft 109 as shown in FIG. 1DD.

FIG. 1BB shows that a retaining dimple 197*a* can be used to permanently attach a connector (194, 700, 710, etc.) to a shaft 106 to form the receiving end 1072.

FIG. 1CC shows a novel feature of the present invention. The connectors of both the inserting end 1070 and receiving end 1072 of the shaft segment 199 can be attached to the shaft 106 using a cord 126*a* using pins 196 (not shown) or cord retainers 1075 (as shown in FIG. 1T, FIG. 1NN and here in FIG. 1CC). The cord is attached using the cord attachment or knot 126*b*. This feature allows a plurality of shaft segments 199 to be threaded together with various supports, such as 101, 101*b*, 101*c*, 1082, 1084, 1800, and so forth, to form various configurations. Once configured the structure can be quickly broken down by separating the connectors from the shaft 106 by stretching the cord 126*a* on one or both ends. The structure can be quickly put up by reinserting each end of shaft 106 into the connector to which it is attached by the cord 126. The advantages of this feature will be seen below.

FIG. 1DD shows an embodiment of the attaching pivoting support 100 of the present invention, comprising an alternate support 101 (or 101*b* or 101*c*, not shown) and a threaded segmented shaft 109.

FIG. 1EE shows a threaded bolt 1088 that can be threadedly attached to a dimpled connector 194 having at least one thread receiving dimple 195. As shown in FIG. 1FF a threaded connector 1076 can be manufactured by trapping a bolt 1088 inside a connector using two retaining dimples 197*b* and 197*c*. The threaded connector 1076 manufactured by this method can be attached to the shaft 106 to form an inserting end 1070. A dimpled connector can be attached a shaft 106 to form a receiving end 1072. The threaded connector of one shaft segment 199 can be connected to the receiving end 1072 of a second shaft segment 199 having at least one thread receiving dimple 195 as shown in FIG. 1GG.

As shown in FIG. 1HH, the threaded segmented shaft 109 of the present invention has a novel advantage over conventional segmented shafts in that the inserting end 1070 can pass through one or more firm grommets (or eyelets), such as 1566*a* and 1566*b*, and secure them between two shaft segments 199. The advantages of this novel feature will be seen below.

FIG. 1II through FIG. 1QQ

FIG. 1II shows a novel method of connecting a thinner shaft 1092 to a common sized dimpled connector 194. A connector 700 with a smaller diameter than the dimpled connector 194 is permanently attached to the thinner shaft 1092. The outer diameter of the connector 700 is slightly smaller than the inner diameter of the dimpled connector 194. In the thinner shaft inserting end 1090 embodiment (shown in the top of FIG. 1II), the dimpled connector 194 could be a receiving end 1072 and the connector 700 of the thinner shaft 1092 is removably inserted into the receiving end 1072 as an inserting end 1070 to effectively connect a thinner shaft 1092 to a commonly sized shaft 106. In the embodiment shown, a midpoint dimple 195*s* stops the smaller connector 700 from being inserted beyond the midpoint. In the thinner shaft receiving end 1091 embodiment (shown in the bottom of FIG. 1II), the dimpled connector is permanently attached to the smaller diameter connector 700 forming a permanent commonly sized receiving end 1072 for the thinner shaft 1092. The smaller diameter connector 700 can be permanently attached to the dimpled connector 194 by making a retaining dimple 197*d* in both connectors at a point that they overlap. Alternatively the two connectors could be glued or welded. Using this method a thinner shaft 1092 can be provided either an inserting end 1070 or a receiving end 1072 for connection to common sized shafts and connectors. One advantage of this novel method is that the force on the thinner shaft is transferred more evenly through the series of increasing sized connectors. Other advantages will be seen below (for example, in FIG. 1JJ and FIG. 15G).

As shown in FIG. 1JJ, the thinner shaft receiving end 1090 of the present invention has a novel advantage over conventional segmented shafts in that the inserting end 1070 (in this case formed by the smaller diameter connector 700) can pass through one or more firm grommets (or eyelets), such as 1566*a* and 1566*b*, and secure them between the thinner shaft 1092 and another component with a common sized dimpled connector 194 (for example, on the receiving end 1072 of a shaft segment 199).

FIG. 1KK illustrates an angled threaded connector 1086. This 2-legged support is similar to the 2-legged threaded support 1082 shown in FIG. 1W having a threaded first leg 150, but the second leg is a receiving end 1072. This component can be formed by making a bend 140 in a bolt 1088 and permanently attaching a dimpled connector 194 using retaining dimples 197*b* and 197*c*. The angled threaded connector 1086 can be used to attach to a threaded segmented shaft 109 to form an attaching pivoting support 100. The angled threaded connector 1086 can also be used to form an angle at the end of a threaded segmented shaft 109 that is being used to configure a blind or shelter structure.

Because the receiving end 1072 of the connectors of the currently preferred embodiment of the modular system of the present invention is a dimpled connector 194, rather than a threaded connector 104, the inserting ends 1070 do not necessary need to have connector threads 1077. Instead the shaft 106 can have a locking slot 1094 through which the receiving dimple 195 is passed. The locking slot 1094 can have a path with a shape that will lock the two pieces together. A J-shaped locking slot 1904*a* can be useful if the shaft 106 has force applied to it that brings it back toward the connector (for example the cord 126*a* as shown in FIG. 1MM). Alternatively, when the force can be either a pulling or pushing force, a locking slot 1094*b* can have a path that circles almost completely around the shaft, or locking slot 1094*c* can have a zig-zag path. Because the locking slot 1094 is hidden when inserted into the dimpled connector 194*g*, a slot mark 1096 can be made on the shaft 106 showing the position of the locking slot entry and exit. The locking slot has the advantage over connector threads 1077 in that the connection can be made or released with a rotation that is less than one complete rotation. With threaded connectors such as 1076, many rotations are required.

As shown in FIG. 1MM the use of a locking slot 1094 can be used to temporarily secure the connection of a shaft 106 to a dimpled connector 194*f* which otherwise would be held together only by the force of the cord 126*a*. In one embodiment of the modular system of the present invention the shaft segments 199 with cords 126 attaching the receiving 1070 and receiving 1072 ends to the shaft 106 as shown in FIG. 1CC use the locking slot 1094 (instead of threads) and dimpled connectors 194 as shown in FIG. 1MM.

FIG. 1NN shows a more versatile embodiment of the shaft segment 199 that includes the features described in FIG. 1CC. In this embodiment, the connectors at both ends are formed the same, namely both as receiving ends 1072 (forming a 2-receptor shaft 1690). Either end can be converted to be the inserting end 1070 by attaching a short inserting-to-inserting connector 1760, such as the one shown in FIG. 17G or any support having at least two legs with threads (e.g. 101, 101*b*, 101*c*, 1082, 1084) or locking slots 1094 (e.g. FIG. 1LL). Both connectors are connected to the shaft 106 with cords 126*a* providing a means for breaking down the structure after it has been configured with the threaded attachments. FIG. 1NN shows the holes in the cord retainers 1075 being off-center. As discussed above, this is advantageous because the sharp point of a support such as 101*b* will not damage the cord knot or attachment 126*b*.

The alternate shaft segment 1099 shown in FIG. 1NN is more versatile than the embodiment in FIG. 1CC, because it allows all the shafts in the system be common and interchangeable. These type shafts can be interconnected with the various supports (such as 101, 101*b*, 101*c*, 1082, 1084, 1800) and connectors (such as 1760, 1086) to form any number of structures, including those shown, for example, in FIGS. 3A, 4D-F, 6D, 8A-D, 14A-B, 14H, 16A-F, 16U, 16W-KK, 16PP-RR, 17A-D, 18G-J, 19E, and 20A, as well as others that will be designed by users. Like the embodiment of 1CC, once configured with the thread-to-dimple attachments the structure can be quickly broken down by separating the connectors from the shaft 106 by stretching the cord 126*a* on one or both ends. The structure can be quickly put up by reinserting each end of shaft 106 into the connector to which it is attached by the cord 126*a*.

FIG. 1OO [one-letter oh-letter oh, not one-zero-zero] shows an embodiment of the attaching pivoting support 100 of the present invention, comprising an alternate support 101*c* (or 101 or 101*b*, not shown) and a threaded segmented shaft 109 which uses the alternate shaft segments 1099 and connectors 1760 of embodiment shown in FIG. 1NN.

FIG. 1PP shows the inserting-to-inserting connector 1760 that can be threadedly attached to two dimpled connectors 194 each having at least one thread receiving dimple 195. In contrast to the embodiment shown in FIG. 1FF, the connector 1760 is not trapped in either dimpled connector 194 providing more versatility. The inserting end 1070 comprises an inserting-to-inserting connector 1760 attached to a dimpled connector 194 connected to a shaft 106. It can then be connected to any receiving end 1072.

FIG. 1QQ shows that, like 1HH, the inserting end 1070 and the receiving end 1072 of the alternate shaft segments 1099 have a novel advantage over conventional segmented shafts in that the inserting end 1070 can pass through one or more firm grommets (or eyelets), such as 1566*a* and 1566*b*, and secure them between two alternate shaft segments 1099.

FIG. 2A

FIG. 2A shows a top cross-sectional view of the attaching pivoting support 100 attached to the attaching structure 130. In this example the attaching structure 130 is shown as tree or a wooden pole. As will be shown later, the attaching structure 130 may comprise scaffolds, buildings, or devices composed of straps, belts, or other components further attached to trees or other structures.

In one normal use, the second leg 160 is extended generally horizontally. In this simplest embodiment of the present invention, the operator could drape a sheet, coat, poncho, garbage bag, tarp, or other available material over the attaching pivoting support 100 to form a means of concealment.

FIG. 2B through FIG. 2D

FIG. 2B shows the attaching pivoting support 100, as shown in FIG. 1F, attached to the attaching structure 130 comprising an attaching belt 200. The attaching belt 200 includes a strap 210 attached to an attaching fastener 230. The attaching fastener 230 contains a threaded hole that is capable of receiving the threaded first leg 150. The side of the plate 110, which is adjacent to the first leg 150, may be tapered so that the deeper it is threaded in the hole, the greater the friction between the plate 110 and the attaching fastener 230.

Figure 11A:
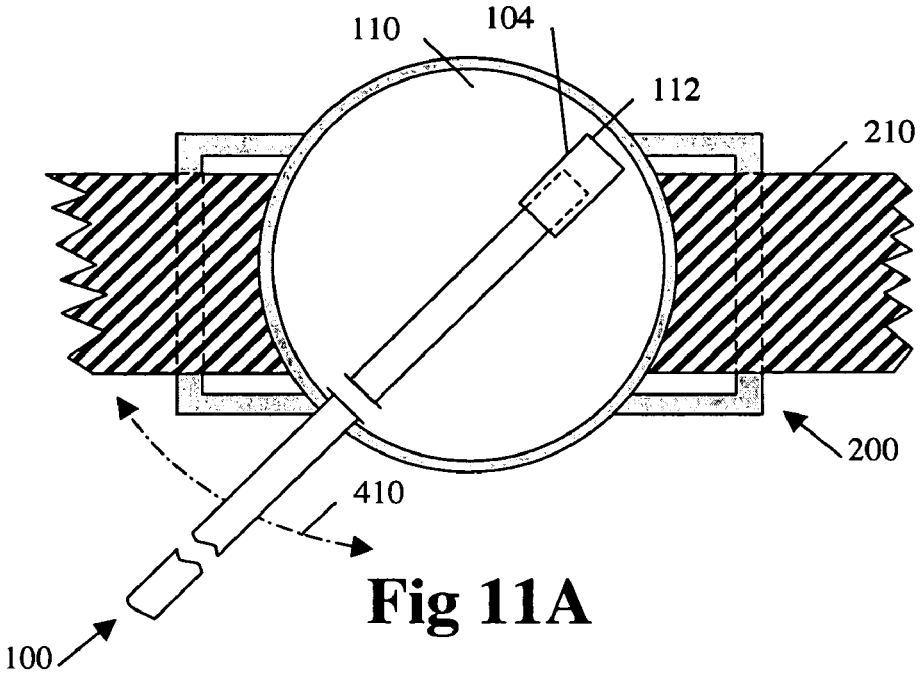

The strap 210 could pass through openings on each end of the attaching fastener 230 (as shown in FIG. 11A). Alternatively, the strap 210 can be permanently fastened to one end, passed around a tree or similar structure and then tightened against the structure by passing the loose end of the strap 210 through a tension means 220 on the opposite end. One embodiment of the tension means 220 is shown in FIG. 2B. Other equivalent means are known in the art.

FIG. 2C shows an exploded view of the attaching pivoting support 100 and the attaching belt 200 as shown and described in FIG. 2B. The first leg 150 is not visible in this view but would attach at a threaded receptor 240 in the attaching fastener 230.

FIG. 2D shows a different view of same components shown and described in FIG. 2B and FIG. 2C. This view shows how the shaft 106 pivots around the center of the first leg 150 and the plate 110. The shaft 106 is shown in a lowered position relative to the strap 210 which is shown horizontally as if it were attached to the attaching structure 130, such as a tree or pole.

FIG. 3A through FIG. 3I

FIG. 3A shows an embodiment of the present invention where a curtain 300 is hanging from the attaching pivoting support 100. In this example, the curtain is a sheet of material with a support hem 318 sewn or sealed along the top edge. Good results have been obtained by making the curtain from camouflaged woven material or plastic sheeting. The attaching pivioting support 100 is passed through the support hem 318 of the curtain 300.

FIG. 3B shows an anchored curtain 302 which is an embodiment of the curtain 300 with multiple anchor points 310 and ties 340. Each tie 340 can be used to adjust the effective length, or the effective shape, of the curtain by attaching to one of the anchor points 310. The attaching points 310 and the ties 340 can hold the curtain 300 taut to avoid noise caused by wind.

A slit 350 can optionally be placed in the curtain 300 to allow the person to peek through the curtain 300 without lowering the attaching pivoting support 100.

FIG. 3C shows the detail of a row of anchor points 310. In this example, there is a first anchor point 370, as a second anchor point 380, and a third anchor point 390. Good results have been obtained by sewing a stretch cord into a hem such that the stretch cord forms the first and third anchor points (370 and 390) on the sides of the curtain, and the second anchor point 380 in between. The anchor points (370, 380, and 390) each are examples of a grommet 368 as used in the present invention.

A shaft could be placed through the anchor points 310 to make the curtain more rigid.

In an embodiment where more than one curtain 300 is used, the curtains can be tied together with the ties 340, or a shaft could be inserted into adjacent anchor points 310.

One method of using the present invention is to attach the attaching pivoting support 100 to a limb and position it vertically and attach the ties 340 to the tree trunk such that the curtain is held generally horizontally (see FIG. 4E below).

Regardless of the position, the shaft 106 or second leg 160 of the attaching pivoting support 100 provides tension on the curtain 300 to hold it tight in the wind.

FIG. 3D shows a draw-curtain 304, which is an embodiment of the curtain 300 with one or more drawstrings 364. In this exemplary embodiment, in addition to the support hem 318, there is an edge hem 312 on each side of the curtain. Optionally, there could be one (as shown) or more interior hems 314 in the material between the edges. Each edge hem 312 or interior hem 314 forms a sleeve or path through which a drawstring 364 can pass. One end of the drawstring is attached to a drawstring fastener 366. The drawstring fastener 366 could be a permanent attachment to the draw-curtain 304. However, it is advantageous to have the drawstring fastener 366 be a moveable attachment, such as a hook or snap. A moveable version of the drawstring fastener 366 could be attached to one of a plurality of grommets 368 that can be placed in the curtain 300. Each grommet could be a loop of flexible material (as shown in FIGS. 3B and 3C) or a firm eyelet (as shown in FIG. 3D, 3E, 3F, 3H and 3I). The other of end of the drawstring 364 is drawn in a loop that is passed through a drawstring clip 362. The drawstring clip 362 prevents this end of the drawstring 364 from going through the respective hem (312 or 314). When the drawstring fastener 366 is attached to a grommet 368 above the bottom of the draw-curtain 304, the material at the bottom of the curtain is drawn up shortening the effective length of the curtain. Typically, the drawstring fastener 366 end of the drawstring 364 is also passed around a fixed object, such as a tree branch, a tree trunk (as shown in FIG. 4E below), a tree stand (as shown if FIG. 4C below), or a stake 1320. The extra length of the drawstring 364 can be drawn through the drawstring clip 362. The tension between the fixed object at the drawstring fastener 366 end of the drawstring 364 and the drawstring clip 362 keeps that section of the drawstring 364 and the draw-curtain 304 taut. By securing each drawstring 364 as explained here, the length and shape of the draw-curtain 304 can be adjusted and the draw-curtain 304 is held tight so that its material is less likely to move or make noise in the wind. This layout makes it easier and safer to manipulate or adjust the curtain 300. Being able to move the drawstring fastener 366 and adjust the length of the drawstring 364 using the drawstring clip 362 without bending over and reaching all the way to the bottom of the curtain 300 is valuable when the user is high on a tree stand. The user can make adjustments while sitting or standing.

FIG. 3D shows the interior hem 314 being shorter than the edge hem 312 teaching that the technique can be used with the hem (312 or 314) only going up a portion of the curtain 300. This could reduce the cost of the system and provide room for the slit 350 or a window 322.

FIG. 3D also shows an optional cord cutout 360 in the support hem 318. This allows a supporting cord 900 to be attached to any shaft or connector passing through the support hem 318. See FIG. 9A through 9E below.

FIG. 3E shows an enhanced draw-curtain 306, which is an embodiment of the draw-curtain 304 with one or more extra grommets 368. In this exemplary embodiment, in addition to the grommets near the edge hem, there is a grommet group 316 placed in the interior of the curtain 300. When the drawstring fastener 366 is attached to one of the interior grommets 368 a sideways (lateral) force is added to the force that draws up the bottom of the curtain 300. This sideways force can be used to change the shape of the curtain. The sideways force can be used to secure the curtain 300 around an object such as a tree or the base of the tree stand.

FIG. 3E also shows the optional slit 350 in the enhanced draw-curtain 306.

FIG. 3F shows details of the edge hem 312, drawstring clip 362, drawstring 364, drawstring fastener 366, and grommets 368.

FIG. 3G shows details of the extra length of the drawstring 364 being looped through the drawstring clip 362. A drawstring knot 365 keeps the end of the drawstring from passing through the drawstring clip 362. The user can pull on the loop while opening the drawstring clip 362 to draw more of the drawstring 364 beyond the drawstring clip 362. The user can relax the pressure on the loop while opening the drawstring clip 362 to release some of the drawstring 364 thus loosening or extending the draw-curtain 304.

FIG. 3H shows details of the interior hem 314, drawstring clip 362, drawstring 364, drawstring fastener 366, and grommets 368.

FIG. 3I shows the reinforced grommet group 316. In some cases where the curtain 300 material is light, it may be beneficial to reinforce the material receiving the grommets with a strip of grommet reinforcement 369.

FIG. 3K shows a windowed curtain 309, which is an embodiment of the curtain 300 with one or more windows 322. The window 322 is a geometric shape cut in the curtain 300. The window can optionally be covered with a see-through 320. The see-through 320 is material that a person near the window can see through but other people or wildlife, on the other side or at a distance, cannot see through. For hunting, the see-through 320 could also be material that could be shot through with an arrow, dart, or bullet. The window 322 could also be covered with a window cover 308. As shown in detail in FIG. 3J, the window cover 308 operates like an upside down version of the drawn-curtain 304. The window cover has edge hems 312, each providing a channel for drawstring 364. The drawstring fastener 366 passes through a window grommet 324 at the top of the window 322 and then is attached to one of the grommets 368 near the edge hem 312. The length of the window cover 308 can be adjusted by moving the drawstring fastener 366 to a different grommet 368 and tightening the drawstring 364 where it passes through the drawstring clip 362.

FIG. 3L shows an embodiment of the curtain 300 with the slit 350 being opened by a slit cord 352. In this example, the slit cord 352 passes through a side grommet 354 which acts as a pulley to redirect the force when the slit cord 352 is pulled. The free end of slit cord 352 can optionally be tied to form a pull loop 356. The operator can apply a force to the slit cord 352 by pulling directly on the slit cord 352 or optionally by placing the pull loop 356 around the operator's hand or foot. The force on the slit cord 352, opens the slit 350 allowing the operator to see, or shoot, through the curtain 300 without moving the curtain 300.

FIG. 3M

FIG. 3M shows an alternate curtain 307, which is an embodiment of the curtain 300 with one or more drawstrings 364. This embodiment is similar to the curtain shown in FIG. 3D and FIG. 3E. It contains optional slit 350. However, unlike the draw-curtain 304 and the enhance draw-curtain 306, this embodiment adds alternate support hem 319 (shown at the bottom). The alternate support hem 319 contains reinforced holes 367*a* through 367*d*. The reinforced holes 367 shown throughout this curtain are an embodiment of the grommet 368. The reinforced holes 367 can be formed as conventional button holes where during sewing the button hole pattern can be made in the fabric and later cut. In this embodiment, the manufacturer of alternate curtain 307 requires fewer parts and tools than, for example, the use of metal grommets.

In this embodiment the use of the drawstrings 364 and the drawstring fasteners 366 is similar to that described above.

FIG. 4A

FIG. 4A shows an operator 400 concealed by the present invention. The operator 400 may be washing or taking care of other personal hygiene.

The means of concealment can quickly and quietly be lowered as shown by an angular path 410. This allows the operator 400 to look over the curtain 300 or to shoot an arrow or fire a gun behind them without being obstructed by the means of concealment. After firing the user can quickly and quietly return the curtain 300 into its normal position as shown.

As explained earlier, one objective and advantage of the present invention is maintaining the frictional force of the first leg 150 with the attaching structure 130. This frictional force holds the attaching pivoting support 100 in place when not being moved by the operator 400. It should be clear that the operator 400 could also raise the curtain 300 so that the operator's head is also concealed.

FIG. 4B and FIG. 4C

FIG. 4B shows a person observing wildlife from a tree stand without the benefit of the present invention. As explained earlier, the person makes a silhouette against the background and is observable from 360 degrees. FIG. 4C shows the same person shielded by the present invention. In the method of present invention, first, the operator 400 attaches the attaching pivoting support 100 to the attaching structure 130 (in this example a tree). Next the operator 400 hides in front of the curtain 300. This novel approach revolutionizes wildlife observation. It eliminates the silhouette of the operator 400. It is believed that most animals see primarily black and white. This method removes one of the animals' best sensing abilities. The approach allows the operator 400 to observe 180 degrees in front of him, or her, and to be free from worrying about what is in the 180 degrees behind him, or her. The operator 400 is free to eat, drink, modify clothing, etc. when it is clear to do so and hide for ½ of the observation area that is behind him, or her. The slit 350 can be placed in the curtain 300 (as shown in FIGS. 3B, 3E, and 3L). The operator 400 can peek through the slit 350 to see if any wildlife is approaching; this can be done without moving the position of the second leg 160.

FIG. 4D shows an embodiment of the present invention where the curtain 300 is held in taut by two attaching pivoting supports 100: one at the top and one at the bottom. Either attaching pivoting support 100 can be moved independently. When the curtain 300 is taut, raising the top will cause both supports 100 to raise in parallel, and lowering the bottom will cause both supports 100 to lower in parallel.

FIG. 4E shows a use of the present invention where the attaching pivoting support 100 is attached to a horizontal structure 180, such as a tree limb or rafter, and positioned vertically. The ties 340 or the drawstrings 364 pass around a vertical object such as the tree trunk or a pole, so that the curtain 300 is held generally horizontally.

FIG. 4F

FIG. 4F shows an example of the use of alternate support 101 as an attaching pivoting support 100. In this example, either first leg 150 or alter second leg 192 can be attached to the attaching structure 130 (shown as a tree).

The curtain 300 can be quickly and quietly lowered in an angular path as described above in relation to FIG. 4*a*.

As explained earlier, an objective and advantage of the present invention is maintaining the frictional force. Either first leg 150 or alternate second leg 192 can be used to attach to the attaching structure 130.

FIG. 5A through FIG. 5C

FIG. 5A shows an embodiment of the present invention where the curtain 300 is held in its place simply by putting it over the exposed threads of the first leg 150. Good results have been found with a woven fabric catching on the threads and holding the curtain 300 in place.

FIG. 5B shows an embodiment of the present invention where the area of the curtain 300 that comes in contact with the exposed threads of the first leg 150 is reinforced for longer wear. A hem reinforcement 510 is made by using multiple layers of material.

FIG. 5C shows an embodiment of the present invention where the curtain 300 is held in place with a fastening strap 520 that connects over the first leg 150. Good results have been obtained by making the fastening strap 520 with a cord or loop of material. As shown in FIG. 5C the fastening strap 520 could also comprise a hook and loop fastener 530. The hook and loop fastener 530 is advantageous for quick assembly and disassembly.

The present invention anticipates that other similar means may be used to hold the curtain 300 in place.

FIG. 6A through FIG. 6D

Figure 6A:
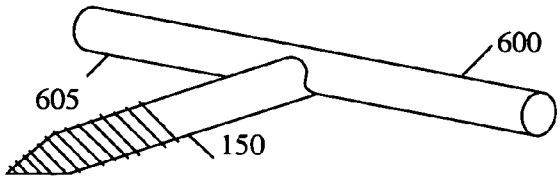

FIG. 6A shows a major variation of the attaching pivoting support 100. A T-shaped support 600 comprises the first leg 150 attached to a cross bar 605. The cross bar 605 could be bent at an angle or curved. The user screws the T-shaped support 600 into the attaching structure 130 by rotating the cross bar 605.

Figure 6B:
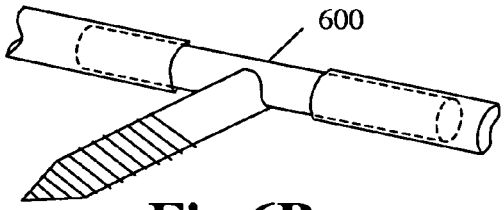

FIG. 6B shows the T-shaped support 600 inserted into two ends of a ring 630 (not shown in FIG. 6B): a first ring end 610, on one leg of the cross bar 605, and a second ring end 620, on the opposite leg. Both ring ends have cavities for receiving the ends of the cross bar 605.

Figure 6C:
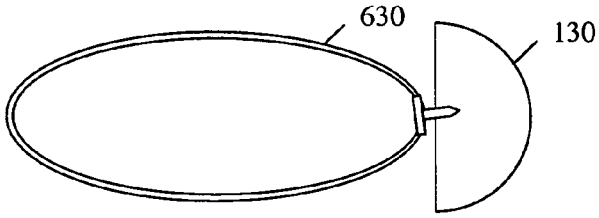

FIG. 6C shows the ring 630 extending from the attaching structure 130 supported by the T-shaped support 600. Good results have been obtained by making the T-shaped support 600 with hardened steel and making the ring 630 with a semi-rigid tube of plastic or a flexible shaft.

Figure 6D:
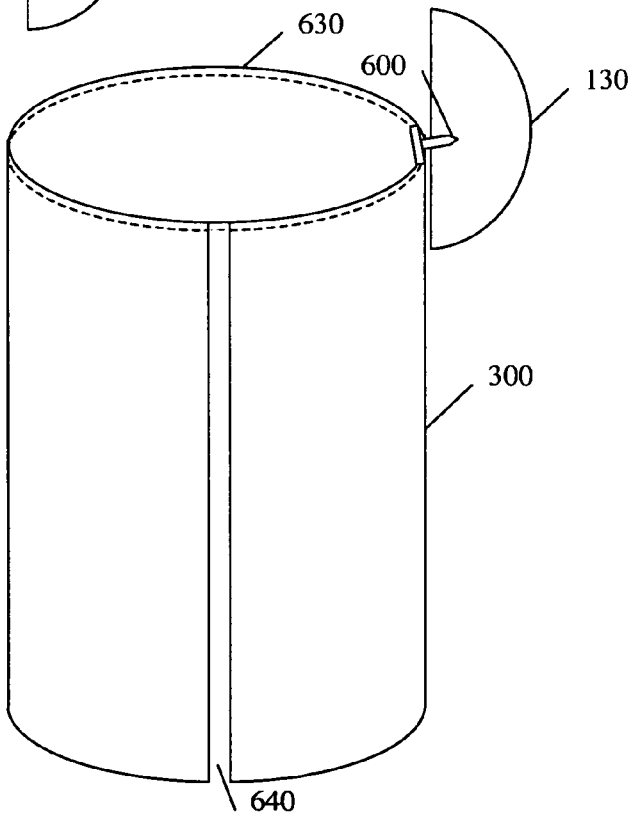

FIG. 6D shows the curtain 300 hanging from the ring 630. The edges of the curtain 300 form a curtain opening 640. The curtain opening 640 provides an entrance and exit. The curtain opening 640 further provides a viewing slit while the curtain maintains a backdrop to prevent an animal or person from seeing a silhouette. The curtain opening 640 provides a path for shooting film, arrows, and bullets.

FIG. 7A through FIG. 7G

It is anticipated by the present invention that the ring 630 could be made from multiple shafts connected permanently or temporarily by various connectors.

Figure 7A:
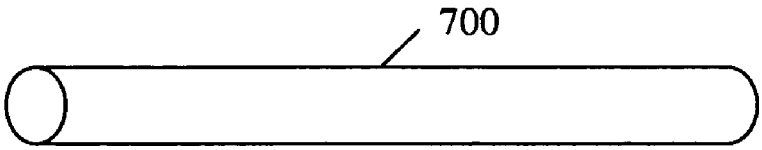

FIG. 7A shows the straight connector 700.

Figure 7B:
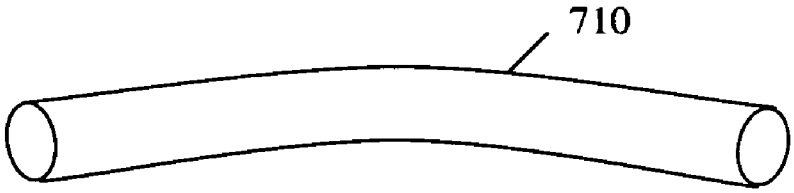

FIG. 7B shows an angled connector 710. The angle is obtuse.

Figure 7C:
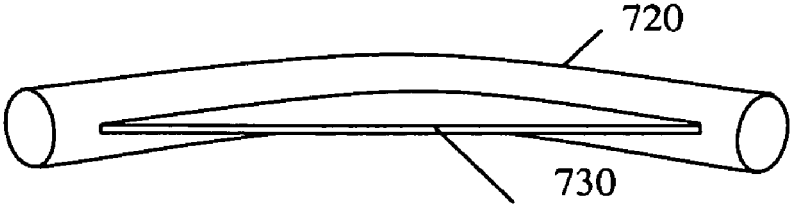

FIG. 7C shows a reinforced angled connector 720. Tests have shown that the connector receives substantial force and, depending on the strength of the material, connector reinforcement 730 may be necessary.

Good results have been obtained by making these connectors with aluminum alloy tubes or plastic.

Figure 7D:
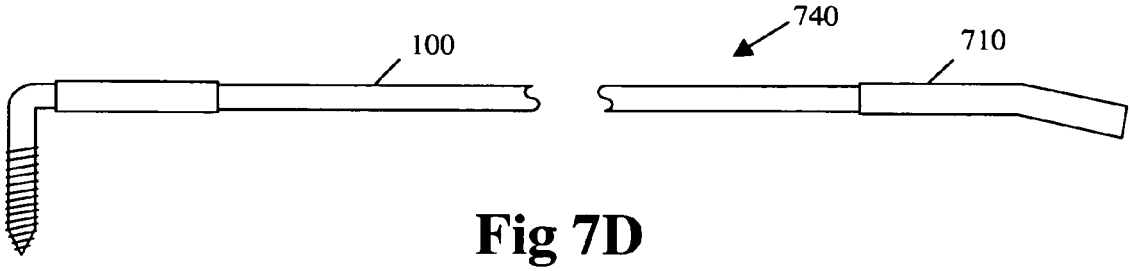

FIG. 7D shows a "support with angled connector" 740 comprising the attaching pivoting support 100 and a connector, either the angled connector 710 (shown), the straight connector 700, or the reinforced angled connector 720.

Figure 7E:
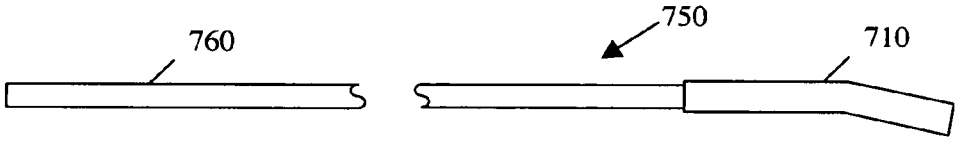

FIG. 7E shows a "shaft with angled connector" 750 comprising a connected shaft 760 and a connector: either the angled connector 710 (shown), the straight connector 700, or the reinforced angled connector 720.

Figure 7F:
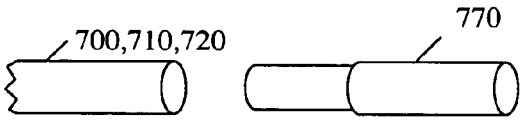

FIG. 7F shows a connector with a connector insert 770. When the shaft 106 is inserted into a connector and a sideways (lateral) force is applied to the shaft 106, the material of the shaft 106 may breakdown. For example, a fiberglass shaft may break or fray. To avoid this problem, any shaft 106 can be protected by attaching the connector insert 770 to the end of the shaft 106. The connector insert 770 has a section, with smaller dimensions than the shaft receiving section, that can be inserted into a hollow connector such as the straight connector 700, the angled connector 710, the reinforced angled connector 720, or a flexible connector 790. The sideways (lateral) forces are transferred through the material of the connector insert 770. Good results have been obtained by making the connector insert 770 from metal or plastic and attaching it to the end of the shaft 106 with glue.

Figure 7G:
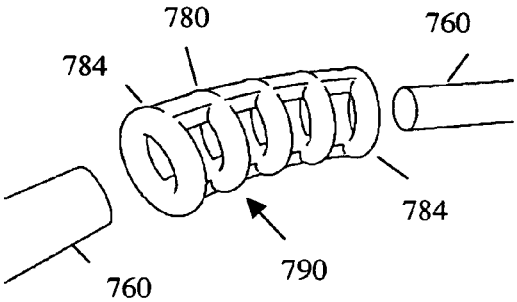

FIG. 7G shows an embodiment of the flexible connector 790. The flexible connector 790 allows the components that it connects to move side to side (laterally) but not up and down. The flexible connector can be comprised of a flexible top rail 780, a flexible bottom rail 782, and a plurality of rail rings 784. The top rail 780 and the bottom rail 782 allow the connector to flex side to side but resist up and down flexing. The rail rings 784 hold the rails together and act as receivers for the shafts 106 or narrow sections of the connector inserts 770. The rail rings 784 also limit the amount of side to side flexing.

FIG. 8A through FIG. 8E

Figure 8A:
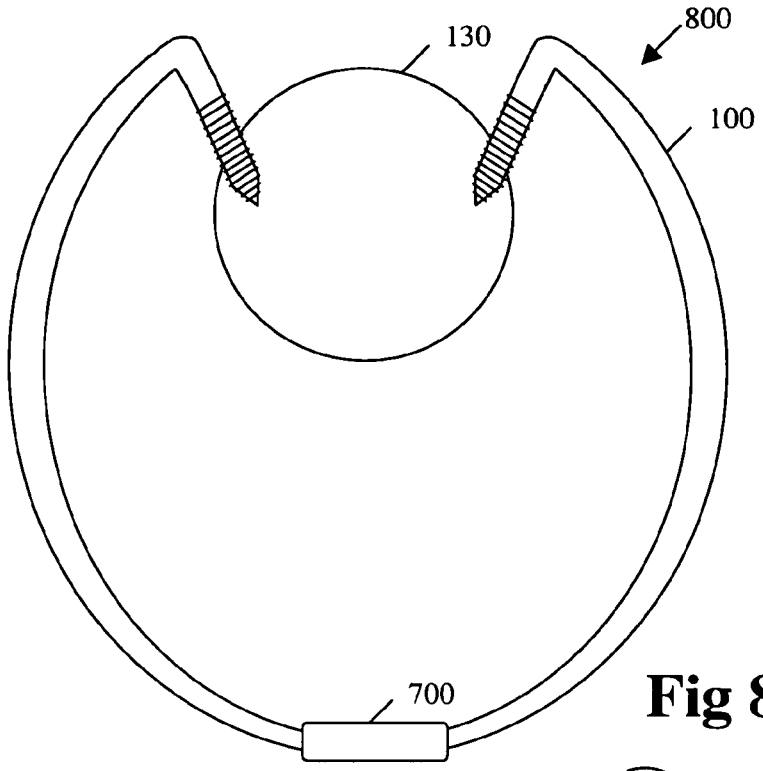

FIG. 8A shows a double support ring 800, namely, two of the attaching pivoting supports 100 attached to the same attaching structure 130, the respective second leg 160 of each support being connected with a connector: such as the straight connector 700 (shown), the angled connector 710, the reinforced angled connector 720, or similar connector.

Figure 8B:
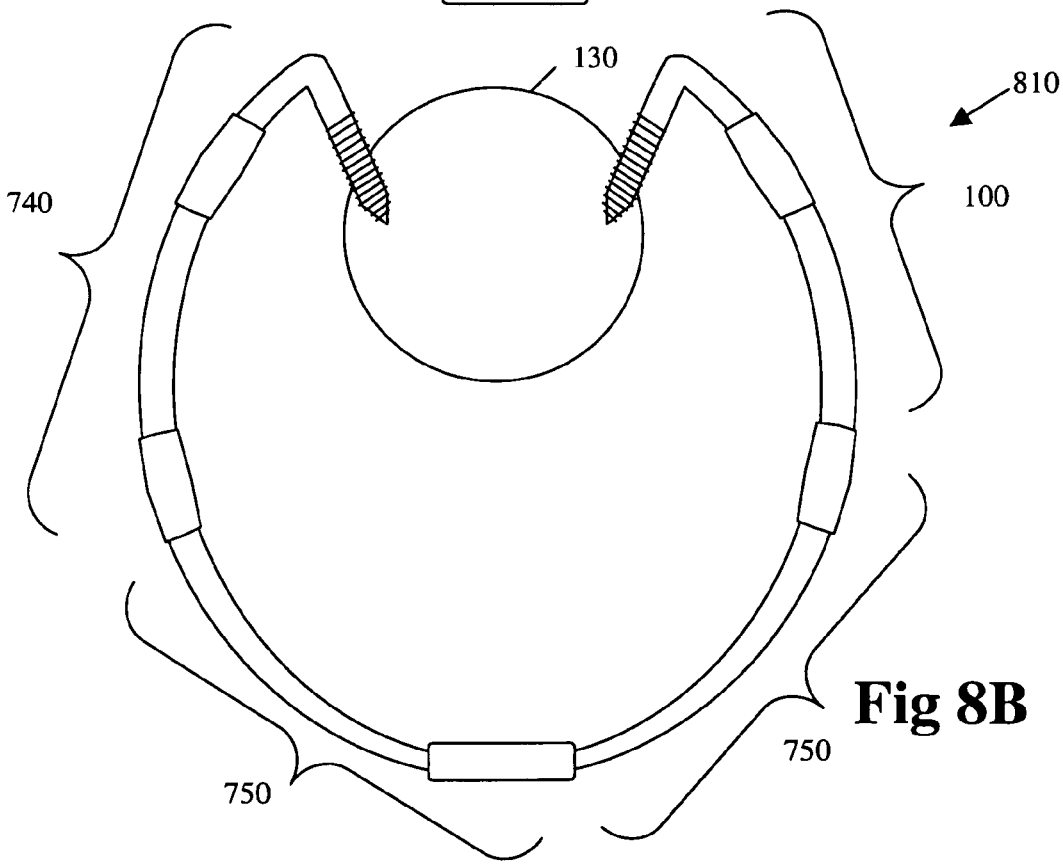

FIG. 8B shows a substantially similar structure, a segmented ring 810 comprising one "support with angled connector" 740 (as shown and explained with FIG. 7D), multiple "shafts with angled connectors" 750, and one attaching pivoting support 100.

Both the double support ring 800 and the segmented ring 810 shown in FIG. 8A and FIG. 8B, respectively, can pivot up and down by virtue of the pivoting of each first leg 150. The present invention anticipates that substantially similar pivoting support structures could be constructed of with any number of supports, shafts, and connectors.

FIG. 8C shows a curtained ring 820 comprised of either the double support ring 800 or the segmented ring 810 and one or more curtain(s) 300. The curtained ring 820 is attached to the attaching structure 130.

FIG. 8D shows variation of the segmented ring 810 (shown in FIG. 8B) comprising one "support with angled connector" 740 (as shown and explained with FIG. 7D), multiple "shafts with angled connectors" 750, and one attaching pivoting support 100. However, in this embodiment, the attaching pivoting support 100 and the angled connector 740 have obtuse angles. As explained before, the obtuse angles help avoid obstructions when attaching. This embodiment has the added advantage of excluding the attaching structure 130 from the concealed area, thus allowing more room for the user.

The elastic cord 126 running through the centers of a group of ring or hoop components (such as 100, 700, 710, 720, 740, 750, 760, 770, or 790) can connect the components. This can prevent components from falling and makes it easier to assemble the rings 360, 800, 810, 820 or hoop 910.

Figure 8E:
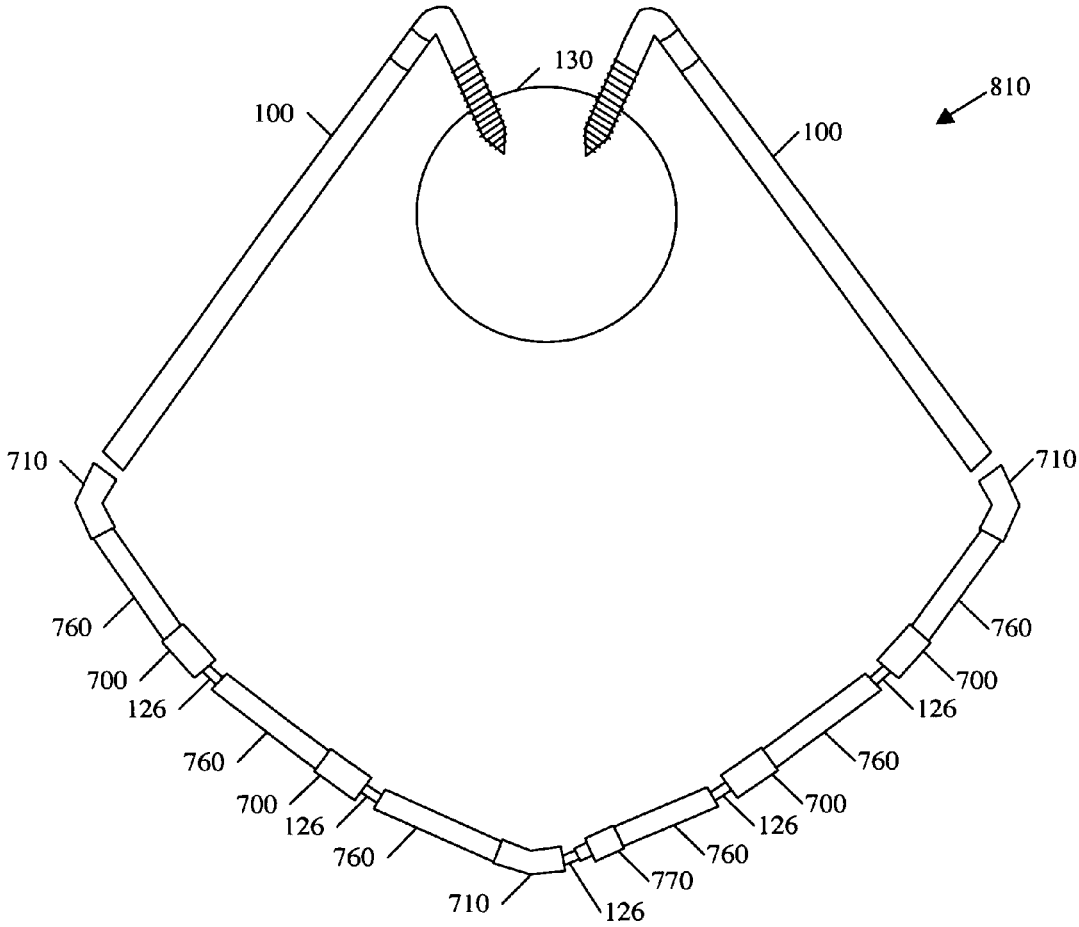

FIG. 8E shows an alternate embodiment of the segmented ring 810 where two attaching pivoting support attach to the attaching structure 130. The remaining components of the segmented ring 810 comprise a plurality of angled connectors 710, connected shafts 760, straight connectors 700, and connector inserts 770, all connected together by the elastic cord 126.

FIG. 9A through FIG. 9E

Figure 9A:
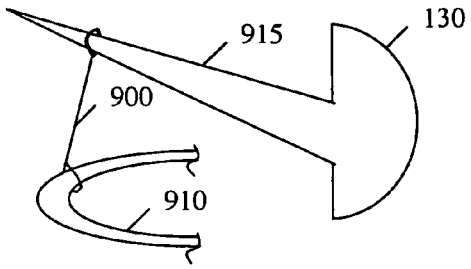

FIG. 9A shows the supporting cord 900 supporting a hoop 910. The hoop 910 represents either the attaching pivoting support 100, the ring 630 (shown in FIG. 6C and FIG. 6D), the double support ring 800 (shown in FIG. 8A), the segmented ring 810 (shown in FIG. 8B, FIG. 8C and FIG. 8D), or an equivalent structure. In the example shown in FIG. 9A the supporting cord 900 is attached to an overhead structure 915, such as a tree limb, a scaffold, or other overhead element.

Figure 9B:
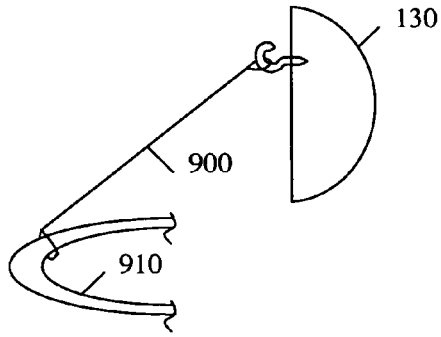

FIG. 9B shows the supporting cord 900 attached to an eye fastener 920. In the example shown in FIG. 9B the eye fastener 920 is screwed into the attaching structure 130 at a point higher than the hoop 910 is attached.

Figure 9C:
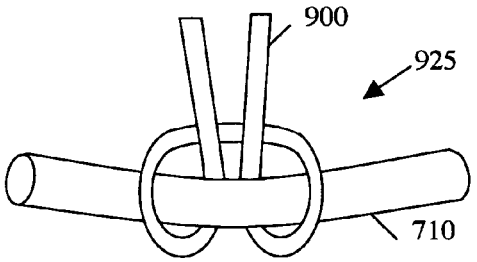

FIG. 9C shows a knotted connector 925. The supporting cord 900 is tied around a connector. Good results have been obtained by tying a lark's head knot over the angled connector 710 as shown. The present invention anticipates that other knots, for example two half hitches, clove hitch, timber hitch, bow line, taut line, bow knot, slip knot, and the like could be substituted. The present invention anticipates that such knots could be tied anywhere on the hoop 910 as shown in FIG. 9A and FIG. 9B.

Figure 9D:
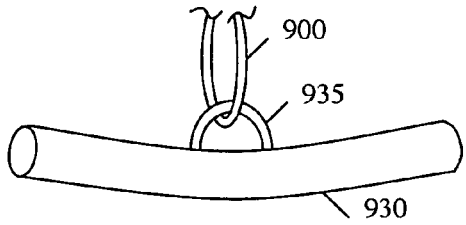

FIG. 9D shows a connector with eye loop 930. The supporting cord 900 passes through an eye loop 935 comprising part of the connector.

Figure 9E:
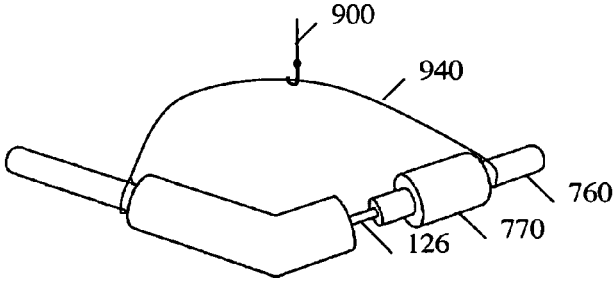

FIG. 9E shows the section of the segmented ring 810 shown is FIG. 8E being supported by the supporting cord 900 and a second cord 940. The second cord 940 is tied around the connected shaft 760 next to the angled connector 710 at one end and around the connected shaft 760 next to the connector insert 770 at the other end. The second cord 940 distributes the force from the supporting cord 900 to the segment ring 810 at two points. The raised edges of the angled connector 710 and the connector insert 770 prevent the second cord 940 from slipping inward. Because the second cord 940 connects the two components, the elastic cord 126 between them is redundant and could be eliminated.

In these embodiments one or more cords 900 help support the weight of the hoop 910 and the curtain 300 (not shown) so that the hoop 910 and its components can be of lighter weight and support a heavier load.

FIG. 10A through FIG. 10F

A number of tree steps are known in the art. The present invention anticipates that the attaching pivoting support 100 could attach to an attaching structure 130 comprising an improved tree step and pivot about its connection to the tree step at a friction pivot joint 1025. FIG. 10A through FIG. 10F show various embodiments of the attaching pivoting support 100 in combination with various tree steps. In each example, the attaching structure 130 includes an improved tree step. It should be anticipated that any tree step could be used in a similar manner in the present invention.

Figure 10A:
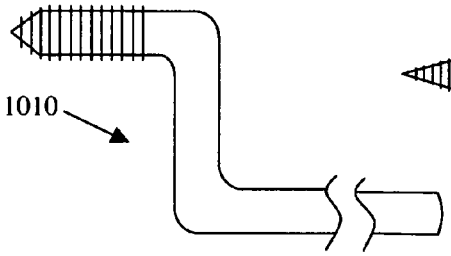

FIG. 10A shows a first example 1010 of an embodiment of the present invention which is formed by additional bends in the attaching pivoting support 100. A similar but not equivalent tree step based device with three or more legs is shown in U.S. Pat. No. 5,908,084, entitled "Lifting and raising device", however, the present invention is not described or claimed by Laurin et al.

Figure 10B:
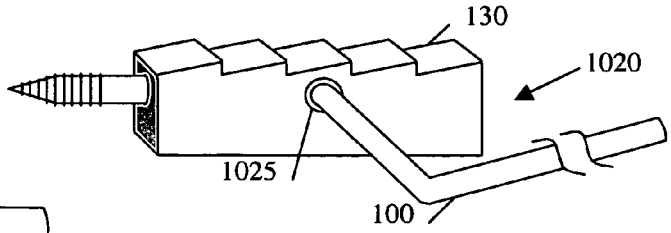

FIG. 10B shows a second example 1020 where the attaching pivoting support 100 is combined with the tree step shown in U.S. Pat. No. 5,279,388, entitled "Tree climber or step device", however, the present invention is not described or claimed by Laughlin et al.

Figure 10C:
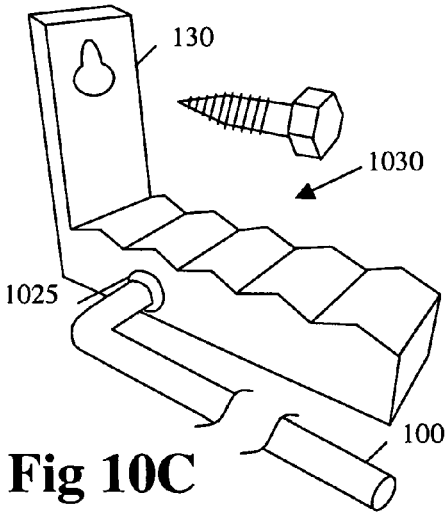

FIG. 10C shows a third example 1030 where the attaching pivoting support 100 is combined with the tree step shown in U.S. Pat. No. 4,867,272, entitled "Steps for climbing trees", however, the present invention is not described or claimed by Troubridge.

Figure 10D:
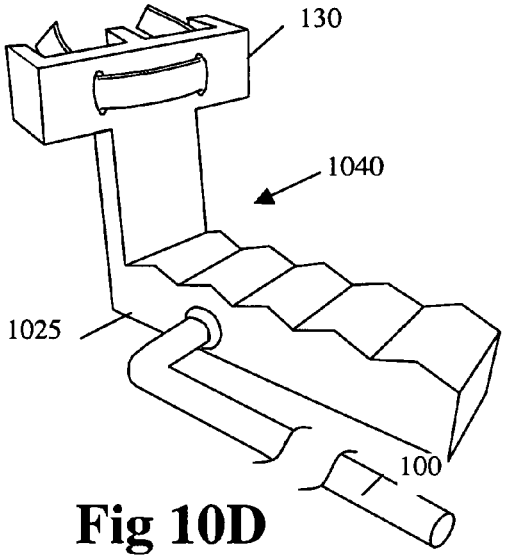

FIG. 10D shows a fourth example 1040 where the attaching pivoting support 100 is combined with the tree step shown in U.S. Pat. No. 4,000,788, entitled "Belt-on tree step (BOTS)", however, the present invention is not described or claimed by Burgess et al.

Figure 10E:
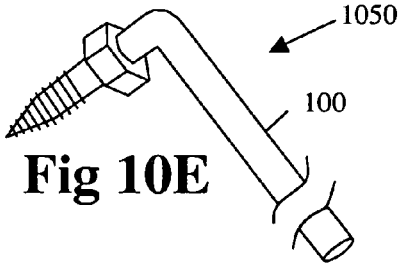

FIG. 10E shows a fifth example 1050 where the attaching pivoting support 100 is combined with a component of the tree step shown in U.S. Pat. No. 4,775,030, entitled "Tree step", however, the present invention is not described or claimed by Wright.

Figure 10F:
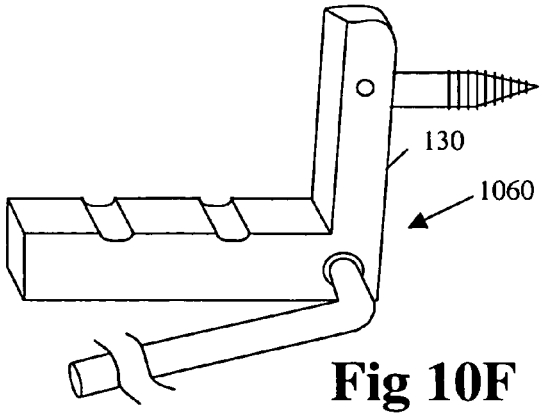

FIG. 10F shows a sixth example 1060 where the attaching pivoting support 100 is combined with the tree step shown in U.S. Pat. No. 4,697,669, entitled "Folding portable tree step", however, the present invention is not described or claimed by Bergsten.

FIG. 11A

FIG. 11A shows the attaching pivoting support 100, in the embodiment shown in FIG. 1F and FIG. 2B, connected to the attaching belt 200. In this embodiment the strap 210 passes through holes in each end of, and under, the attaching fastener 230. This embodiment shows the use of the threaded connector 104 for attaching the shaft 106 to the plate connection 112. The shaft 106 passes through the plate sleeve 114 for added support. The attaching pivoting support may be rotated around the pivot point along the path 410 (as is show in FIG.

4A). The friction between the plate 110 and the attaching fastener 230 holds the device in position.

FIG. 11B

Figure 11B:
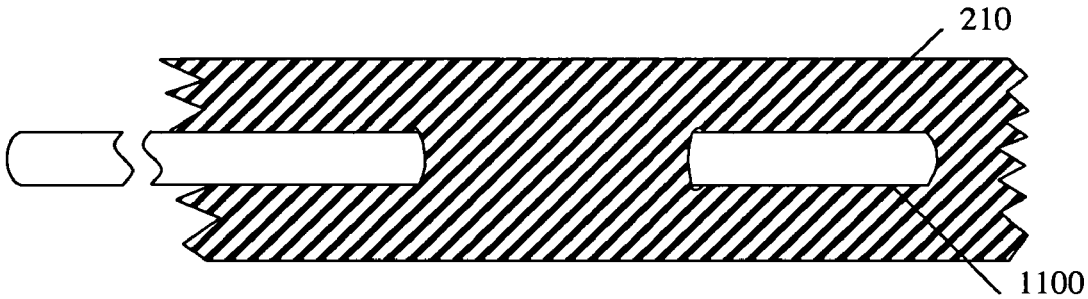

FIG. 11B shows a simple embodiment where the attaching pivoting support 100 passes through the strap 210 via two strap holes 1100. The tension of the strap 210 against the attaching structure 130 holds the attaching pivoting support 100 in place. The attaching pivoting support 100 can be bent at an angle and pivot in the strap holes 1100.

FIG. 11C

Figure 11C:
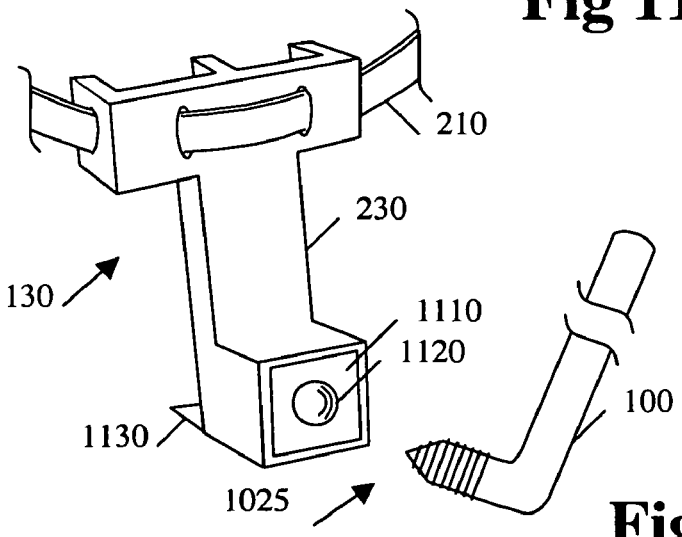

FIG. 11C shows an embodiment where the attaching pivoting support 100 connects to the attaching structure 130 comprising the strap 210 and the attaching fastener 230. The attaching fastener 230 provides the friction pivot joint 1025 with the first leg 150. The friction pivot joint 1025 comprises attaching material 1110, attached to the attaching fastener 230, and having a threaded attaching hole 1120. An optional tooth 1130 on the back of the attaching fastener 230 provides torque resistance.

Good results have been found making the attaching fastener 230 of metal and the attaching material 1110 of a high polymer plastic as known in the art.

FIG. 11D

Figure 11D:
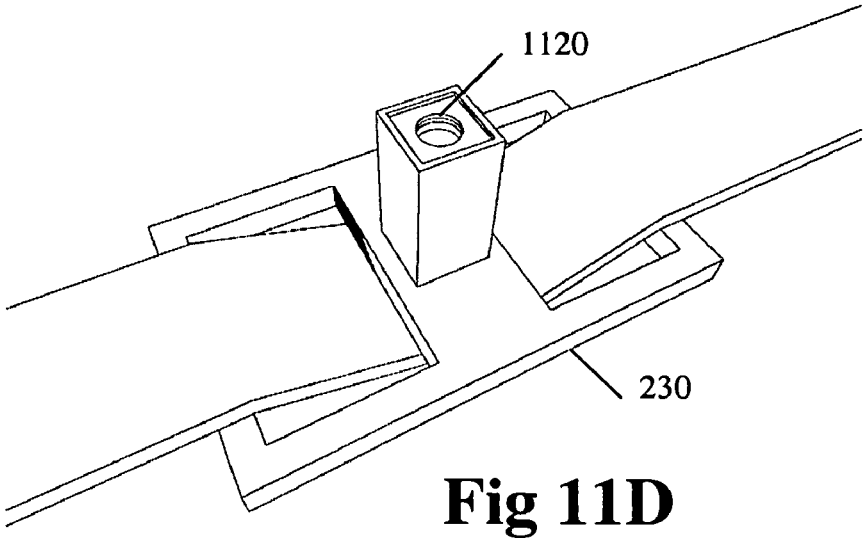

FIG. 11D shows an alternate embodiment of the attaching fastener 230. In this embodiment torque resistance is provided by the strap 210.

FIG. 11E

Figure 11E:
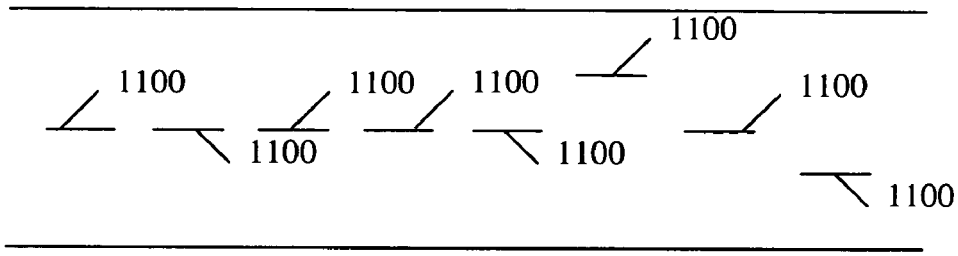

FIG. 11E shows an alternate embodiment strap 210 with more than two strap holes 1100. In this embodiment the attaching pivoting support 100 can pass through any two or more of the strap holes 1100. For example, if the strap 210 is attached to a small diameter tree, then the attaching pivoting support 100 could be passed through strap holes 1100 that are close to each other. On the other hand if the strap 210 is attached to a large diameter tree it may be necessary to pass the attaching pivoting support 100 through strap holes 1100 that are farther from each other to apply the necessary friction.

FIG. 11F

Figure 11F:
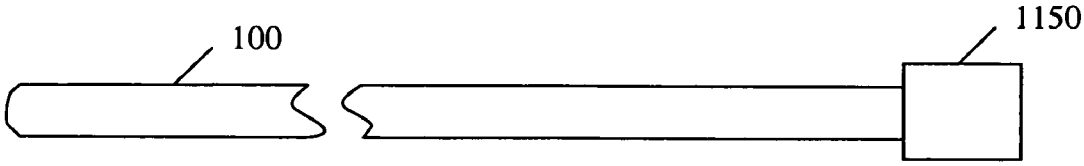

FIG. 11F shows an embodiment where one end of the shaft 106 of the attaching pivoting support 100 has an enlarged end that acts as a stopper 1150 to prevent it from passing through the strap holes 1110.

Figure 11G:
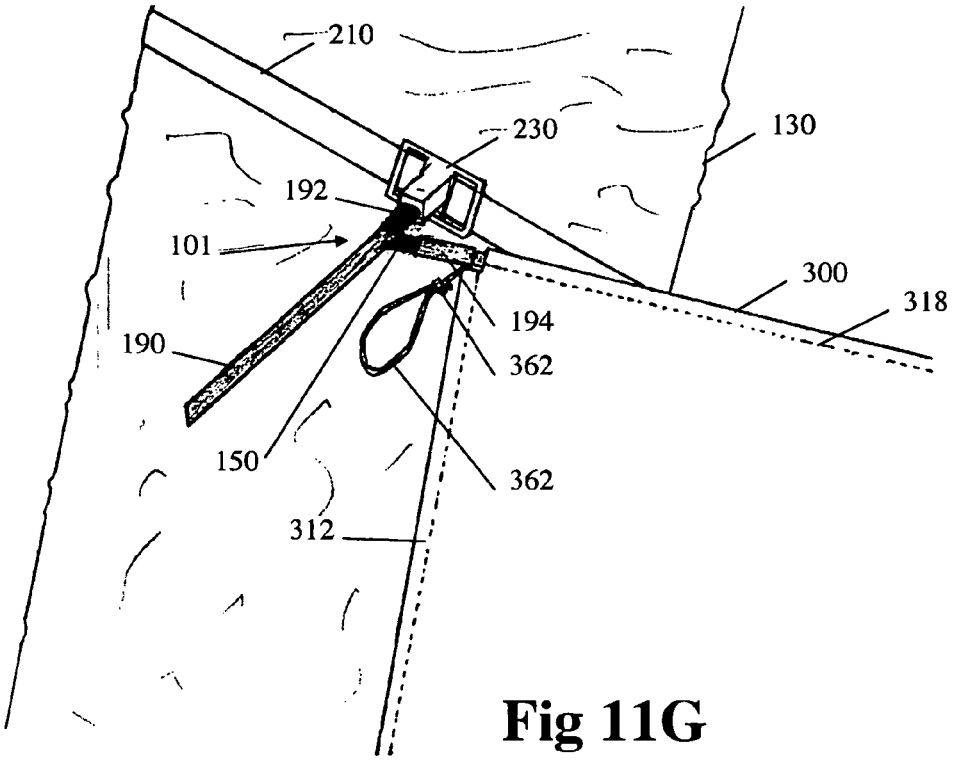
Figure 11H:
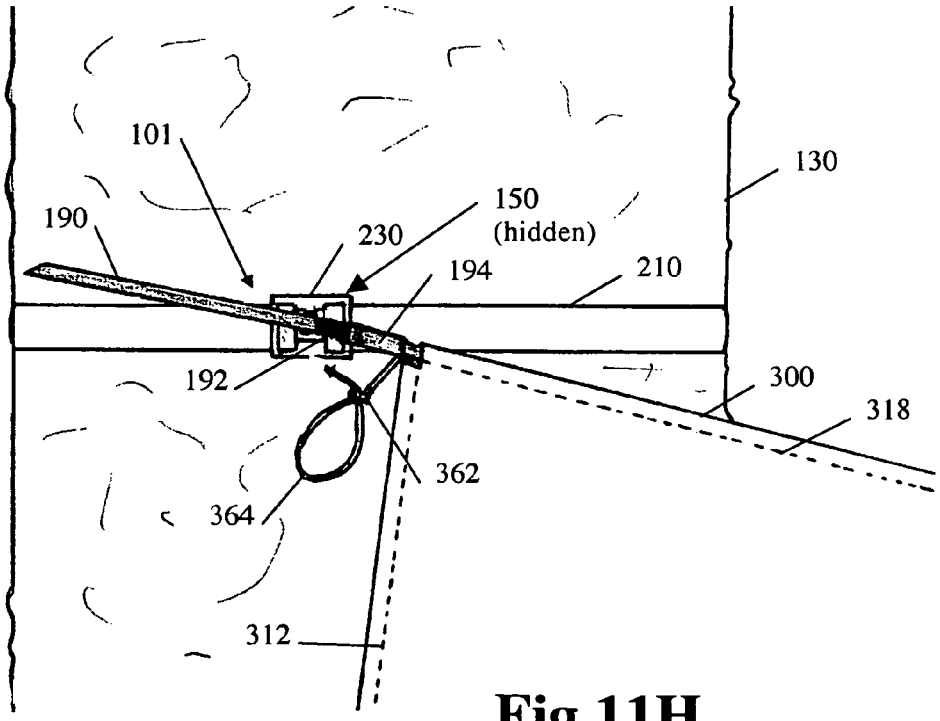

FIG. 11G and FIG. 11H

FIG. 11G and FIG. 11H show embodiments where the alternate support 101 connects to the attaching fastener 230. As described above the attaching fastener 230 provides the friction pivot joint 1025 with the first leg 150 (FIG. 11H) or alternate second leg 192 (FIG. 11G).

In FIG. 11G, where the alternate second leg 192 is used to attach to attaching structure 130, the third leg 190 can be used to hang equipment such as a bow, quiver or water bottle.

In FIG. 11H, where the first leg 150 is used to attach to attaching structure 130, the third leg 190 can be used as a lever to assist in driving the alternate support 101 into the attaching structure 130. The third leg 190 can also be used as a lever to raise and lower the curtain 300.

FIG. 12

FIG. 12 shows an alternate embodiment of the present invention where the attaching pivoting support 100 comprises the shaft 106 that passes under the strap 210. In this embodiment the pressure and friction of the strap 210 is sufficient to attach and to provide a pivot point for the attaching pivoting support 100. The curtain 300 is supported by the attaching pivoting support 100.

FIG. 13

FIG. 13 shows a lightweight, portable embodiment of the present invention, known as the Pocket UnBlind™. FIG. 13 shows a folded curtain 300; a collapsed attaching pivoting support 100 (shown disassembled into two separate pieces) comprised of the threaded support 102 (as shown, or alternatively, the alternate support 101—not shown) and the segmented shaft 107 with end-cap 170 held together by the elastic cord 126; a plurality of stakes 1320; and a carrying case 1300. The case 1300, which can hold all of the other components, is shown with a belt loop 1310, which makes it easy to carry. The case is closed with the drawstring 364, which can be held closed with a knot or the drawstring clip 362. Each stake 1320 can be put in the ground, tree, or other substance to make a fixed object to which the ties 340 or drawstrings 364 of the curtain 300 can be attached. With the stakes, the same blind can be used, for example, in a tree stand for hunting deer in the fall and on the ground for hunting turkey in the spring.

FIG. 14A and FIG. 14B

FIG. 14A and FIG. 14B show ground blind embodiments.

FIG. 14A shows the use of three alternate supports 101 and two alternate curtains 307 to form a ground blind. In this example, the alternate second leg 192 of each alternate support 101 is inserted into the ground. Each alternate support 101 is connected to a shaft 106 using either a threaded connector 104 or one of the embodiments of a dimpled connector 194. The alternate support hems 319 of both a first alternate curtain 307*a* and a second alternate curtain 307*b* are placed over the center of alternate support 101. The support hem 318 of the first alternate curtain 307*a* is placed over the shaft of the alternate support 101 on the left. The support hem 318 of the first alternate curtain 307*b* is placed over the shaft of the alternate support 101 on the right. The alternate supports 101 can be placed in a line to form wall or diagonally to form a V-shaped blind.

Three or more curtains could be used to form a fully enclosed blind.

FIG. 14B shows an embodiment with more of the optional curtain features, such as, drawstrings 364 and the use of the reinforced holes 167*a* through 367*d* to create an interwoven connection between two alternate curtains 307. This will be explained in more detail in reference to FIG. 14D and FIG. 14E below.

FIG. 14C through FIG. 14H

FIG. 14C though FIG. 14G shows details of the ground blind embodiments.

FIG. 14C shows an embodiment where the third leg 190 has been inserted into the ground. The alternate second leg 192 has been attached to a shaft 106 or connected shaft 760 using a dimpled connector. In this example, the first leg 150 can be used to assert downward force on the alternate support 101 using a foot to drive the third leg 190 into rocky or frozen soil.

FIG. 14D illustrates an embodiment where two curtains 300 are joined over a shaft 106 (or 760) using hem segments 395*a* through 395*c*. In this example, hem segments 395*a* and 395*c* are part of the curtain 300 on the right and hem segment 395*b* is part of another curtain 300 on the left. The curtains are joined by alternately passing the shaft 106 through the hem segments: first 395*a*, then 395*b*, then 395*c* and so forth. FIG. 14D also shows an alternate cap 1400.

FIG. 14E shows the preferred embodiment of joining alternate curtains 307 which works on a similar principle. The first alternate curtain 307*a* and the second alternate curtain 307*b* are joined by passing the shaft 106 through the alternate support hem 319 of each curtain. At each of the reinforced holes 367*a* through 367*d*, the rod passes out of the hem of one curtain and into the hem of the other curtain. For example, the shaft would enter through 307*a* and then into the hem of curtain 307*b* at reinforced hole 367*d*. It would exit 307*b* at 367*c* and at that point enter 307*a*'s hem at 367*b*. It would continue along the alternate support hem 319 where it would exit 307*a* at 367*c* and reenter 307*b* at 367*b* where it would continue through the hem 319 of 307*b* until is exited at 367*a* and would finally pass through the final reinforced hole 367*d* of 307*a*. At that point, both alternate curtains 307 would be secured by the alternate cap 1400. The advantage of this arrangement is that it forms a tight connection that prevents light and wind from passing between the two curtains. This novel alternate support hem 319 also has the advantage of being easy to secure over a shaft by itself or interwoven as described above. This is in contrast to the embodiment shown in FIG. 14D where the shaft has to be placed through multiple hem segments 395.

FIG. 14F shows the detail of the alternate cap 1400 which is similar in design to the connector insert 770. The tip 1402 has a narrow diameter and the rim 1404 has a wider diameter. As shown in FIG. 14G, when inserted through the first alternate curtain 307*a* and the second alternate curtain 307*b* the tip 1402 can pass through reinforced holes 367*d* of 307*a* and 367*a* of 307*b* (as described above). The rim 1404 portion of the alternate cap 1400 holds both curtains in place while under tension, but easily allows the curtains to be slipped off to break down the blind.

FIG. 14H shows a pivoting ground bind comprised of two alternate supports 101 connected to opposite ends of a first shaft 106 (hidden by the curtain edge hem 312). The top alternate support 101 is also connected to a second shaft 106, which supports a curtain via support hem 318. When the third leg 190 is inserted into the ground, it can pivot freely in any direction. Thus, the shaft supporting curtain 300 can be pivoted anywhere in a horizontal plane.

Modular System for Concealment and Shelter

The components described thus far provide the basic components for a blind or shelter system. These basic components can be sold as kits that can be combined with other basic kits or more advanced kits for become the building blocks for a variety of blind and shelter structures.

For example, an attaching pivoting support 100 (comprising 107 and 101 as shown in FIG. 13, comprising 109 and 101 as shown in FIG. 1DD or comprising 109*b* and 101*c* as shown FIG. 1OO) and a curtain 300 (or 307) can be sold as a starter kit in a small case 1300. The starter kit can be used configure tree blinds as shown in FIGS. 4A, 4C, 4E, and 4F. A basic blind kit can be comprised of two attaching pivoting supports 100 (e.g. 109 and 101*b*) and an alternate curtain 307. The basic blind kit can be used to configure tree blind as shown in FIG. 4D and ground blinds as shown in FIG. 14 H and one side of FIG. 14A. With two basic blind kits a two sided tree blind (similar to FIG. 8C or 8E), a covered tree blind shown in FIG. 17A, and ground blind configuration shown in FIG. 14A or 14B can be constructed. By adding more basic kits more complex structures can be constructed; for example, with five curtains 307 and five supports 100 (as shown in FIG. 1DD) a pentagon ground blind can be constructed.

Advanced kits can be combined with basic kits to provide even more flexibility in constructing various blinds and shelters. One advantage of this modular system is that the operator 400 does not have to wait till he can afford the entire system. A starter kit or basic kit can be purchased first and then enhanced later without losing the initial investment. Another advantage is that a group of operators 400 can meet in the field and combine their individual basic components to form a more complex structure that meets their combined needs.

FIG. 15A through FIG. 15J

FIG. 15A through FIG. 15J show components and features of an advanced module that can be combined with the basic module (as shown in FIG. 14A) to form various covered blind and shelter structures.

Figure 15A:
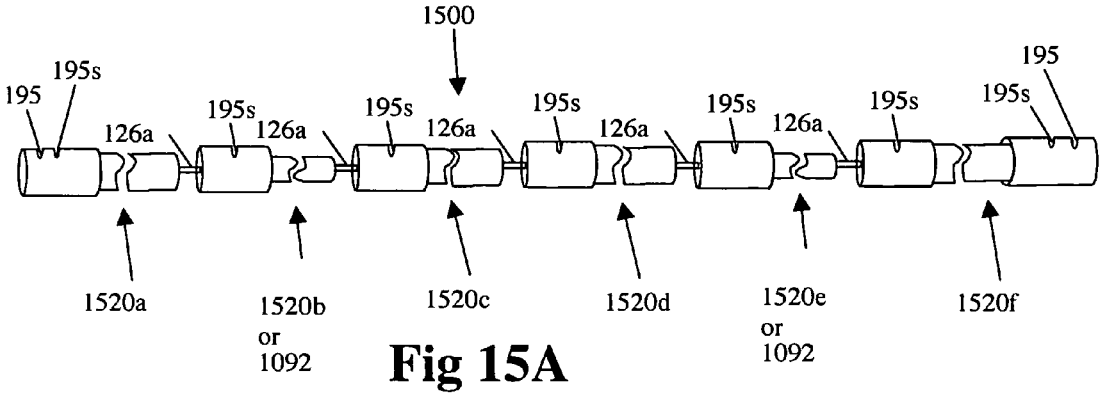

FIG. 15A shows a segmented cover shaft 1500. In the embodiment shown, the segmented cover shaft 1500 is comprised of six cover shaft segments 1520 connected together with a cord 126*a*. Both ends of the segmented cover shaft 1500, in this exemplary embodiment, are receiving ends 1072 with dimpled connectors 194. In the embodiment shown segment 1520*b* and 1520*e* are comprised of thinner shafts 1092 (as explained in reference to FIG. 11I). As will be shown later, in other embodiments both ends of the segmented cover shaft 1500 will be inserting ends 1070.

Figure 15B:
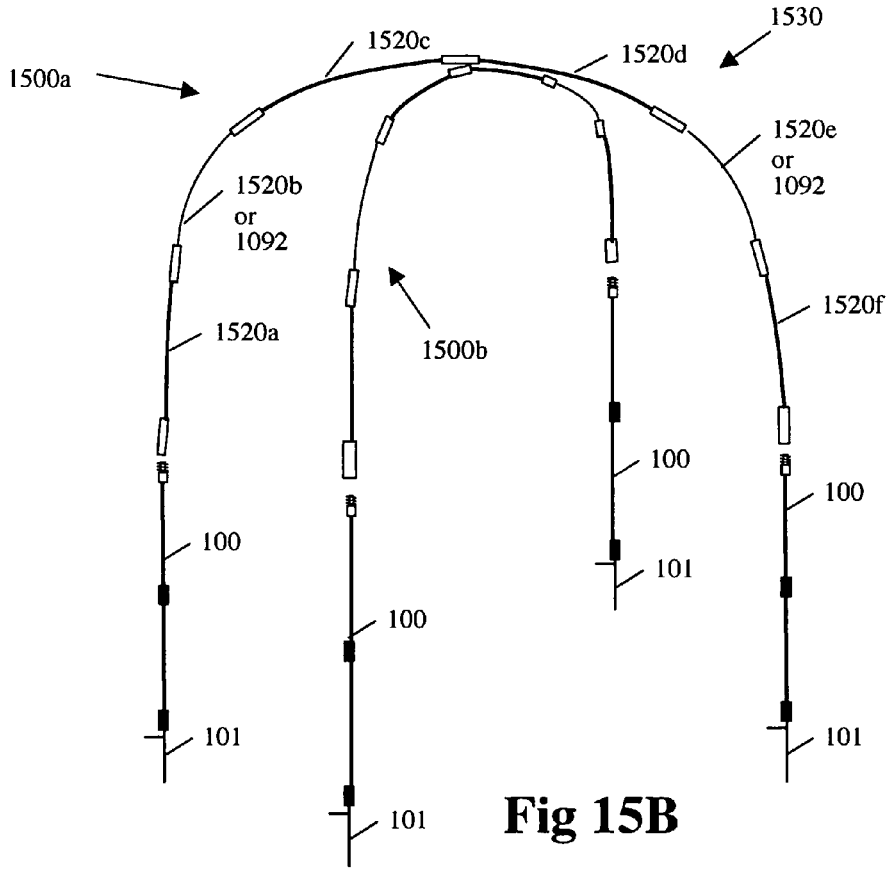

FIG. 15B shows a shelter frame 1530. In this embodiment, the frame is constructed of four attaching pivoting support 100 (using alternate supports 101, such as 10*b*) and two segmented cover shafts 1500*a* and 1500*b*. The two segmented cover shafts 1500*a* and 1500*b* cross and connect to supports 100 in opposite corners forming a frame for an arched dome.

This method of construction has other advantages over conventional tents and blinds because the frame 1530 is secured firmly to the ground. A single operator can easily insert each support 100 into the ground and then attach each cover shaft 1500 one at a time without the conventional difficulty of trying to thread the shafts through the tent or blind material. Also because the structure is secured firmly to the ground it will not move in the wind or slide down steep terrain. The supports 100 can be quickly setup and used independently with curtains 307 as shown in FIG. 14A and, later, the fourth support 100 and cover shafts 1520 and cover 1540 (not shown) can be added as needed for shelter from sun, rain, or snow or for enhanced concealment.

In the embodiment where segments 1520*b* and 1520*e* comprise more flexible segments 1092, the arch will bend more at those segments forming a flatter top. This novel feature provides more useful space with the structure. The operator can move around freely throughout a large area without obstruction. This is especially beneficial if the operator is holding a vertical object such as a bow. This novel feature allows for maximum headroom without having the peak of the structure any higher than needed.

The thinner or more flexible segments 1092 will need to support a greater bending force and would be the natural breaking point if made from the same materials as the other shaft. The thinner segments 1092 could be made with a solid shaft while the other commonly thick segments are hollow. Alternatively, the more flexible segments could be made from a more flexible material such as plastic while the other segments 1092 are made of fiberglass.

Figure 15C:
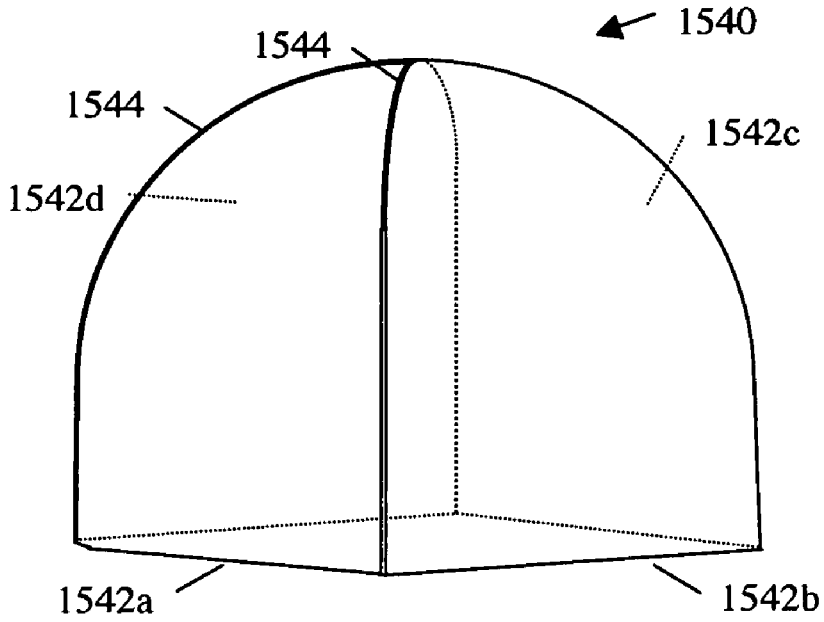

FIG. 15C shows a cover 1540 comprised of four cover panels 1542. Adjacent panels are connected together with a cover seam 1544. For example, cover panel 1542*a* is connected to cover panel 1542*b* on its right side and to cover panel 1542*d* on its left side. For concealment uses, the cover is preferably made of camouflaged material.

A novel feature of the present invention is that the cover 1540 can used to cover the shelter frame 1530 including any curtains 307 that are already attached to the shelter frame 1530. One advantage over a tent with external poles is that the cover 1540 is external to the poles, and is preferably camouflaged, so that the wildlife will not see the poles at the apex of the structure where tent poles would be most noticeable against the sky.

Another novel feature of the present invention is that the cover can be rolled up or raised as desired because it is not integral to the structure of the tent.

Figure 15D:
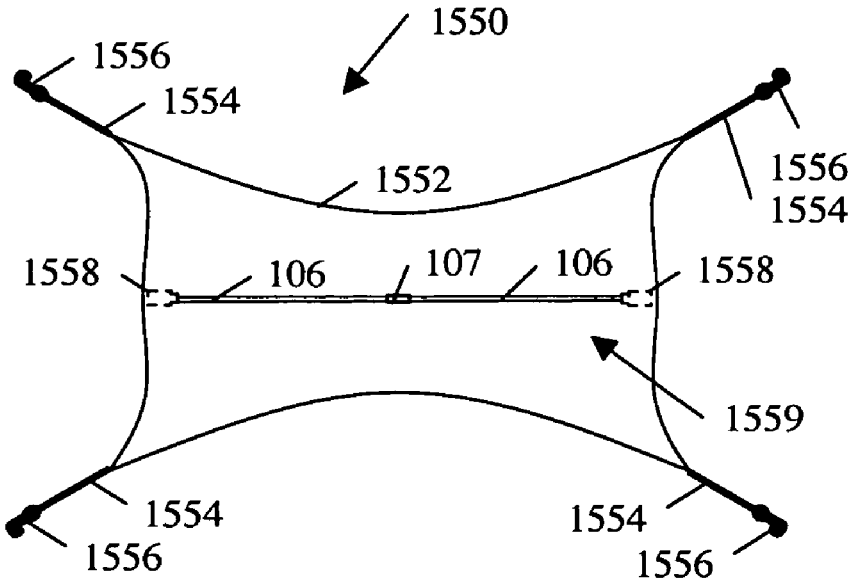

FIG. 15D shows an optional rain fly 1550 component. The rain fly 1550 is comprised of fly material 1552 with fly cords 1554 attached to each corner. A fly fastener 1556 is attached to the end of each fly cord 1554. A plurality of fly pockets 1558 can be used to hold one or more rain fly shafts 1559. In the embodiment shown, the rain fly shaft 1559 is a segmented shaft 107 composed of two shafts 106.

Figure 15E:
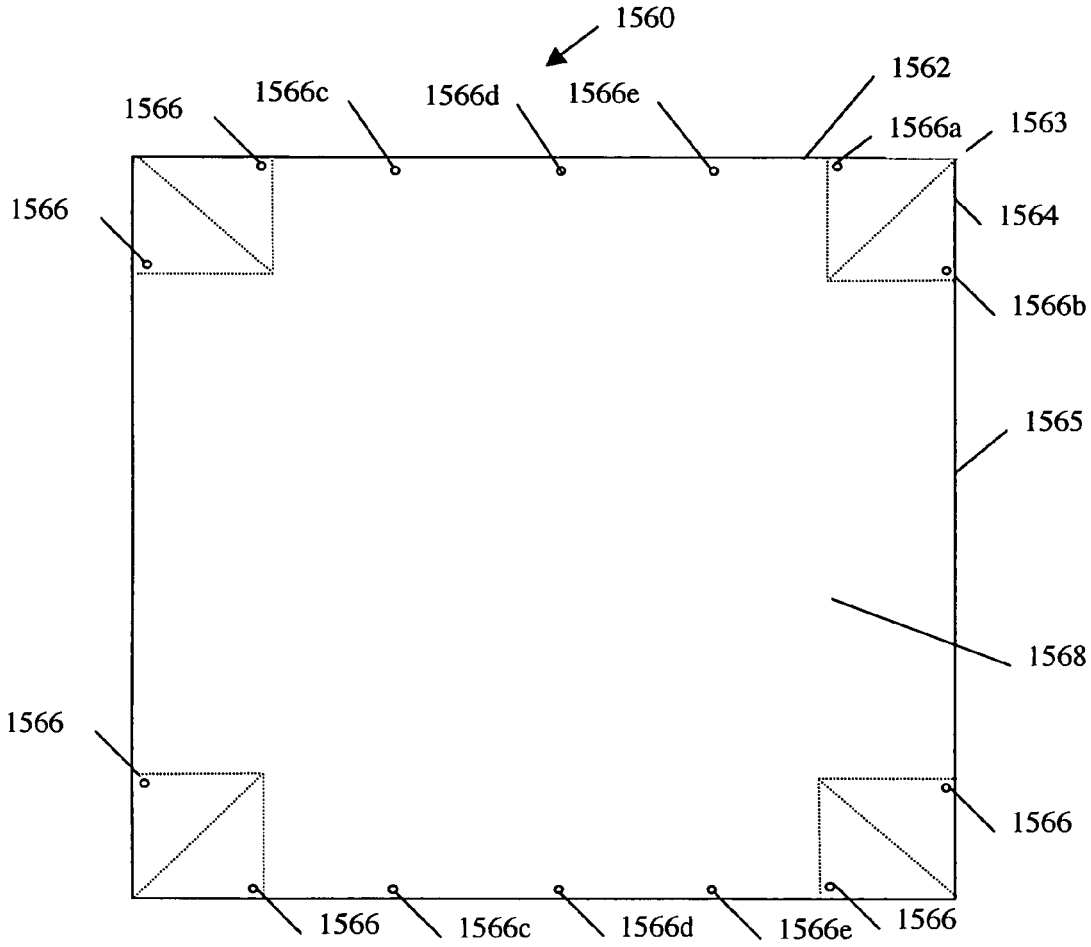
Figure 15F:
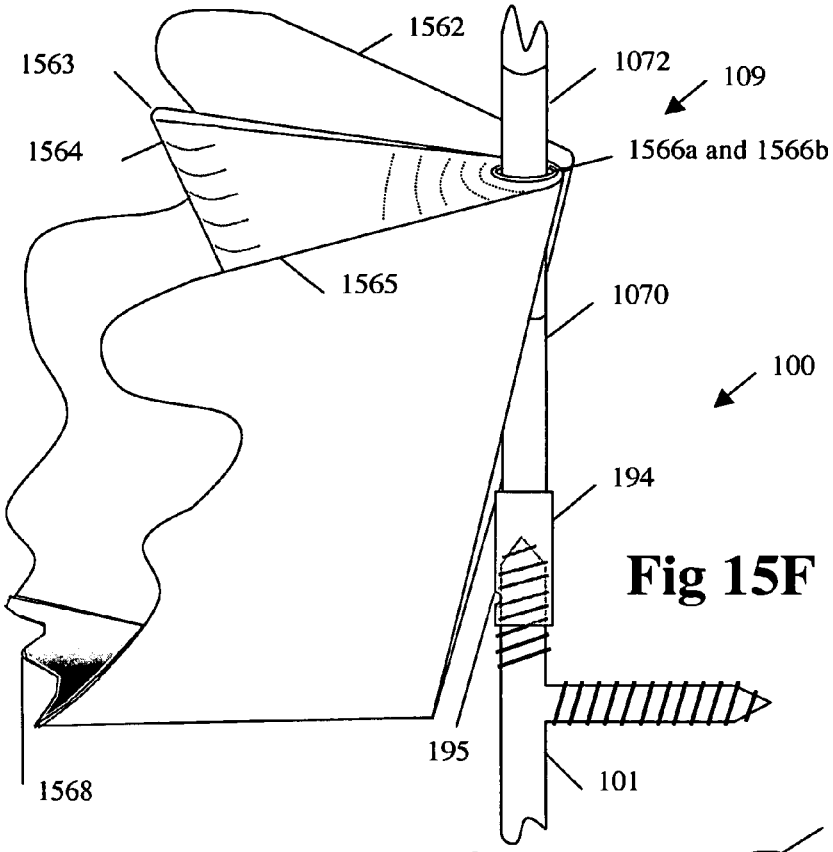

FIG. 15E shows an optional tarp 1560 that can be used as a novel removable floor. The tarp 1560 can have a number of firm grommets or eyelets 1556. In each corner 1563 a corner fold 1564 is shown. The corner 1563 can be folded inward at corner fold 1564 to bring the corner eyelets 1566*a* and 1566*b* together. As shown in FIG. 15F the corner eyelets 1556*a* and 1556*b* can be held together between the inserting end 1070 and the receiving end 1072 of the two shaft segments 199 that make up the threaded segmented shaft 109. This is one advantage of the connection show in FIG. 1HH. Because the shelter frame 1530 comprises four supports 100, each corner of the removable floor 1560 can be held up as shown in FIG. 15F. This novel feature has advantages over a conventional ground tarp because it creates relatively high sides that will keep out water, dirt and debris. This novel feature has advantages over a convention tent with an attached bottom because the bottom can be removed. It does not have to be carried when a floor is not needed. It can be removed from the shelter cover for cleaning; for example after a muddy campout or use as a water fowl blind in a marshland it can be hosed down and dried independently. Further, because the floor is a separate component it can more easily be laid out on the terrain for optimum placement and the used a guide for insertion of the alternate supports 101 into the ground to form a square.

The tarp material 1568 in the center of the tarp 1560 forms the floor with four raised sides. Each corner 1563 is folded inside the structure so that rain and dirt cannot enter through the corner fold 1564.

In reference to a first side 1562, additional eyelets 1566*c*, 1556*d*, and 1556*e* can be placed at measured points along the side 1562. Similar eyelets can be placed on the opposite side. These other eyelets 1566 can be used as a guide for insertion of the alternate supports 101 into the ground to form various shapes of rectangles. A rectangular blind configuration may be useful on steep terrain or in a configuration, for example, such as shown later in FIGS. 16U, 16W, 16X or 16AA. Once the rectangular footprint is laid out and the supports 100 are inserted into the ground, rectangular material, such as the tarp 1560, can be used as a roof; for example in the A-frame configuration of FIG. 16U or the cylindrical arch of FIG. 16W.

Figure 16V:
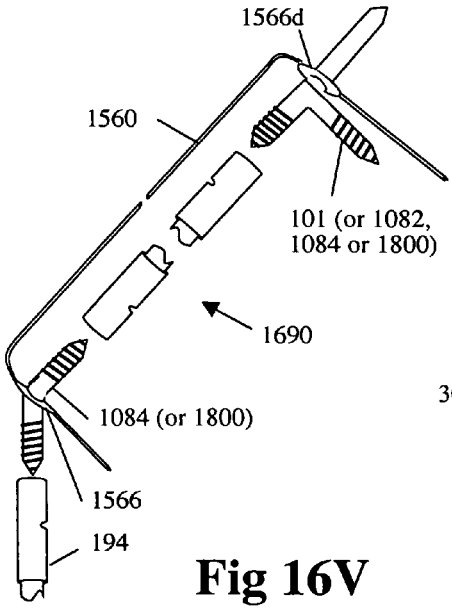
Figure 16W:
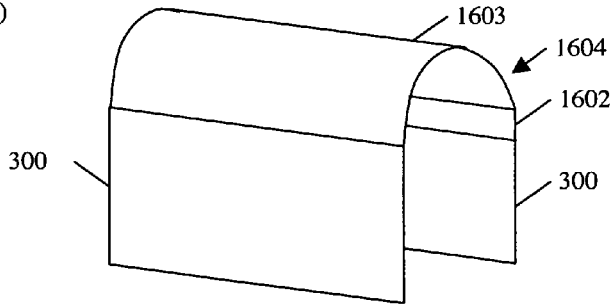

Note that the same novel tarp 1560 can be used as a roof in other configurations, for example, such as shown in FIG. 16U, 16W, 16AA, and 16II-KK.

Figure 15G:
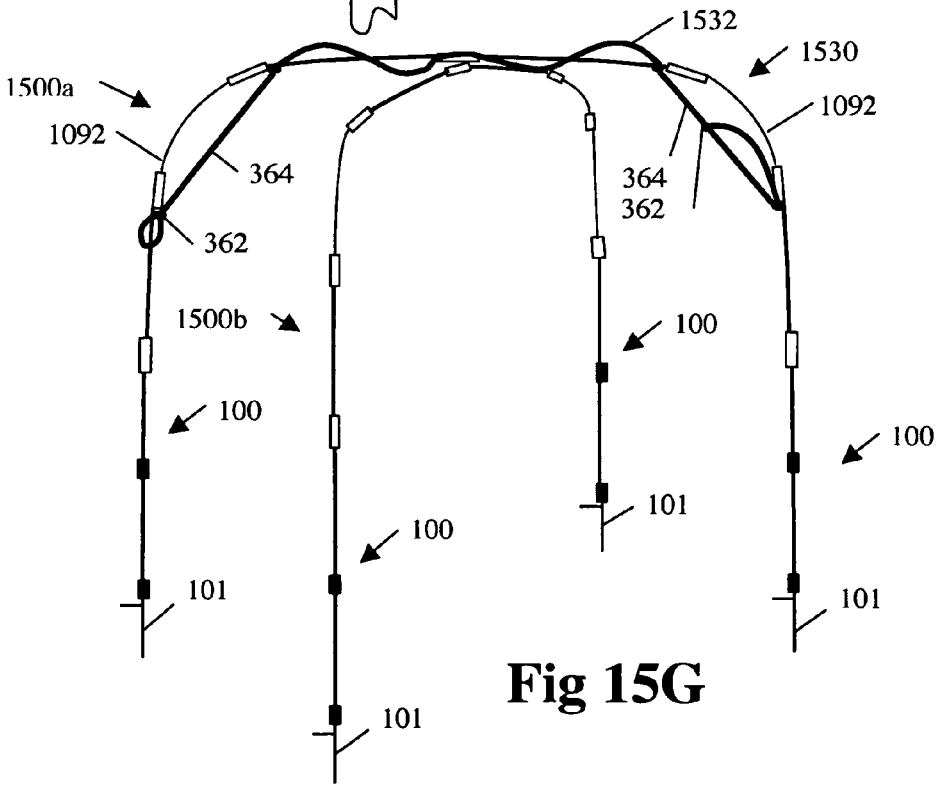

FIG. 15G shows the assembled shelter frame 1530 with a novel flattening feature. A shelter cord 1532 can be attached along each cover shaft 1500 to assert a force from the between points above and below each more flexible segment 1092. The shelter cord 1532 comprises a drawstring 364 with a drawstring clip 362. The drawstring 364 can be tightened to apply a force on the more flexible segment 1092 causing it to bend more and thus flatten the peak of the shelter frame 1530 even more. In addition to having the benefits as described above this has the additional benefit of tightening the skin of the shelter on the sides of the cover to reduce movement in the wind.

Figure 15H:
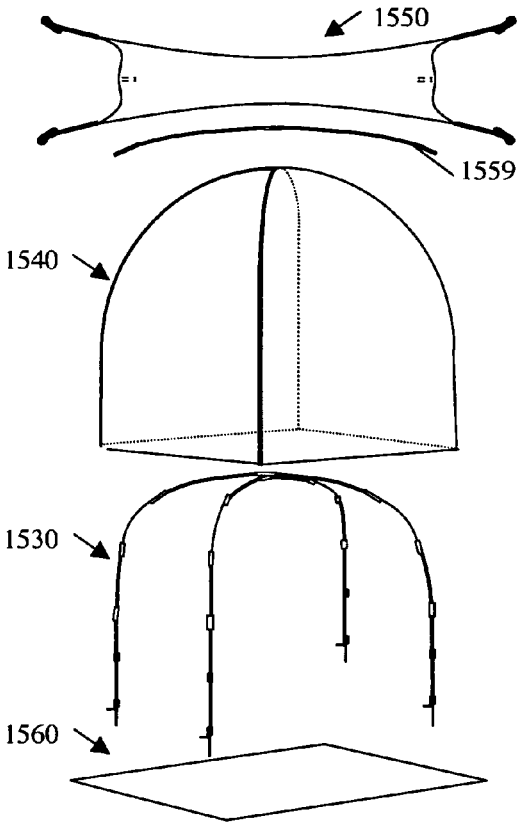

FIG. 15H shows each of the components that comprise one embodiment of a blind or shelter structure. This embodiment would be constructed as follows. The supports 100 would be inserted into the ground using the removable floor 1560 as a guide. Each cover shaft 1500 would be attached to the supports to form the shelter frame 1530. The cover 1540 would be pulled down over the shelter frame 1530. The rain fly 1550 would be attached, if desired. The rain fly shaft 1559 could be inserted under the rain fly 1550, if desired, to form a peak.

Figure 15I:
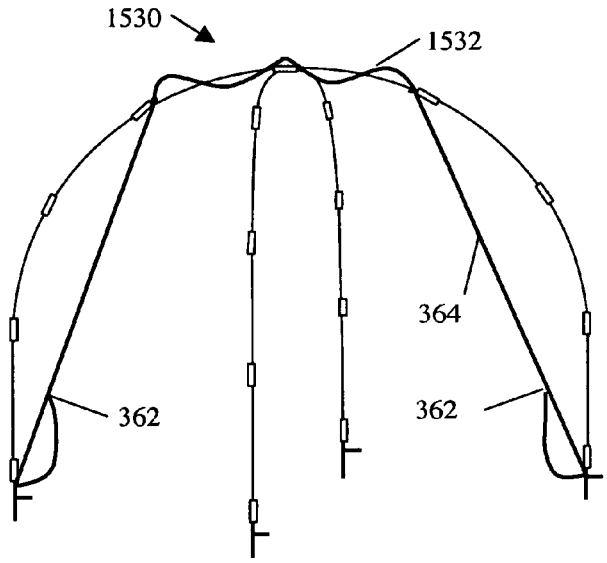

FIG. 15I shows the assembled shelter frame 1530 with a novel skin tightening feature. A plurality of shelter cords 1532 (only one shown) can be attached between the alternate support 101 and each cover shaft 1500 to assert a force on each side of the shelter. In this embodiment the more flexible segment 1092 is not necessary. This novel feature has the benefit of tightening the skin of the shelter on the sides of the cover to reduce movement and flutter.

Figure 15J:
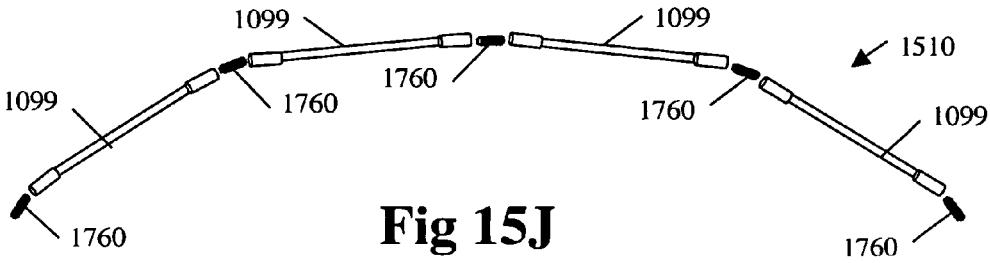

FIG. 15J shows an alternate cover shaft 1510 comprising a plurality of alternate shaft segments 1099 connected with inserting-to-inserting connectors 1760. FIG. 15J shows four shaft segments 1099 with five connectors 1760, resulting in an alternate cover shaft 1510 with inserting ends 1072 at each end.

FIG. 16A through FIG. 16F

FIG. 16A shows one side of the covered blind or shelter 1600 constructed with the modular components of the present invention. The operator 400 is shown behind a curtain 307*a* which forms a wall of the structure. The wall is stretched between two adjacent supports 100 that have been inserted into the ground using alternate supports 101. The shelter frame is further comprised of two cover shafts 1500 that cross at the peak of the structure. The cover 1540 provides a shadow that further conceals the operator, and provides protection from the sun and weather. In this embodiment the cover 1540 is rolled up, as a cover roll 1546, on at least one side (the side shown) leaving an opening 1602. A novel feature of this structure is that the opening is unobstructed along the entire length of the side. Further, the height of the opening 1602 can be adjusted or removed entirely by rolling up or down (or otherwise raising or lowering the side of the cover 1540).

FIG. 16B shows another embodiment of the covered blind or shelter 1600 with four walls formed by curtains 307*a* through 307*d*. In this embodiment, the cover 1540 has cover windows 1612 in each cover panel 1542. Each cover window 1612 may be closed by with a window fastener 1610 such as a zipper or a strip of hook and loop fastener material.

FIG. 16C shows an alternate cover 1630 having additional novel features of the present invention. One or more overhead windows 1632 can be placed near the top of each cover panel 1542. A cover window 1612 on at least one side can be extended to form a door 1634 by extending the window fastener to the bottom of the cover as a door fastener. A lower window 1638 can also be formed below the center window.

FIG. 16D shows a number of novel features of the modular system of the present inventions. Because the shelter frame is constructed with removable, interchangeable segments and because the frame is anchored to the ground, the blind or shelter structure can be positioned on the side of a steep hill or rough, uneven terrain or over obstacles such as boulders or tree trunks. This provides a number of advantages not available with conventional blinds or tents that are limited to being placed on flat, open spaces. If placed on even a slight grade conventional tents will be distorted and their skins will droop and flutter. The structures of the present invention can be located on steep terrain or among large obstacles that will enhance its concealment features and take it out of normal wildlife paths.

As shown in FIG. 16D the cover shafts 1500 can be connected directly to the alternate support 101 on the high side of the steep slope and the extra segments can be moved to the low side of the steep slope in an extended configuration 1640. The cover 1540 can be adjusted to meet the ground on all sides.

The embodiment of FIG. 16D also includes a shoot-through panel 1642 positioned within a closed cover window 1612. A shoot through panel is a lightweight see-through material that reflects enough light to maintain the camouflaged effect but that can be see through so that an projectile, such as a bullet or arrow, can pass through. Shoot-through panels have some disadvantage in that they are damaged by each shot and affect the flight of the projectile that limits the range and accuracy of the shot.

FIG. 16E shows the operator 400 inside the extended configuration 1640 anchored on a steep hillside. The center and lower windows 1612 and 1638 are unfastened and rolled up forming window rolls 1672. In this configuration the wildlife is likely to be seen down the slope along a line of sight or trajectory 1641. In the preferred embodiment the cover 1540 is made of a lightweight, waterproof material. In this configuration, a shoot through panel is not needed as enough light will come through the top of the lightweight camouflaged top. The ability to place the modular system on a steep hill and shoot down the slope through a lower window provides a benefit not available with conventional blinds or tents.

FIG. 16F shows another configuration where the cover 1540 is only long enough to cover the cover shafts (not the threaded segmented shafts 109), forming a cover cap 1631. The cover cap 1631 can be mounted directly to the ground using alternate supports 101. For situations where it is desired to stay low to the ground and shoot towards the sky, the operator can lie inside the cover cap 1631 and raise up through the overhead window 1632 when desired. The cover cap 1631 can also be used in a configuration like FIG. 16B except that the cover roll 1546 is eliminated. The cover cap 1631 can also be a component of configuration as will be shown later in FIGS. 16BB and 20A.

Battens (not shown) can be used to stiffen the windows (1612 and 1632) to reduce flutter in any of these embodiments.

FIG. 16G through FIG. 16L

FIG. 16G an alternate embodiment of the cover designed for use in a rain fly configuration 1650. In this embodiment the overhead window 1632 is a mesh that allows for airflow out the top of the shelter. The rain fly 1550 covers the overhead window 1632. Fly loops 1652 are attached to the cover seams 1544. Fly fasteners 1556 attach to the fly loops 1652 and the fly cords 1554 hold the fly 1550 taut. For better concealment the rain fly shaft 1559 can be omitted. For better airflow the rain fly shaft 1559 can be placed in the fly pockets 1558 to raise the fly 1550 to a peak.

FIG. 16H shows that the shape of the fly 1550 is designed to cover the ridges 1651 caused by the cover shafts 1500 (or 1510) so that the rain will not come into the overhead window 1632.

FIG. 16I shows a top view of a cover fragment showing two overhead windows 1632*a* and 1632*b*. Each overhead window 1632 is removably fastened with an overhead window fastener 1662 such as a zipper (as shown), strips of hook and loop fasteners, or other fasteners. If a single zipper is used for each overhead window 1632, preferably the zipper start 1664 and the zipper end 1666 are near the top of the cover. Another novel feature of removable overhead windows is that the rain fly 1550 and rain fly shaft 1559 can be installed and removed without leaving the shelter. While standing inside the shelter, the operator can open the overhead window and reach out to install or remove the fly fasteners 1556 in the fly loops 1652. For example the fly could be partially removed during a storm to get a particular shot without leaving the shelter or the concealment of the blind.

FIG. 16J illustrates the details of the rain fly 1550 attachment, namely the fly cord 1554 connected to the fly fastener 1556 which, in the embodiment shown hooks into the fly loop 1652. FIG. 16L shows the outside view of the fly loop 1652 attached to the cover seam 1544.

FIG. 16K top view of yet another embodiment of an alternate cover with windows 1661. This embodiment comprises four overhead windows 1632*a* through 1632*d*. To cover these windows the rain fly requires a square shape as shown by the alternate fly boundary 1551.

FIG. 16M through FIG. 16T, and FIG. 16SS

FIG. 16M shows an inside view of the cover 1540 with a cover shaft pocket 1654 which is a piece of material attached over the cover seam 1544 with a 3-sided attachment 1655. The cover shaft pocket 1654 receives one of the ends of the cover shaft 1500 (or 1510), namely 1520*a* or 1520*f*. While this embodiment is low cost and easy to make, there is concern that the force of the cover shaft against the cover 1540, its seam 1544, or the cover shaft pocket 1654 would wear a hole over time.

FIG. 16N shows a novel improvement over the simple pocket of FIG. 16M. In this embodiment, a grommetted pocket 1656 is attached when the cover seam 1544 is made at the pocket seam attachment 1553. The pocket grommet 1658 reinforces a hole in the pocket that allows an inserting end 1070 to be inserted and attached to the end of the cover shaft segment 1520. This is a novel way to secure the cover 1540 to the supports 100 and has the benefit of taking pressure off the end of the cover shaft segment 1520, reducing wear.

FIG. 16O shows another embodiment of a grommetted pocket 1656. In this embodiment, the pocket grommet 1658 is placed in the pocket material and the pocket is formed with a pocket seam 1657 on each side. The grommetted pocket 1656 is then attached to the cover 1540 with a pocket attachment 1659 on each side. This embodiment has the benefit of an extra layer of material between the end of the cover shaft segment 1520 and the cover 1540.

FIG. 16P shows yet another embodiment where the reinforcing grommet is formed from a channeled plug 1680. As shown in FIG. 16Q, the channel in the plug 1680 is sized to receive the straight connector 700 that is connected to the end of the shaft 106. In this embodiment, the plug 1680 is tubular and shaped like an inverted T. The connector 700 (e.g. the receiving end of the cover shaft segment 1520) stops when it hits the T, the plug 1680 has a plug hole 1682 which is smaller than the diameter of the connector 700 but large enough to receive the connector threads 1077 of the inserting end 1070 of the support 100. Referring back to FIG. 16P, the channeled plug 1680 comprises the grommet in the grommetted pocket 1656. The channel receives the end of the cover shaft segment, for example 1070, 1520*a* or 1520*f*, and holds it securely. The channeled plug 1680 protects the cover and pocket material by distributing the force over a broader area. Optionally, the channeled plug 1680 may be permanently held in the pocket by narrower than shown pocket attachment 1659 threads.

FIG. 16SS shows an alternate plug 1681, that may be made by drilling a channel and plug hole 1682 in an oval or eye-shaped cylinder. The alternate plug 1681 distributes the forces against the pocket 1656 more evenly and may be more easily inserted into the pocket 1656, than the embodiment of FIG. 16Q.

Figure 19D:
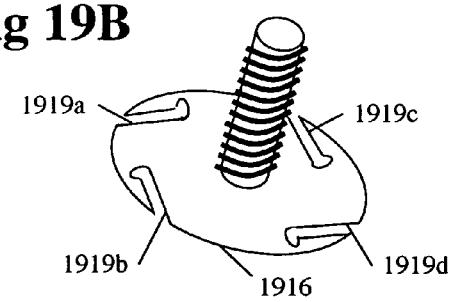
Figure 20A:
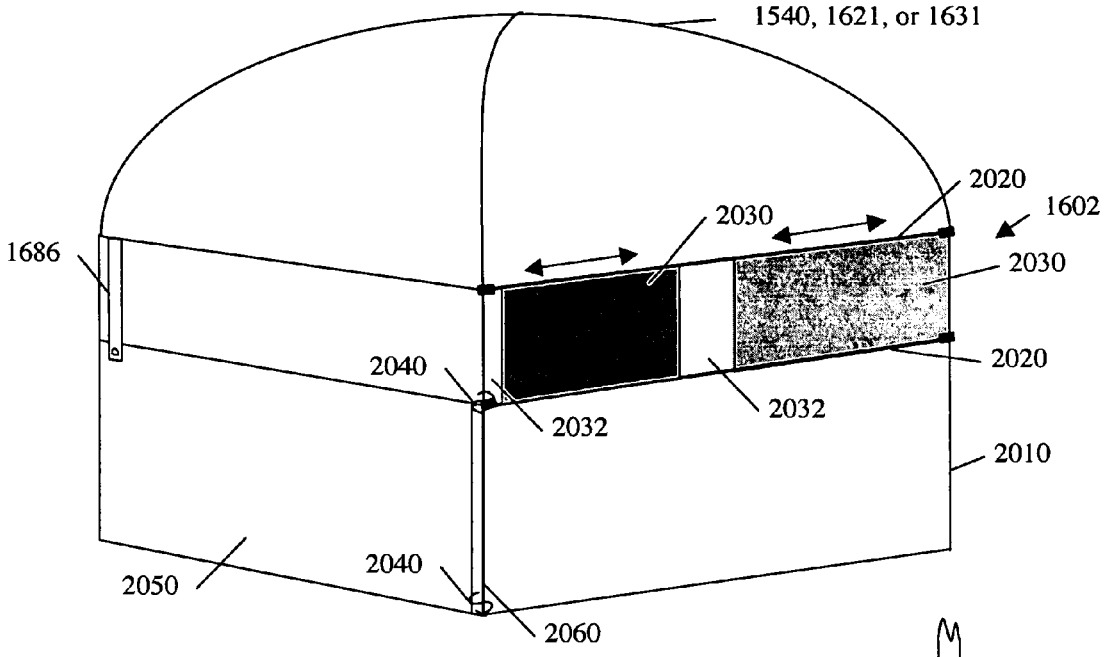

FIG. 16R shows an alternative method of securing the cover shafts 1500 (or 1510) to the cover. In this embodiment the cover shafts have inserting ends 1070 (as shown in FIG. 15J). Rather than having a cover shaft pocket 1654, a strap 1686 is attached to the cover 1540 along the seam 1544 with a strap attachment 1684. The strap has a plurality of reinforced strap holes 1685. As shown in FIG. 16S, the reinforced strap holes 1685 are formed by connecting an eyelet top 1687 and an eyelet bottom 1688 through a hole in the strap 1686. Good results have been obtained by also placing a rectangular piece of reinforcement 1689 above the strap in the eyelet. The reinforcement 1689 can be a piece of plastic that distributes the force to the strap and away from the hole in the strap. Once formed the reinforced strap holes 1685 can receive the connector threads 1077 of the inserting end 1070 of the cover shaft. Additional shaft segments 199 or 1099 can be added to the cover shaft (1500, 1510, 1691, or 1692) as desired and the longer shaft can be placed in lower reinforced strap holes 1685. This allows the cover 1540, pyramid cap 1621, or cover cap 1631 to be raised to any height above the supports 100 to leave an opening 1602 as shown in FIG. 16B, 19D and 20A. The strap 1686 can optionally have a skirt fastener 1683, such as a snap (shown) or a buckle, that can be used to support a skirt 2010 (as shown in FIG. 20A). The buckle would be a conventional plastic buckle as is used with flat webbing straps.

FIG. 16T illustrates the novel feature of the module systems of the present invention where the inserting end 1070 can pass through and hold material (such as tarp material 1568, grommetted pocket 1656, strap 1686, and so forth). After passing through the material inserting end 1070 can be secured to the receiving end 1072 to securely hold the material.

FIG. 16U through FIG. 16CC

FIG. 16U shows an A-frame configuration where a basic kit with four supports 100 and two curtains 300 (e.g. 307*a* and 307*b*) can be placed in parallel. When desired a roof frame can be constructed as detailed in FIG. 16V and covered with rectangular material, such as the tarp 1560. The opening 1602 can be formed by sliding the curtains 300 down the supports 100 or, alternatively, by raising the roof by inserting extra shaft segments 199 (or alternate shaft segments 1099). This configuration could be placed on a steep slope or on top of a narrow ridge of a hill.

FIG. 16V shows the details of how the modular components can be used to form the desired structure and secure the tarp 1560. The lower angle can be constructed using the obtuse threaded support 1084, an inserting-to-inserting connector 1760, or an adjustable bracket 1800 (discussed below). The upper angle can be formed with an alternate support 101, a 2-legged threaded support 1082, an obtuse threaded support 1084, or an adjustable bracket 1800. The grommets 1566 and side grommet 1566*d* can be used to attach the tarp 1560 securely to the structure. A shaft with two receiving ends, and a 2-receptor shaft 1690, can act as each rafter for the roof.

The legs of the A-frame configuration can be straight below the roof (as shown) or slanted to form a more traditional A-frame shape based on the angle of based on the lower angle. A combination may be used on a hillside where the supports supporting the downhill side can be straight while the supports on the uphill side enter the hill at a slant (not shown).

Figure 16X:
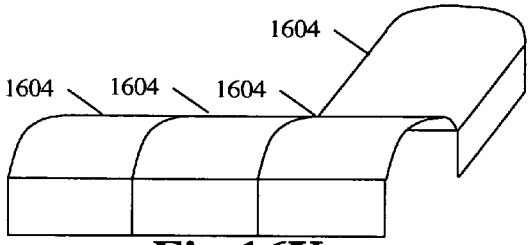
Figure 16Y:
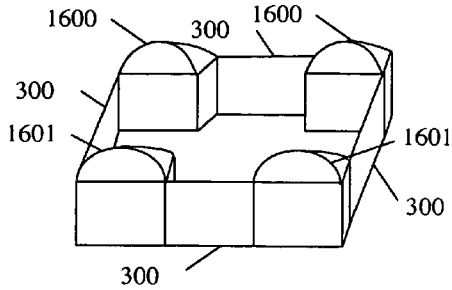
Figure 16Z:
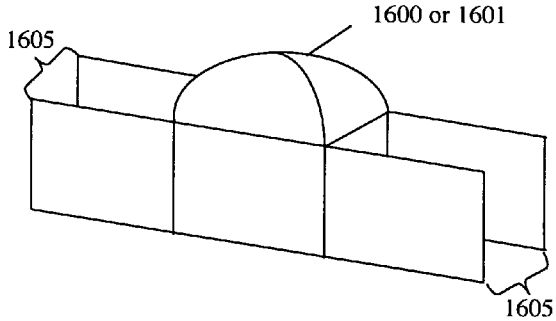
Figure 16A:
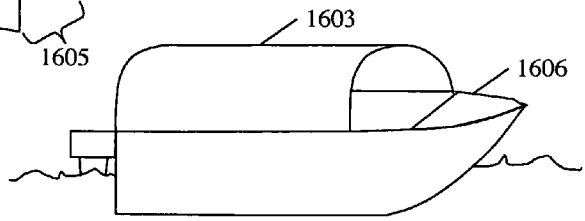
Figure 16B:
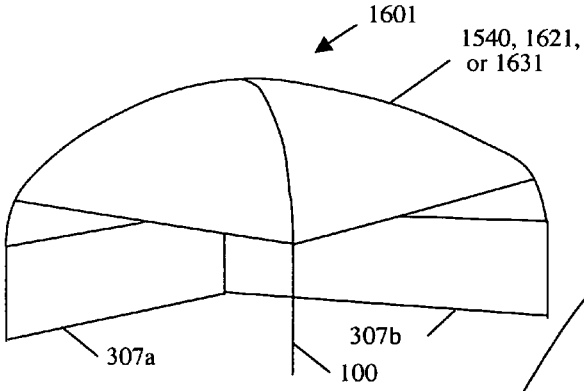
Figure 16C:
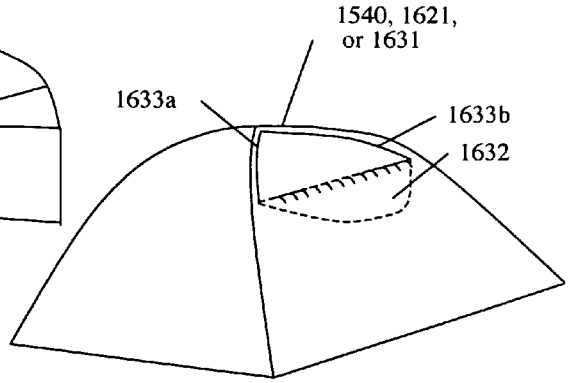
Figure 16D:
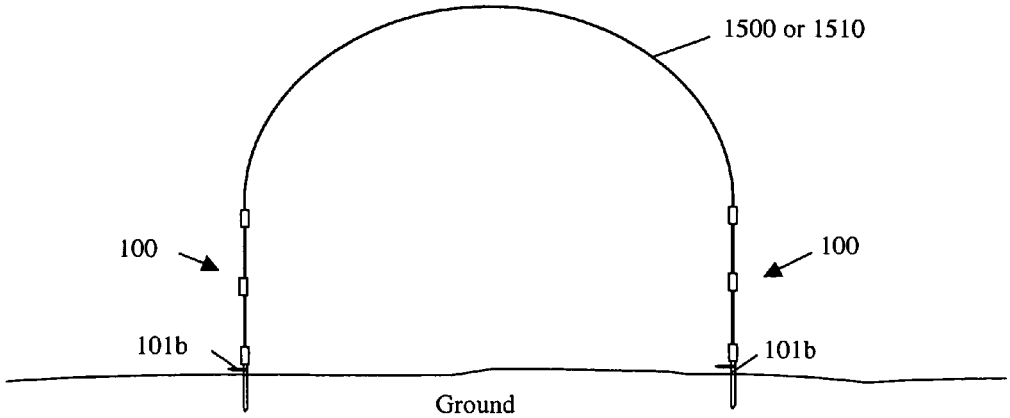
Figure 16E:
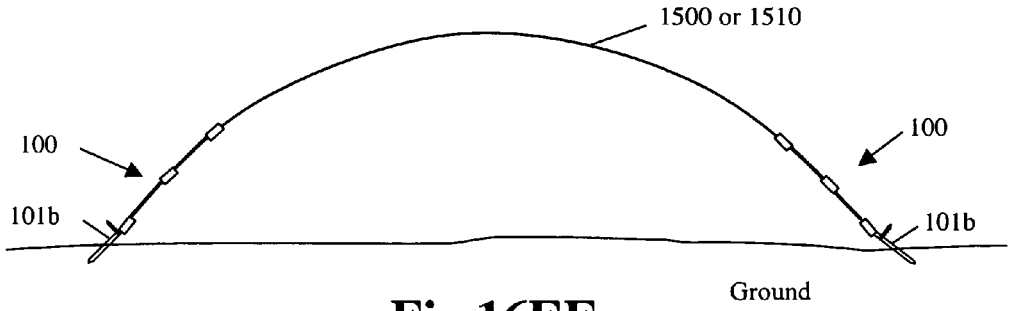
Figure 16S:
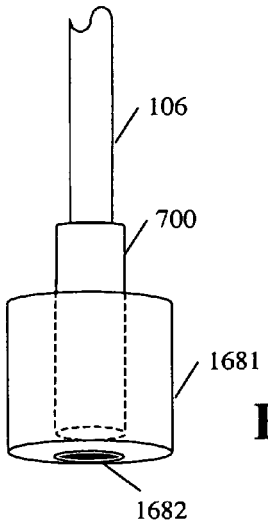
Figure 16F:
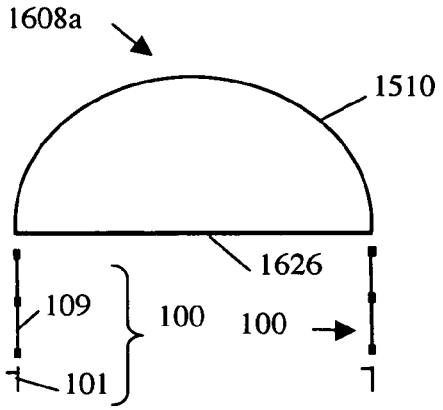
Figure 16G:
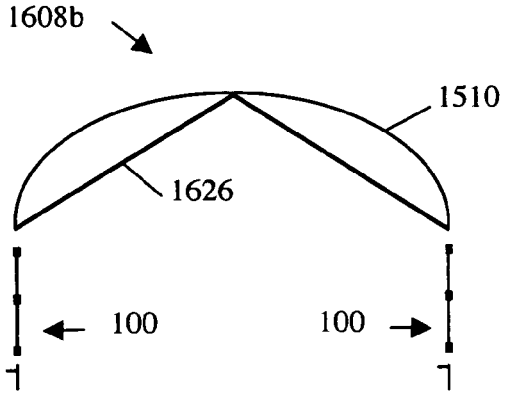
Figure 16H:
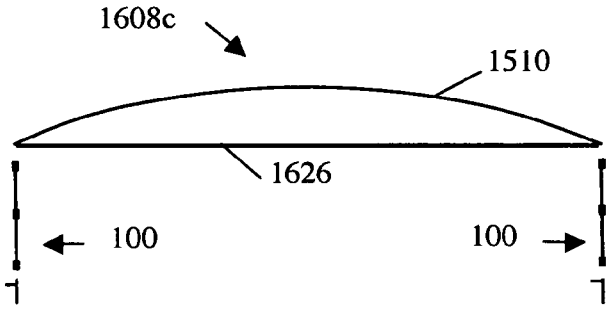
Figure 16I:
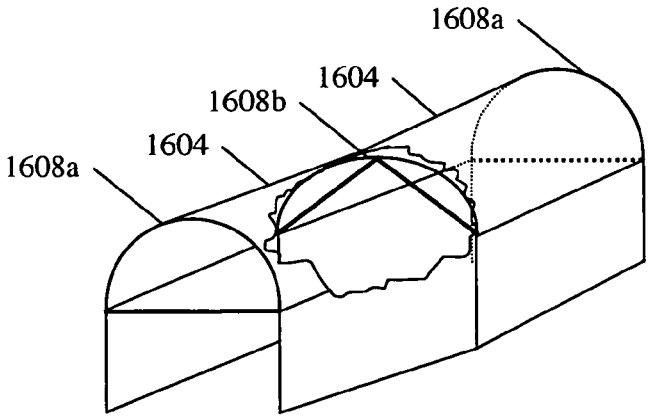
Figure 16J:
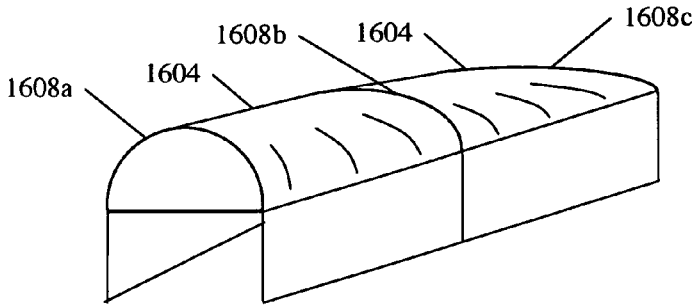
Figure 16K:
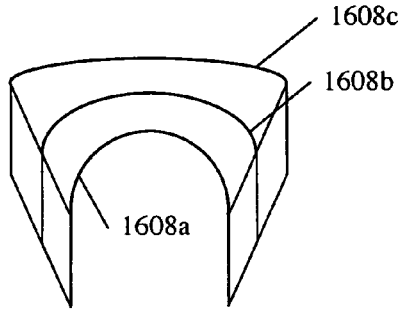
Figure 16L:
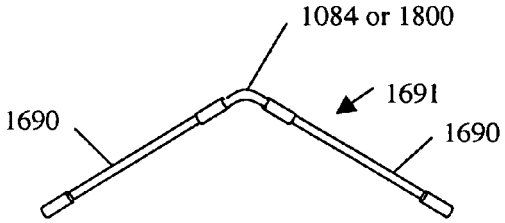
Figure 16M:
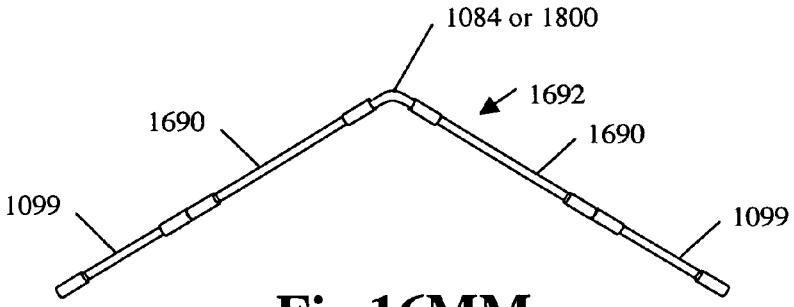
Figure 16N:
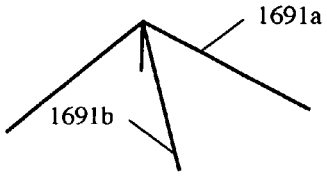
Figure 16O:
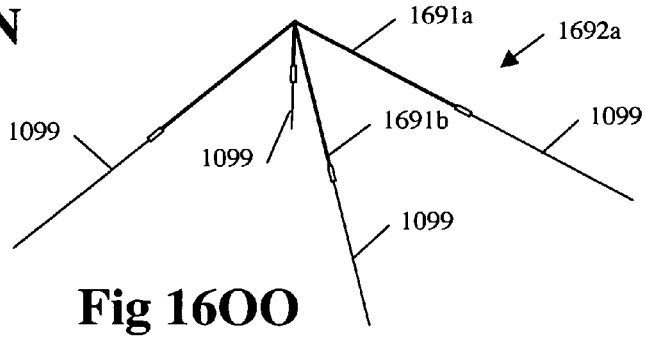
Figure 16P:
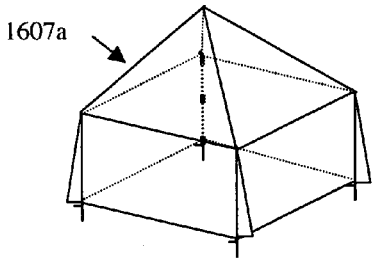
Figure 16Q:
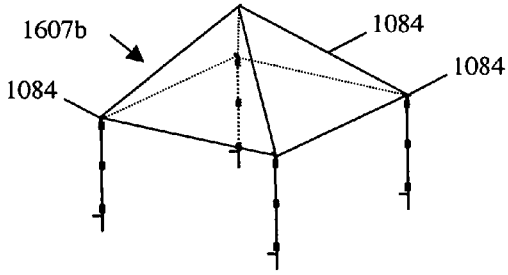
Figure 16R:
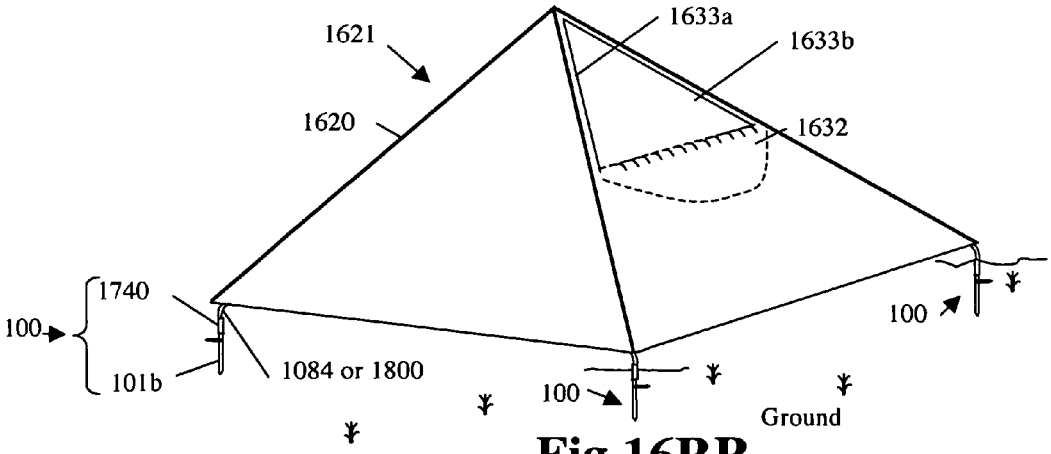

FIG. 16W shows an embodiment with a cylindrical arched roof 1603. The cover shafts 1500 or a plurality of shaft segments 199 (or alternate shaft segments 1099) can be use to form the arches. A rectangular piece of material, such as tarp 1560, can be placed over the arches to comprise the cylindrical arched roof 1603. A cylindrical arched roof unit 1604 comprises a basic module with two curtains 300 and four supports 100 combined with the cylindrical arched roof 1603 module. (See FIG. 16DD and 16EE for details of the arch configuration.) FIG. 16X shows that four units 1604, such as the one shown in FIG. 16W, can be interconnected to form a more complex blind or shelter. FIG. 16Y shows fort-like configuration comprising four advanced modules (1600 and 1601) such as those shown in 16B and 16BB with four single curtains 300 connected between each of the corner modules. Note that the configuration shown could be constructed with eight basic modules 1605 (for a total of sixteen curtains 300 and sixteen supports 100) and four cover caps 1631 (or pyramid caps 1621). FIG. 16Z shows one advanced module (1600 or 1601) such as the one shown in FIG. 16B (or 16BB with the two wall in parallel rather than a V-shape) with parallel extensions on two sides. The parallel extensions would require two basic modules 1605. FIG. 16AA shows an embodiment with cylindrical arch roof 1603 mounted on a vessel 1606. Other users may want to mount a modular blind on a vehicle such as a truck or ATV (not shown).

These various configurations illustrate the advantages that the modular system of the present invention has over convention blinds or tents. A group of operators can combine their individual modules to better accommodate the needs of a group. For example, a backpacking group could have each member carry one component of the system compared to having one member carry one heavy multi-person tent. Further, in recent years there has been growing popularity for television programs showing outdoor experts using various equipment and techniques among wildlife. In order to produce such shows, a blind is needed that can house a large group including the outdoor expert, the producer, the sound guy, and the cameraman. The modular system of the present invention meets the varied needs of such a production.

FIG. 16BB shows a 2-walled covered blind or shelter 1601 where only the two walls of a covered blind need to be present. In the configuration shown only the rear two walls are present. The cover 1540, pyramid cap 1621 (not shown), or cover cap 1631 provides additional concealment due to the shadow of the cover and the elimination of silhouettes on a slope. In this configuration, the operators can apply the "hide in front of" principle of the present invention to move freely in front of the rear, camouflaged walls. In this configuration the operator has an unobstructed 180 degree view and shooting area. No black holes are created by windows or doors.

FIG. 16CC shows a preferred alternative where the overhead window 1632 can be attached on two sides by a zipper, 1633*a* and 1633*b*, respectively which start near the peak of the cover 1540, pyramid cap 1621, or cover cap 1631. This embodiment eliminates the need for a rain fly 1550.

FIG. 16DD shows some of the detail of how the modular components can be used to form each arch, for example, of the cylindrical arched roof unit 1604. Each support 100 is attached to an end of a cover shaft 1500 or 1510 (segment details not shown) and then inserted in the ground such that it forms an arch. Multiple arches are placed in line to form the frame for the cylindrical unit or units 1604. The rectangular piece of material, such as tarp 1560 is placed over the top as a roof and curtains 300 (or a skirt 2010) can be attached to form walls, as shown, for example, in FIG. 16W, 16X, and 16Z.

FIG. 16DD through FIG. 16KK

FIGS. 16DD and 16EE show that, as discussed regarding FIG. 16U, the legs of the arched configuration can be straight below the roof (FIG. 16DD) or slanted (FIG. 16EE) to form a structure that is lower to the ground and cover more area. The taller position of FIG. 16DD allows for the operator 400 to stand up and easily move around. The lower position of FIG. 16EE allows for coverage of more people or equipment. Thus, the same configuration can be used, for example, for cooking or hunting while standing during the day and then repositioned for sleeping at night. Also, the lower position will be advantageous in locations, such as an open, grassy meadow, where the taller profile would be more noticed.

FIG. 16FF through 16HH shows the use of a bow cord 1626 to create a desired bow arch 1608 using a cover shaft 1500 or 1510. FIG. 16FF shows the use of a bow cord 1626 to form a substantially semi-circular bow arch 1608*a*. The bow cord 1626 works similar to a bowstring on a hunting bow, but asserting a bending force on the cover shaft to form an arch. In this embodiment, a straight connector, such as inserting-to-inserting connector 1760, can be used to attach the bow arch 1608*a* to the supports 100, each shown here as a threaded segmented shaft 109 and an alternate support 101.

The bow cord 1626 is attached to the shaft 1500 or 1510 and then tightened to form the desired arch. Next an appropriate connector is used to attach it to the supports which hold the arch off the ground. The use of the bow cord 1626 makes it easier to hold the arch in the desired position while attaching it to the supporting shafts. Its use also increases safety by reducing the risk that the arch of the bow arch 1608 will be released in an uncontrolled manner.

FIG. 16GG shows the use of a bow cord 1626 attached at the center top of the bow arch 1608*b*, which is useful for an arch that is not on the end of a structure. By raising the bow cord 1626, it is moved out of the way of the operator 400 on the inside arches in a configuration with three or more arches (see FIG. 16II through 16KK below).

FIG. 16GG also shows how the bow cord 1626 can be used to form a flatter arch. In this case the attachment to the supports is shown with an obtuse threaded support 1084 which better matches the natural angle.

FIG. 16HH shows the use of a bow cord 1626 to form a slightly bowed, almost flat bow arch 1608*c*. In this case the attachment to the supports is shown with an obtuse threaded support 1084, or an adjustable bracket 1800, which better matches the angle.

FIG. 16II shows a configuration with two cylindrical arched roof units 1604 sharing a middle bow arch. This configuration only needs three bow arches 1608. The end arches are semi-circular bow arches 1608*a* (with the cord straight from shaft end to shaft end) while the middle bow arch 1608*b* has the bow cord 1626 raised (as shown in the cutaway).

FIGS. 16JJ and 16KK show a perspective view and a downward looking end view, respectively, of a configuration with two cylindrical arched roof units 1604 where each arch is increasingly flatter. A flatter arch has a wider base so that the footprint of the overall structure is a trapezoid. This configuration illustrates the operation of the bow cord 1626 forming varying shapes with the same components. Even though the shape is different, and in this case continually varying, the same sized root material, for example, such as tarp 1650, can be used regardless of the flatness or degree of arch.

FIG. 16LL through FIG. 16RR

FIG. 16LL shows a pyramid cover shaft 1691. The pyramid cover shaft 1691 comprises two shafts connecedt with an angled connector. Each shaft could be a 2-receptor shaft 1690. The angled connector could be an obtuse threaded support 1084 or an adjustable bracket 1800.

FIG. 16MM shows an extended pyramid cover shaft 1692. The pyramid cover shaft 1692 comprises two shafts connected with an angled connector (i.e. 1691 as in FIG. 16LL). Each 2-receptor shaft 1690, extended with an alternate shaft segment 1099. Good results have been found using extension shafts that are half the length of the shafts 1690 in the non-extended configuration.

Alternatively the pyramid cover shafts (1691 or 1692) could be formed in a similar manner as the segmented cover shaft 1500 as shown in FIG. 15A where the cover shaft segments 1520 are connected with elastic cord 126 and the angled connector could be an angled connector 710 with receiving ends as shown in FIG. 7B, or reinforced angled connector 720 as shown in FIG. 7C.

FIG. 16NN shows two pyramid cover shafts 1691 used together to form a pyramid shape. In an alternate embodiment not shown, a 4 legged angled connector could be used instead of the two angled connectors, 1084, as shown in FIG. 16LL.

FIG. 16OO [letter oh-letter oh, not zero-zero] shows two extended pyramid cover shafts 1692 used together to form an extended pyramid.

FIGS. 16PP and 16QQ shows two configurations of a pyramid unit 1607. Each pyramid unit comprises four supports 100 inserted into the ground and supporting the pyramid cover shafts, 1691 or 1692, respectively. Each unit further comprises a pyramid cover 1620, which is placed over the pyramid cover shafts 1691 or 1692, respectively. The same sized pyramid cover 1620 can be used in both configurations. The first pyramid configuration 1607*a* is smaller and can be extended to form the larger configuration 1607*b*, simply by adding an alternate shaft segment 1099 to each end of each pyramid shaft 1691 (as shown in FIG. 16MM). Again this illustrates how the same components of the module system of the present invention can be used to form configurations with different footprints.

FIG. 16RR shows a pyramid cap 1621, which can be used instead of the arched cover cap 1631 in any configuration previously shown. Like the cover cap 1631 (shown in 16F and 16CC), the pyramid cap 1621 can be attached directly to the ground. For example the extended pyramid shafts 1692 can be attached to an angled connector, such as obtuse threaded support 1084 or adjustable bracket 1800, and connected with a receiving-to-receiving connector 1740 to the alternate support 101 (such as 101*b* as shown). The pyramid cover 1620 can be equipped with one or more overhead windows 1632, preferably attached with two zippers 1633*a* and 1633*b* as explained in reference to FIG. 16CC.

FIG. 17A through FIG. 17D

Figure 17A:
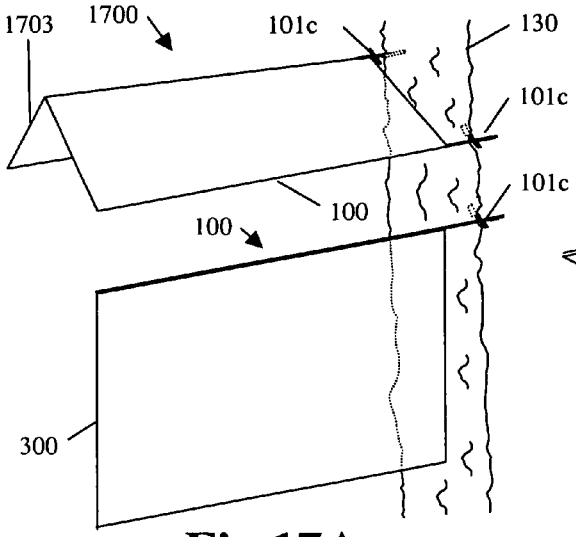

FIG. 17A shows a tree fly 1700 configuration that could be constructed with one basic module 1605 (for a total of two curtains 300 and four supports 100). One attaching pivoting support 100 is attached to the attaching structure 130 (shown as a tree) with an alternate support (shown as a 4-legged support 101*c*) and supports a vertically hanging curtain 300. The remaining three supports 100 are attached to the tree in three points forming an inverted V. The remaining curtain 300 of the basic module 1605 is passed over the top center support 100 and attached to the two lower side supports 100 forming a curtain fly 1703. Thus, the same basic module 1605 that can used to form the ground blind configuration of FIG. 14A or the base of a 2-walled covered blind as shown in FIG. 16BB, can be used to form a tree blind (such as shown in FIG. 4C) with a rain fly. The curtain fly provides protection from the elements and additional concealment due to the shadow of the fly and the elimination of silhouettes against the sky from directly below.

Figure 17B:
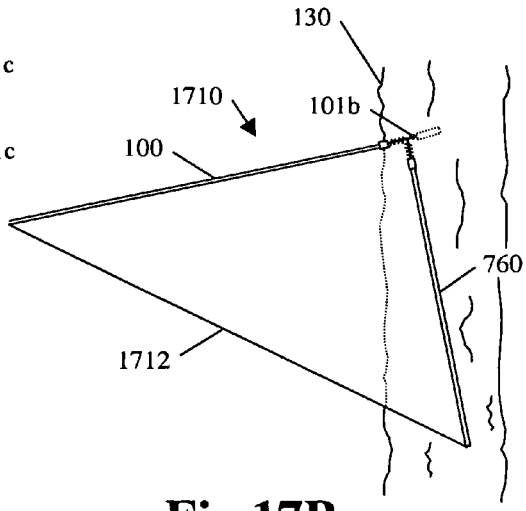
Figure 17C:
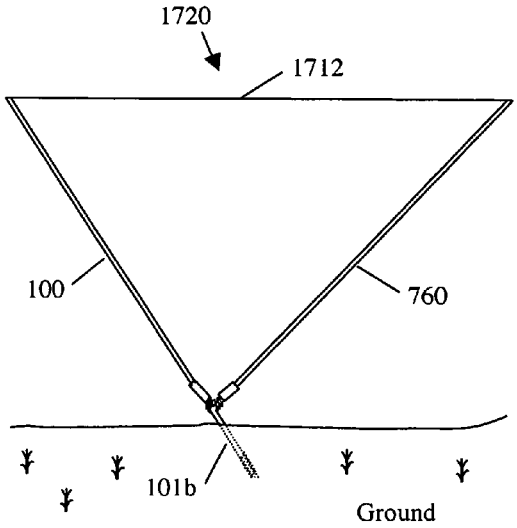

FIG. 17B shows an alternate tree fly 1710 comprising a support 100 (shown attached to a tree with a 3-legged alternate support 101*b*), a connected shaft 760 (such as a threaded segmented shaft 109), and alternate fly material 1712 with a triangle shape and hems on two sides. FIG. 17C shows the same module inserted into the ground as a ground shield 1720. Thus, the same module, that provides protection from the elements, additional concealment due to the shadow of the fly, and the elimination of silhouettes against the sky from directly below, can also be used as an easily moved ground shield. This shows yet another advantage of the modular system of the present invention.

Figure 17D:
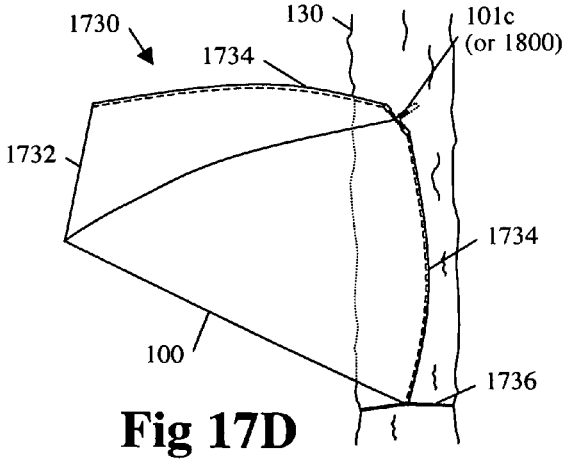

FIG. 17D shows an embodiment of a 3-shafted shield 1730 that can be made with the 4-legged threaded support 101*c* or the adjustable bracket 1800. The 3-shafted shield 1730 comprises a support 100 (shown attached to a tree with support 101*c*) with two side shafts 1734 and 3-shafted fly material 1732. The fly can be tied down to the tree on one or both sides to eliminate wind movement with at fly tiedown 1736. The same 3-shafted shield, shown as a tree blind fly, also can be used as a ground shield (similar to the embodiment shown in FIG. 17C, but with more coverage closer to the ground).

FIG. 17E through FIG. 17H

Figure 17E:
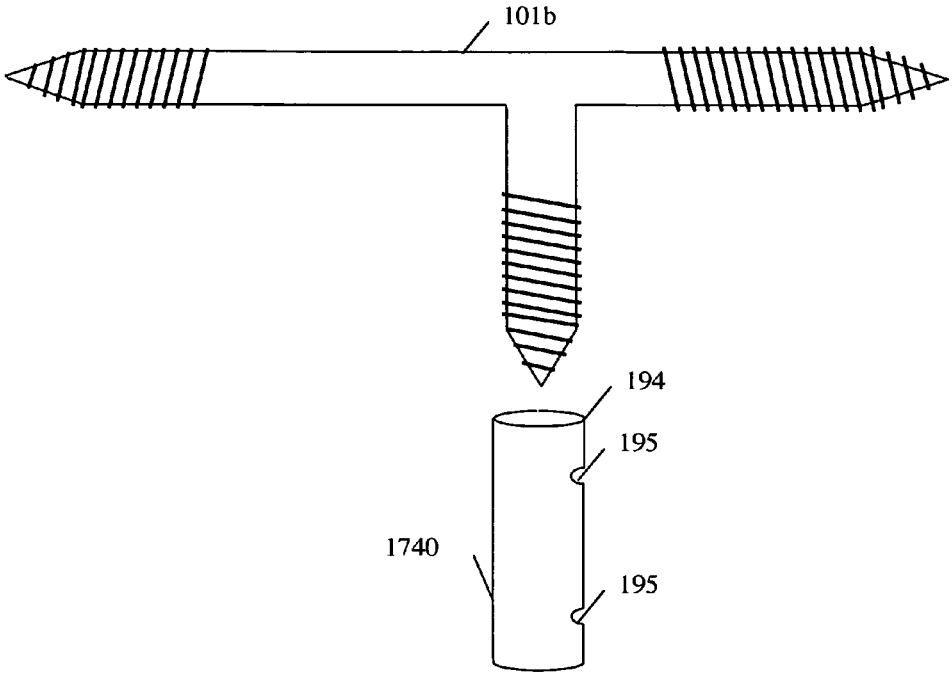

FIG. 17E shows a dimpled connector 194 with at least one dimple on each end forming a receiving-to-receiving connector 1740. The receiving-to-receiving connector 1740 can connect any two inserting ends 1070 whether they are on a support (100, 101, 101*b*, 101*c*, 102, 1082, 1084, 1760, etc.), connector (1086, etc.), bracket 1800, or shaft (109, 199, 1077, 1500/1510 with receiving ends, 1910, etc.).

The receiving-to-receiving connector 1740 has an additional novel use in the system in that it can be used to cover a threaded leg of a support, such as alternate support 101*b* (as shown), to make it easier to apply force to the support when attaching another leg to an attaching structure 130, such as a tree. Further, it can be installed over unused, exposed points and threads of a structure to shield the operator from injury.

Figure 17F:
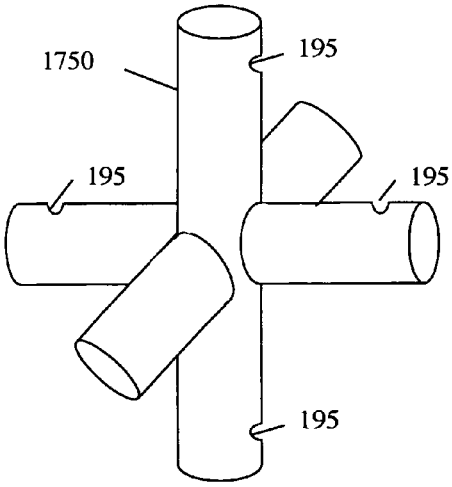

FIG. 17F shows a 6-way receiving connector 1750, that can be used to interconnect various modules such as the walls, curtains, and covers shown in FIGS. 16X through 16Z. The 6-way receiving connector 1750 could have one or more dimples in each of the size ends.

Figure 17G:
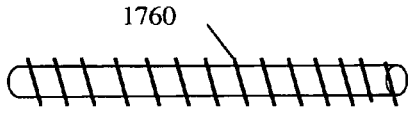

FIG. 17G shows a headless bolt 1088 with threads on each end forming an inserting-to-inserting connector 1760. Alternatively, the inserting-to-inserting connector 1760 could have locking slots 1094 instead of threads. The inserting-to-inserting connector 1760 can connect any two receiving ends 1072 whether they are on a connector (104, 194, 700, 710, 720, 760, 770, 1086, 1740, 1750 etc.), an attaching fastener 230, or shafts (109, 199, 1091, 1099, 1500/1510 with receiving ends, 1910, etc.)

Figure 17H:
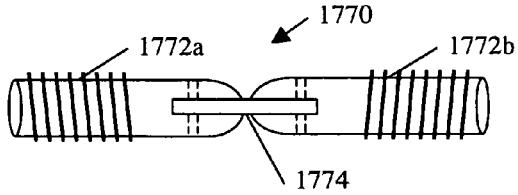

FIG. 17H shows an embodiment of a inserting-to-inserting connector 1760 with at least one hinge 1774 forming a hinged connector 1770 with two threaded legs 1772*a* and 1772*b*.

FIG. 18A through FIG. 18J

Figure 18A:
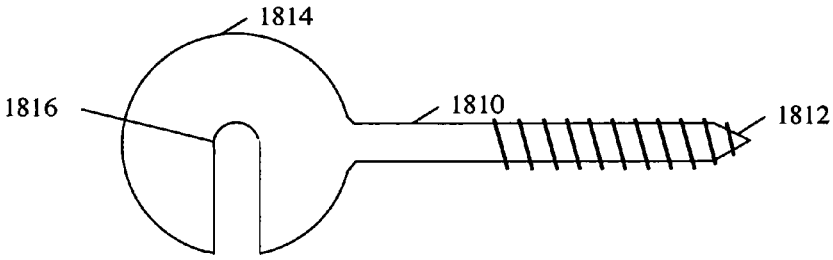
Figure 18B:
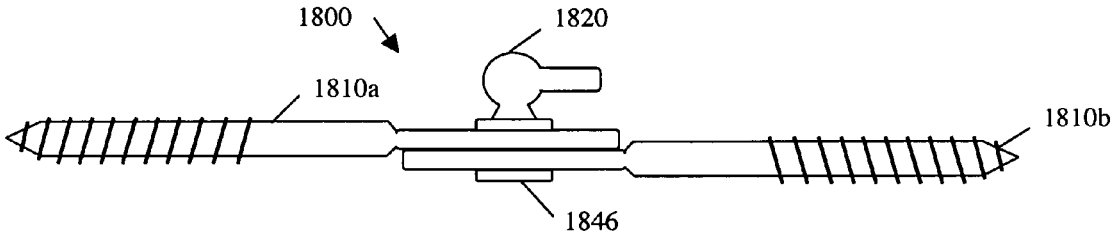
Figure 18C:
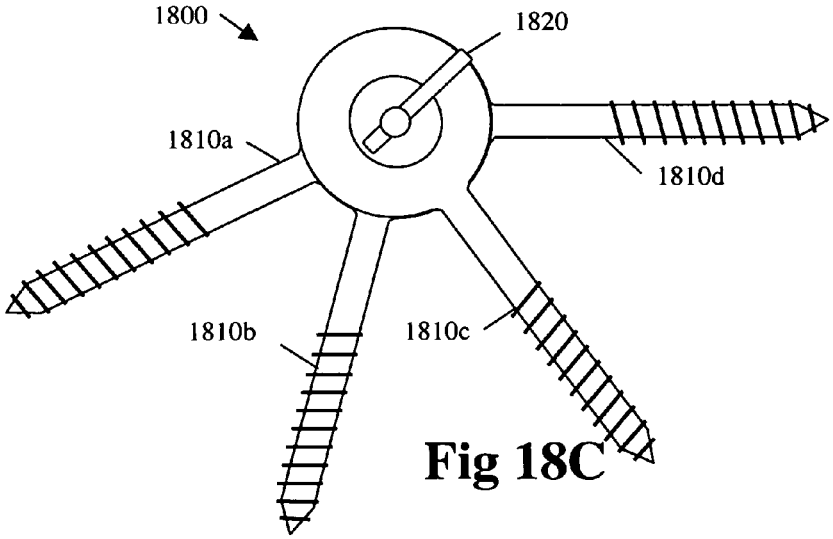

FIG. 18A shows a bracket leg 1810 that comprises embodiments of an adjustable bracket 1800 as shown in FIGS. 18B and 18C. The adjustable bracket 1800 has threads 1812 on each of a plurality of movable legs 1810. FIG. 18A shows the details of an embodiment of a bracket leg 1810. In addition to the bracket leg threads 1812, each bracket leg 1810 comprises a bracket leg base 1814 having a bracket leg opening 1816. The opening 1816 could be a slot as shown or just a circular hole.

As shown in FIG. 18A two bracket legs 1810*a* and 1810*b* can be movably attached using a quick release 1820 attachment. A number of quick release devices are known in the art. The embodiment is shown using a bicycle quick release. When the lever of the quick release 1820 is raised the pressure on the bases 1814 of the bracket legs 1810 is released so that the legs can be moved to the desired angles. When the lever is lowered, the quick release tightens and holds the legs 1810 in their current positions. FIG. 18B shows the adjustable bracket with more two more legs (1810*c* and 1810*d*) added. The slotted version shown in FIG. 18A can be slid in without removing the lower nut 1846 from the quick release 1820. In the version shown in FIGS. 18B and 18C without the slots, the lower nut 1846 must be removed to add additional legs 1810. After the desired number of legs is added, the position of the legs can be adjusted quickly and locked into place with the quick release 120.

One of the bracket legs 1810 could be longer relative to the other legs resulting in an adjustable embodiment of the 3-legged support 101*b* or the 4-legged support 101*c*.

Like the receiving-to-receiving connector 1760, the adjustable bracket 1800 can connect any number of receiving ends 1072. Not all of the legs 1810 need to be used.

Figure 18D:
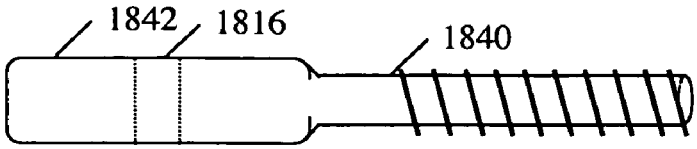
Figure 18E:
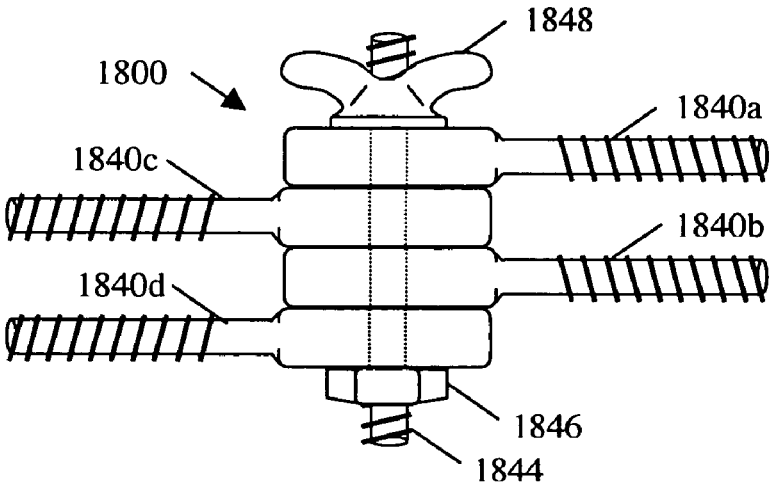
Figure 18F:
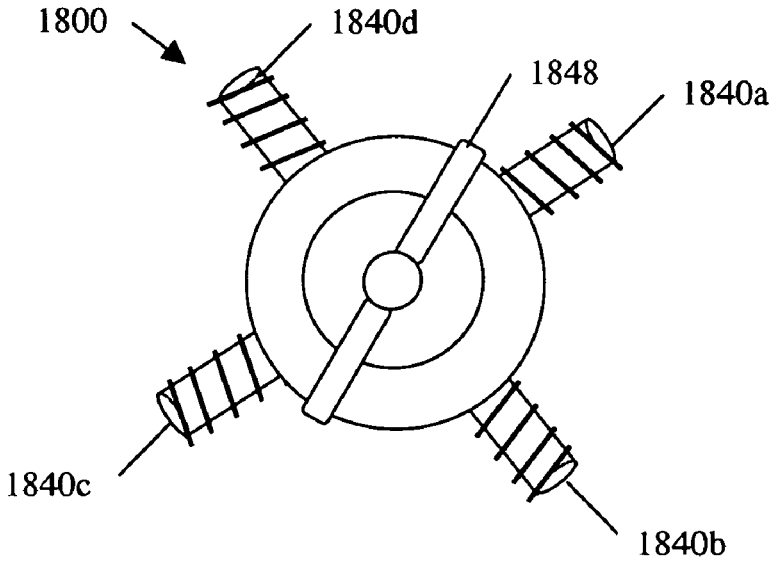

FIG. 18D shows a thicker based leg 1840 embodiment of bracket leg 1810 that has a thicker base 1842. FIG. 18E shows a side view with details of another embodiment of the adjustable bracket 1800. In this embodiment, instead of using a conventional quick release 1820 the bracket legs (1810 or 1840) are joined with an adjustable bracket bolt 1844, a lower nut 1846, and an upper nut 1848. The upper nut as shown is a wing nut to facilitate manual tightening. The lower nut 1846 could be permanently attached to the bolt 1844. The opening 1816 is shown as a circular hole. FIG. 18F shows a top view of the same adjustable bracket 1800 with four thicker based legs 1840. As shown in FIG. 18E, the thicker based legs 1840 have an advantage over the thinner based bracket legs 1810 shown in FIG. 18B in that the thicker based legs 1840 can pass by each other. This allows for the shafts that will be connected to the adjustable bracket 1800 to be freely positioned. This benefit will be explained in more detail in relation to FIG. 18I.

In contrast, the thinner based bracket legs 1810 as shown in FIG. 18B have the advantages of having less material, being lighter, and having the force of the other legs more directly transferred through the bracket assembly.

Figure 18G:
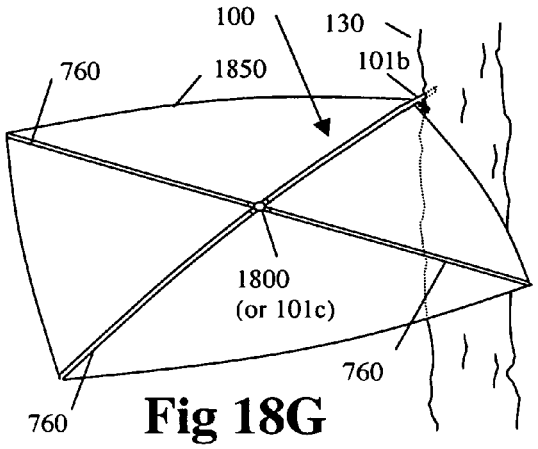

FIG. 18G shows a rectangular fly embodiment comprising a support 100 (shown attached to a tree with alternate support 101*b*) connected to the adjustable bracket 1800 with three connected shafts 760 forming a cross. A rectangular fly material 1850 is placed over each shaft creating a module that can be used as a rain fly, overhead blind (similar to FIG. 17B), or ground shield (similar to FIG. 17C). Note that in this configuration the adjustable bracket could be replaced a 4-legged support such as 101*c*.

Figure 18H:
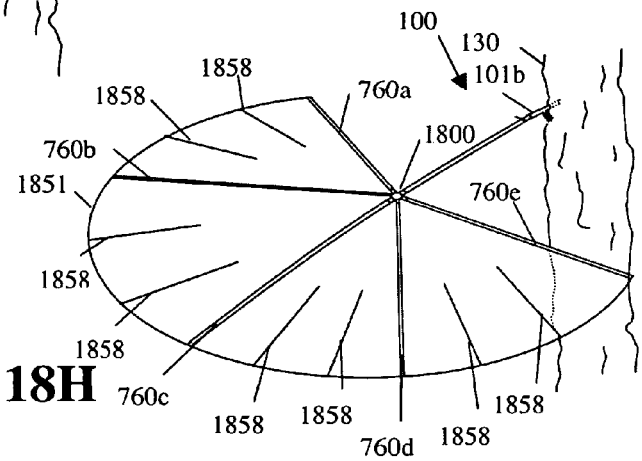

FIG. 18H shows a novel fan fly embodiment comprising a support 100 (shown attached to a tree with alternate support 101*b*) connected to the 6-legged adjustable bracket 1800 with five connected shafts 760 forming a fan. A fan fly material 1851 is placed over each shaft creating a module that can be used as a rain fly, overhead blind (similar to FIG. 17B), or ground shield (similar to FIG. 17C). The fan fly material 1851 may optionally be reinforced with battens 1858 to maintain the shape of the fan edges and to reduce wind movement. The battens 1858 could be a flat or round piece of wood, plastic, metal, or fiberglass.

Figure 18I:
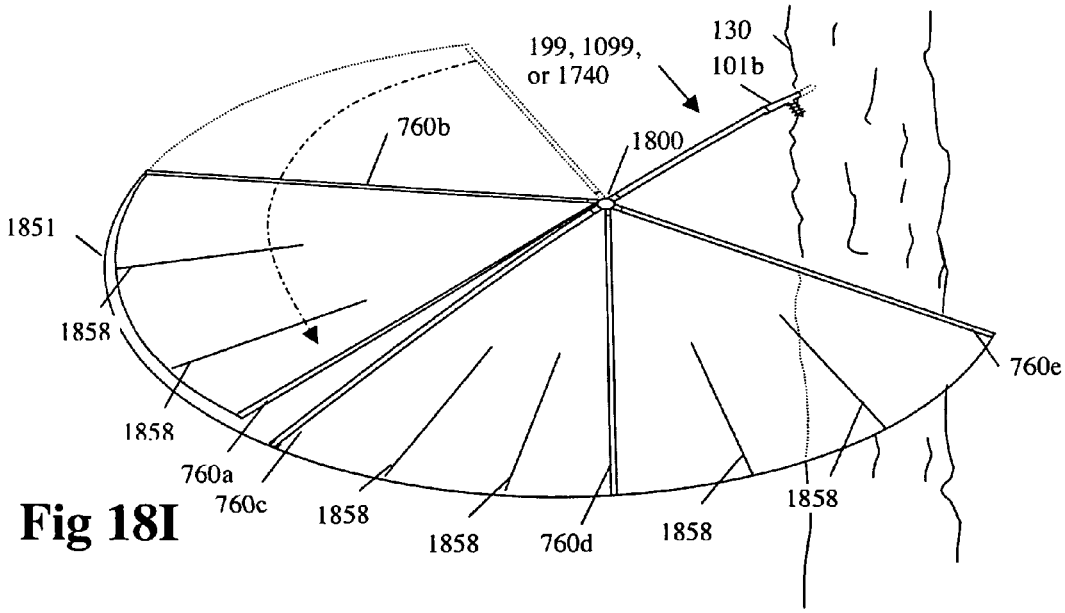

FIG. 18I shows a similar fan fly embodiment where the support 100 is replaced with an alternate support 101*b* and a shorter segment (such as shaft segment 199, alternate shaft segment 1099, or even a receiving-to-receiving connector 1740). The shorter shaft configuration brings the fan closer to the supporting structure 130 and brings the semi-circular configuration of the fan directly over the head of the operator, for example, in the tree blind.

FIG. 18I also illustrates the advantage of the thicker base legged embodiment of the adjustable bracket 1800 (see FIG. 18E) where a fully extended fan as shown in FIG. 18H can have an end shaft 760*a* rotated back past the next to the last shaft 760*b* as shown by the angular path arrow in FIG. 18I. This keeps the fan material 1851 taut even when the fan needs to be reduced in area, for example, to avoid a tree limb.

Figure 18J:
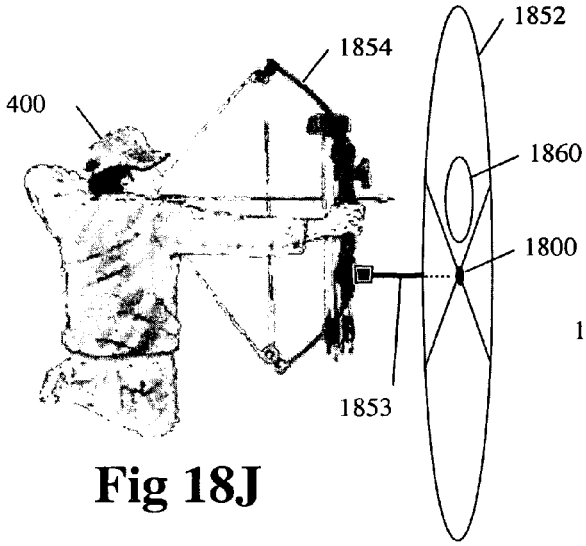

FIG. 18J shows a novel use for the fan fly similar to the embodiment of FIG. 18H. In this moving shield 1852 embodiment, the fan is attached to a piece of hand held equipment 1854 (such as a weapon (e.g. a bow as shown or a gun), camera, or other piece of equipment be carried by the operator 400). The moving shield 1852 is connected to the equipment 1854 with an equipment attachment 1853. The adjustable bracket bolt 1844 (see FIG. 18E) has threads that can attach to the receiving end 1072 of a shaft comprising the equipment attachment 1853. The moving shield 1852 may optionally have a shoot-through section 1860. The shoot-through section 1860 could be a shoot-through panel 1642 in a portion of the shield 1852 material (as shown) or could be a V-shaped opening between the two ends of the fan, i.e. 760*a* and 760*e* (as shown in FIG. 18H). This embodiment provides moving concealment to the operator 400 while the operator's hands are otherwise occupied with the operation of the equipment.

FIG. 19A through FIG. 19E

The opening 1602 shown in FIGS. 16A and 16B may be open on all sides of the blind. While this has the advantage of unobstructed viewing or shooting (compared to conventional blinds and tents), it has a disadvantage of allowing the wildlife to see movement through the opening 1602 and even worse a silhouette from the light coming in the rear opening 1602. The modular system of the present invention can overcome these problems using a module that allows one or more panels of materials to slide over portions of the opening 1602. In a preferred embodiment each opening could be covered with either a blackout panel 1920 or a see-through panel 1922. The blackout panel 1920 would block out light in opening 1602 in the rear. The see-through panel 1922 would allow light to pass through so that the operator can see out of the blind. The see-through panel 1922 could also be made of shoot-through material.

Figure 19A:
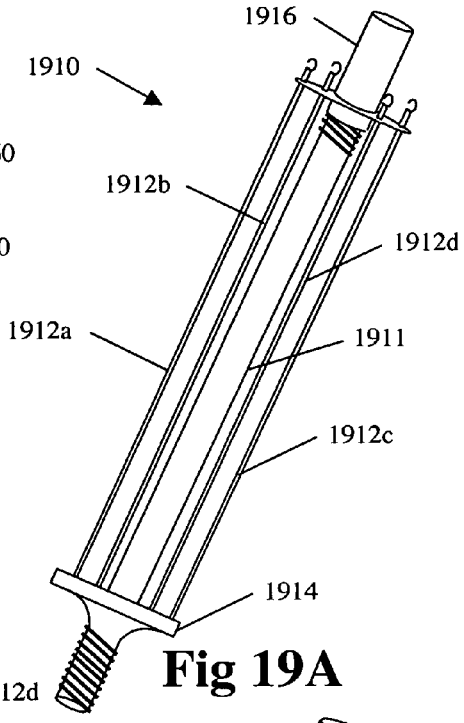
Figure 19B:
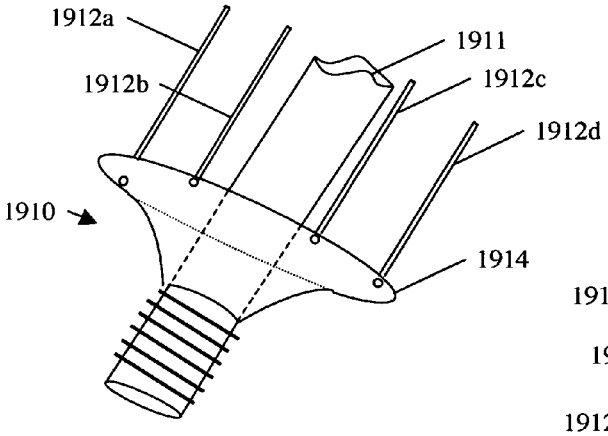
Figure 19C:
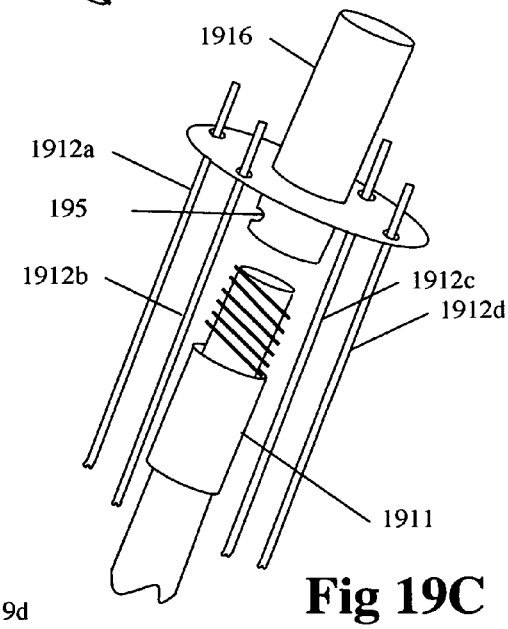
Figure 19E:
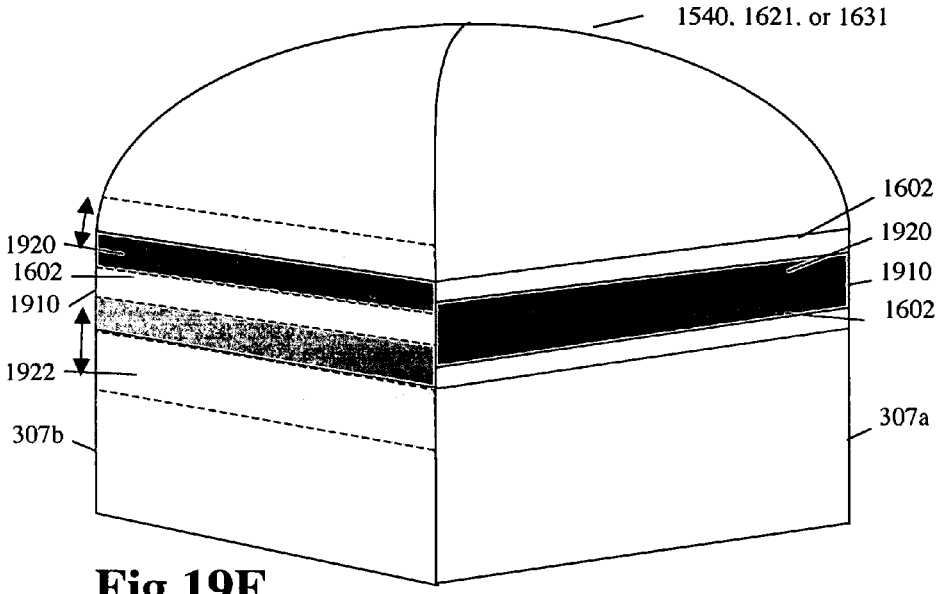

FIG. 19A shows an embodiment of a guyline module 1910. Guyline modules 1910 could be installed between the cover shafts 1500 (or 1510) and the shafts of each support 100 in a covered blind as shown in FIG. 19E. Preferrably the guyline module 1910 would have two guylines 1912 for each adjacent opening, one for the blackout panel 1920 and one for the see-through panel 1922. Each guyline 1912 could be a cord, chain, rod, or wire. Each vertical guyline module would preferably have four guylines (as shown in FIG. 19E) and each horizontal guyline module would preferably have two guylines (as shown in FIG. 20, 2020).

The guyline module 1910 shown in FIG. 19A comprises a guyline base 1914 and a guyline capital 1916 connected by an guyline shaft 1911. In this embodiment, the guylines 1912 are rigid and the guyline capital 1916 is threadedly removable. The guylines 1912 are permanently attached to the guyline base 1914 (as shown in detail in FIG. 19B). The guyline capital 1916 has a hole for receiving the free end of each guyline 1912 (as shown in FIG. 19C). To replace the panel (either 1920 or 1922) the guyline capital 1916 is removed, the panel hem is moved over the guyline, and the guyline capital 1916 is reattached holding the guyline and panel in place. In an alternate embodiment, the guyline shaft 1911 could be eliminated because the rigid guylines would provide enough structural strength for the guyline module 1910.

FIG. 19D shows details of a fixed capital 1918 that is permanently attached to the guyline module 1910. In this embodiment the free end of the guyline shafts or cords 1912 are removably attached in guyline slots 1919. The end of a guyline cord could be a knot. The end of a guyline shaft could have a groove which mates with the guyline slot 1919.

FIG. 19E shows a covered blind with vertical guyline modules. The panels 1920 and 1922 can slide past each other because each is attached on each side by a different guyline 1912. The operator can position the panels to cover the opening 1602 as shown on the right (with blackout panel 1920) or with a portion of the opening 1602 covered by one panel (e.g. the blackout panel 1920 on the left) and with another portion covered by the other panel (e.g. the see-through panel 1922 on the left). Note that the panels can slide behind the cover 1540 (or 1621 or 1631) above or the curtain 307 (or skirt 2010, not shown) below because of the novel features of the modular systems (such as those shown in FIGS. 14D, 14G, and 16N through 16T).

Figure 19F:
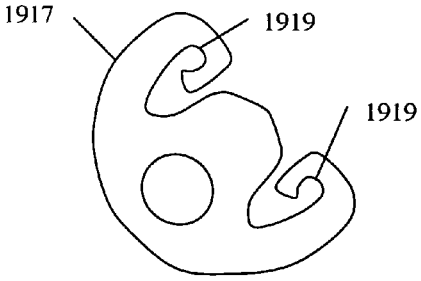
Figure 19G:
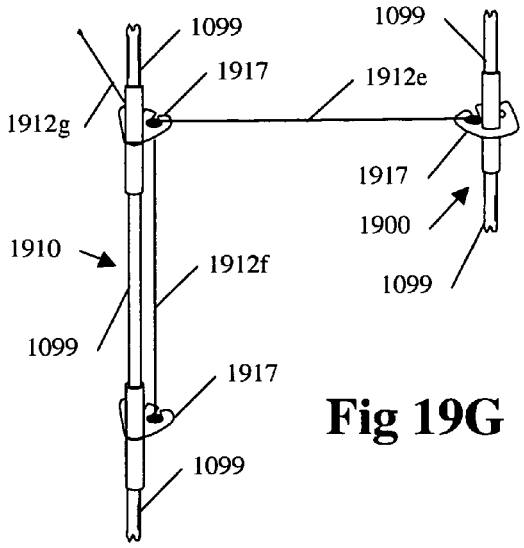
Figure 19H:
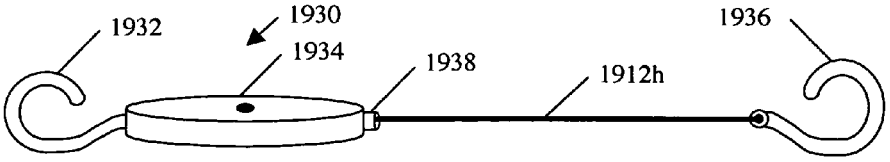

FIG. 19F through 19H

FIG. 19D shows details of a guyline washer 1917 can be used as both a guyline base 1914 and a guyline capital 1916 with an alternate shaft segment 1099 to form a guyline module 1910. The guyline washer 1917 can be secured between any two shaft segments by inserting the inserting end 1070 on one segment through the washer hole 1915 and into the receiving end 1072 of the other segment (similar to the the way the grommets are held as shown in FIG. 1HH and FIG. 1QQ. In this embodiment, the guylines 1912 are removably attached in guyline slots 1919. The end of a guyline cord could be a knot, or loop, passed through the guline slots 1919. The end of a guyline shaft could have a groove which mates with the guyline slot 1919. In this embodiment of the guyline washer, the washer hole 1915 and guyline slots 1919 are positioned so that it can be used in a corners of a configuration such as shown in FIG. 19E or FIG. 20A. As shown in FIG. 19G two guyline washers 1917 can be placed on adjacent corner shafts to support horizontal guylines (for example, 1912*e*) or on each corner shaft to support vertical guylines (for example, 1912*f*). The other guyline slot 1919 on the same corner guyline washer 1917 can be used to attach another horizontal guyline 1912*g* to a third corner.

The guyline washer 1917 is designed so that material of a cover (e.g. 1540) can slide over the outside corner without catching.

In an alternative embodiment not shown, the guy line washer could simply have two or more holes, instead of guyline slots 1919, to which the guyline cords 1912 are tied. A guyline 1912 could alternatively be comprised of a drawstring 364 with a drawstring clip 362 for tightening the guyline.

FIG. 19H shows a retractable guyline 1930, comprising a guyline cord 1912*h* that can be taken up on a guyline coil 1934 on one end and hooked with a guyline hook 1936 on the other end to a shaft 106 or guyline slot 1919. The guyline coil 1934 also has a coil attachment 1932 (shown as a hook) which can be used to connect to another shaft 106. The guyline coil 1934 can be equipped with a guyline lock 1938 for locking the guyline cord 1912*h* at a predetermined length to maintain a taut guyline 1912 for the panels (1920, 1922 or 2030) to pass along. The guyline lock 1938 helps prevent the guyline 1912*h* from sagging under the weight of the panels (1920, 1922 or 2030). This represents a novel use of coil and lock devices known in other fields.

FIG. 20A through 20D

FIG. 20A shows yet another embodiment of a covered shelter. FIG. 20A illustrates the novel use of the horizontal guylines 2020 and a single piece skirt 2010. This embodiment comprises a shelter frame 1530 with a cover 1540 (or pyramid cap 1621 or cover cap 1631). The skirt 2010 is a single piece of material that covers the base of the shelter on a plurality of sides. A skirt door 2050 is formed by having at least one end of the skirt 2010 removably attached when closed.

Figure 20B:
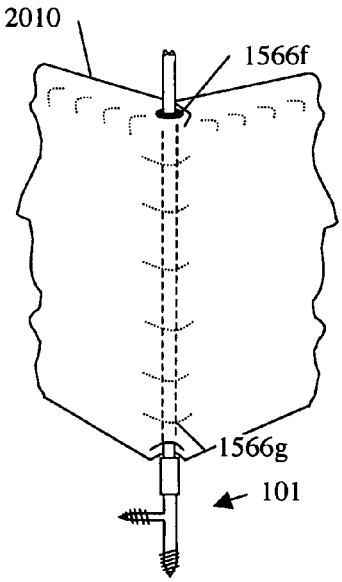

FIG. 20B shows the details of the skirt attachment around the supports not used as the door 2050. At the top, one or more eyelets in the skirt 2010 material are folded inward to form a corner that is held by the shaft connection (as shown in FIGS. 1HH, 1QQ, and 16T). Alternatively, the skirt may be held up by the skirt fastener 1683 on each strap 1686.

Figure 20C:
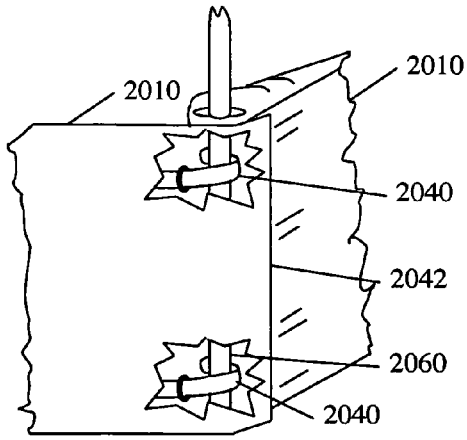
Figure 20D:
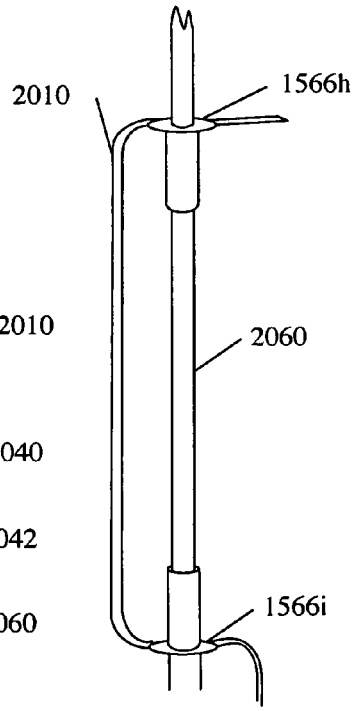

FIG. 20C shows the details of the skirt door 2050 attachment. The door shaft 2060 passes through and outside the skirt 2010 at the top and back in at the bottom (see detail in FIG. 20D, top grommet 1566*h* and bottom grommet 1566*i*). Inside the skirt door 2050 are one or more skirt door hooks 2040 that hook over the door shaft 2060. The material of the skirt door 2050 extends a short distance beyond the skirt door hook(s) 2040 so that a skirt door flap 2042 covers the door attachment.

Referring back to FIG. 20A, horizontal guylines 2020 can support horizontally sliding panels 2030 (panels 1920 or 1922 configured for horizontal sliding). A novel feature of the modular system of the present invention is that the operator can position the horizontally sliding panels 2030 to form one or more small vertical slits 2032. The advantage of the vertical slit 2032 over horizontal slits formed in conventional blinds is that often the operator's eye is a few inches higher than shooting trajectory. Having a vertical slit 2032 slidably formed between the movable panels 2030 allows the operator to see and shoot with minimal exposure. This feature can eliminate the need for shoot-through material that is damaged by each shot and needs to be replaced to maintained adequate concealment. Thus, both horizonally sliding panels 2030 shown covering the opening 1602 in FIG. 20A could be blackout panels 1920 and one guyline 1912 would be needed at the top and bottom, respectively, of each opening 1602. For example, see top guyline 1912*e* in FIG. 19G.

FIG. 21A through 21H

Figure 21A:
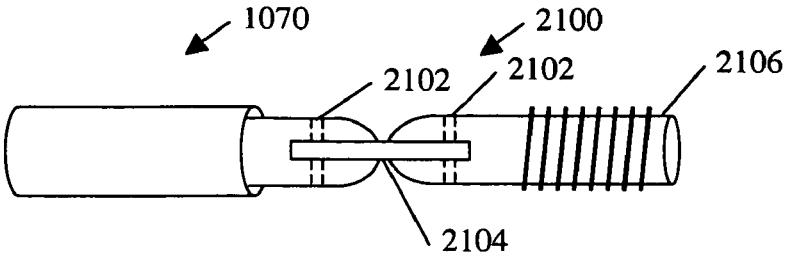
Figure 21B:
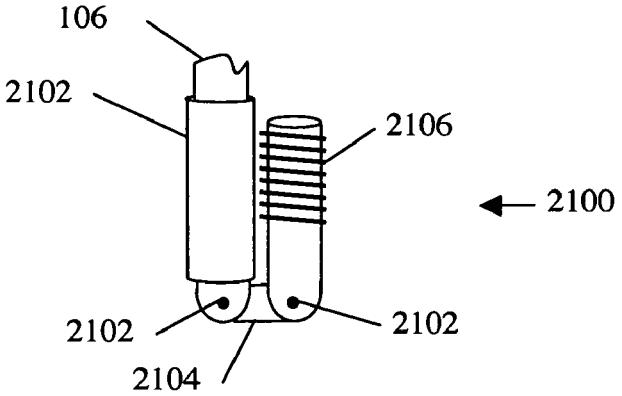

FIG. 21A shows an embodiment of a hinged inserting end 2100. In this example, the two hinge legs, threaded hinge leg 2106 and second hinge leg 2108, are both mortised for receiving a two-sided tenon 2104. Both hinged legs are joined by hinge pins 2102 which pass through the mortise and tenon of each leg to form a double hinge will allow the two legs to be swung 360 degrees and allow the two arms to be positioned parallel to each other, as shown in FIG. 21B. The second hinge leg is shown attached to a shaft forming an inserted end 1070 of a shaft or shaft segment; this attachment could be permanent (for example, glued) or removable (like the inserting-to-inserted connectors 1760 in FIG. 100)

Figure 21C:
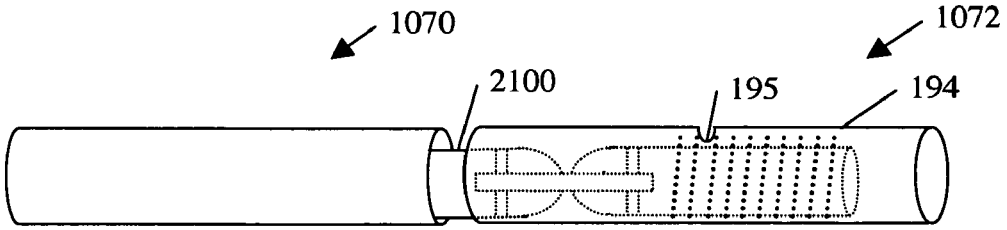

FIG. 21C shows the hinged inserting end 2100 (as shown in FIGS. 21A and 21B) inserted into a dimpled connector 194 (on the receiving end 1072 of a shaft or shaft segment). When the threaded hinge leg 2106 is threaded into the dimpled the connector 194 by screwing it relative to the dimple 195, the dimpled connector 194 will pass over and lock one or both hinges so that they cannot move within the hollow cylinder of the connector. The threaded hinge leg 2106 can be backed out of the connector 194 to a point the hinge is again free to move but the connection between the threads of the threaded hinge leg 2106 are still engaged with the dimple 195. This illustrates a novel feature of the system of the present invention. Shaft segments can be connected together using structure shown in FIG. 21C to form a desired configuration and then by backing out the threads part way, the configuration can be broken down at the hinges while still maintaining the configuration of interconnect segments. This is useful what a desired configuration of shafts or modules are combined to form a structure and various curtains (e.g. 300, 304, 306, 307, etc.), covers (e.g. 1540, 1560, 1620, etc.) or skirts (e.g. 2010) are interconnected and the operator wants to break it down for the evening, or to move it to a new location, and then quickly put it up again.

Figure 21D:
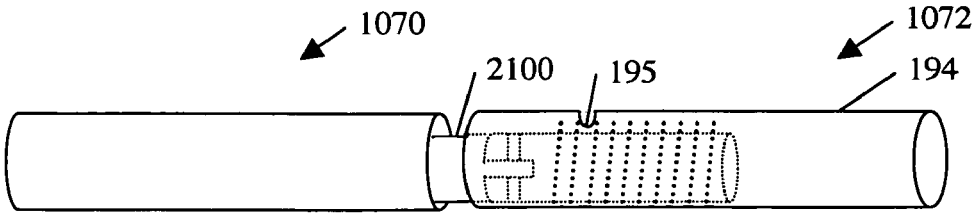
Figure 21E:
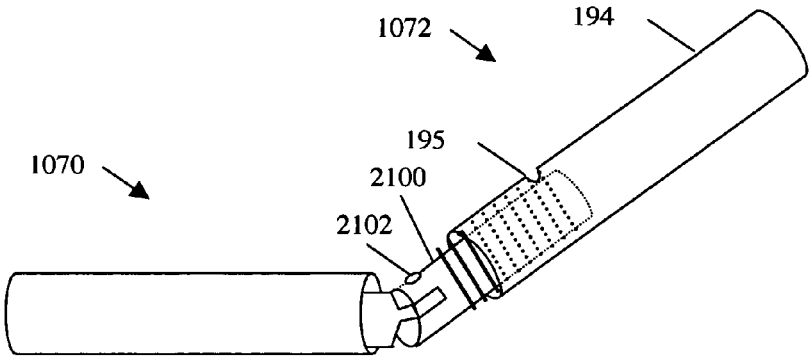

FIG. 21D shows another embodiment of the hinged inserting end 2100 having only a single hinge. The operation of this embodiment is similar to the embodiment of FIG. 21E where the hinge locked in place when it is fully threaded into the dimpled connector 194. With only one hinge, the hinged inserting end 2100 will have a more limited range of motion as illustrated in FIG. 21E.

Figure 21F:
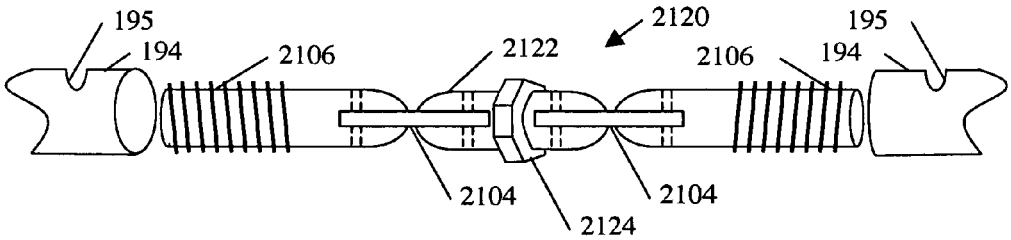

FIG. 21F shows a doubly hinged inserting connector 2120, having two threaded hinged legs 2106 each connected to a middle hinge leg with one of two opposite tenons 2104. The middle hinge leg may optionally have a raised ring 2124. The raise ring could be smoothly cylindrical or could be facetted, such as a hex nut. Each threaded hinge leg can be attached to a dimpled connector 194 in a manner similar to the one shown in FIG. 21C. When the threads are fully tightened, the dimpled connector will meet with the edge of the raised ring 2124 and make a tight threaded connection. When both sides are fully tightened the segmented shaft (e.g. 107, 109, 1099, 1500, 1510, 1691, 1692) will be held straight. One or both sides could be backed out to allow break down of the segmented shaft while still maintaining a threaded connection that will maintain the configuration.

Figure 21G:
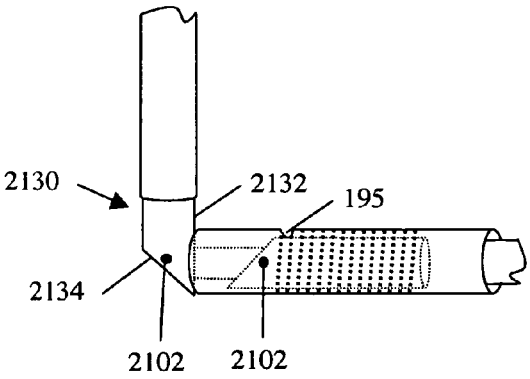
Figure 21H:
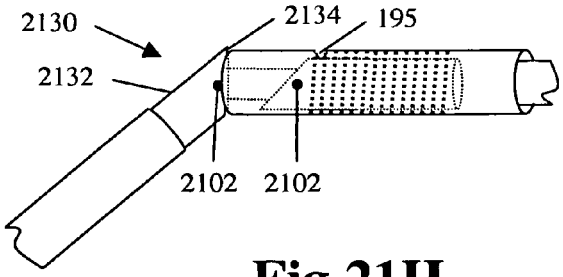

FIGS. 21G and 21H show the operation of a novel beveled hinged inserting end 2130. Generally formed like the embodiment shown in FIG. 21A through 21C, the hinged legs (2106 and 2108) have a side face 2132 and a beveled face 2134. Each hinge can be locked into three positions: 1) the straight position as shown in FIG. 21C, 2) a 90 degree position as shown in FIG. 21G, and 3) an obtuse angle position as shown in FIG. 21H. This novel connector could be used anywhere that the straight inserting-to-inserting connector, 1760, the 2-legged support 1082, or obtuse threaded support 1084 could be used. This shows the advantageous versatility of the beveled hinge.

FIG. 22A through 22C

The module system of concealment and shelter of the present invention has many uses in undeveloped outdoors areas where the attaching pivoting supports 100 can be attached to attaching structures such as trees and poles, or placed in the ground. The module system of the present invention could also be used in places that have been developed, such as a parking lot or drive way, or on a solid rock surface (for example, in wilderness campsites overlooking Yosemite Valley). In these situations it would be useful to attach blind or shelter structures to a base that can rest on a flat surface.

FIG. 22A shows a base block 2200 comprising a block 2202 with a means for receiving an inserting end (190, 191, or 1070), for example, an embedded dimpled connector 2204, as shown. The block could be made of wood, cement, ceramic, metal, or plastic.

FIG. 22B shows a receiving base 2210 comprising a base plate 2212 and a base receiving end 2214. This example shows a connector with a dimple 195 for receiving an inserting end 1070 of a shaft. The base plate 2212 could be made of wood, ceramic, metal, or plastic.

FIG. 22C shows an inserting base 2210 comprising a base plate 2212 and a base inserting end 2214. This example shows a threaded, base inserting end 2224 for inserting into a the receiving end 10702 of a shaft. The base plate 2212 could be made of wood, ceramic, metal, or plastic.

Solid Shafts Versus Hollow Shafts with Elastic Cords

Some of the foregoing embodiments have explicitly shown the use of hollow shaft segments connected with an internally running cord 126, for example FIG. 1NN, FIG. 13 and FIG. 15A. The present invention also provides a means for attaching solid shaft segments and still allowing the shafts to breakdown (see discussion in reference to FIG. 21A through 21H). Most of the embodiments can be implemented with either type of segmented shaft. A solid fiberglass shaft has greater strength than the same sized hollow fiberglass shaft. By using solid fiberglass shafts, smaller diameter shafts can be used resulting in lower cost and lower volume. It is anticipated that both hollow shafts with cords and solid shafts with or without hinged connectors will be used. The different types of shafts can be color-coded, for example, black for solid and grey for hollow.

For some applications, an operator may want to use a solid shaft for every other segment in a segmented shaft. The remaining segments could be those as shown in FIG. 1NN which would allow for a breakdown at both ends of the hollow shaft segments. The end result would be a stronger overall segmented shaft that would have one breakdown point per each shaft.

In applications where the segmented shaft needs to also have tensile strength, only solid poles without corded attachments would be necessary.

Other Uses

While the descriptions of the various embodiments have been made in reference to an undeveloped outdoor area, the module system of the present invention could also be used in urban areas. For example, in colder winter climates, the system could be used to form a green house over a garden using clear plastic sheeting and then reassembled in the summer as a shelter for vehicles or bicycles using an opaque tarp. In another example, the supports, shafts, connectors, and curtains could be used to form a backyard maze. In yet another example, the system could be used for constructing outdoor structures for weddings, flea markets, festivals, or even security checkpoints.

Lengths in Multiples and Integrated Features

The present invention anticipates that the various components, modules, and units will be provided in an integrated fashion. For example, shafts segments will all either be the same size or be multiples of a standard unit of length. Grommets will be placed in covers, cover straps, curtains, skirts, and tarps so that the shaft segments can pass through at any connection. Angles will be determined based on the use of standard units of length when forming modules such as the pyramid cap 1621. As mentioned above, the same tarp 1560 can be sized for use as a removable floor and a roof for a cylindrical arched roof unit 1604. The dimpled connectors 194 are designed to receive both a threaded leg that can be screwed into a tree (e.g. 150 or 191) and an inserting end of a segmented shaft. Applying these principles allows the users of the system to configure an unlimited number of different structures to meet the needs various situations and various sized groups.

Advantages

Modular

The system of the present invention is modular. A user can begin using smaller modules with minimal investment and add more pieces or more complex modules later. A group of users can each own separate modules, which are used independently, and then construct more complex configurations when the group comes together in the outdoors.

Separately Packable

Because the various components and modules can be separated, different users in a group can carry a relatively lighter load, for example, in their backpacks. The removable floor can be removed and only the lighter components need to be carried.

Simple

The present invention is simple to make and use. For example, the starter kit (support 100 plus curtain 300) contains fewer components than other devices in the field of this invention. Each component is easily made. The present invention requires little time to attach and to set up.

Easy to Use

The present invention is easy to use. To install, the operator 400 simply attaches the support and optional shafts, connectors, curtains, and covers. To use as a tree blind, the support 100 of the starter kit is angularly position to raised or lowered position.

Lightweight

The present invention comprises a few simple parts that can easily be constructed of lightweight materials. Being lightweight is important for those who have to carry gear into the outdoors.

Compact

The present invention is compact. The support, shafts, connectors, and curtains can easily be rolled together into a small bundle or placed in a slender sack such as the case 1300. Even larger modules such as covers with cover shafts can be broken down and rolled together in relatively small bundles. This is advantageous for both storage and carrying.

Portable

The present invention is lightweight and compact allowing it to be carried long distances into the outdoors and to be used in a variety of locations. The curtain 300 can be folded or rolled up with various components of the attaching pivoting support 100 and placed in the case 1300 for easily carrying on a waist belt or in a backpack. Other components can be separately packable by a group of users.

Quiet

The attaching pivot support with a curtain has no moving parts that would make a noise or rattle together. In some cases the screws turning against the attaching structure could make a quiet sound. However the design is such that once screwed in all the way the screw can be backed out a turn or two to reduce the volume of noise made to a negligible level.

Further, the tension on the curtain 300 provided by the second leg 160 and the anchor points 310 and ties 340 reduce wind noise.

Universal

The modular system of the present invention uses the same brackets and shafts to construct both a variety of tree blinds and ground blinds. The same parts and equipment can be used to construct configurations for different purposes and for different environments. This maximizes the user's investment in the materials and minimizes the number of items to be packed.

Lower Cost, Longer Reliability

The present invention provides a number of novel features that reduce the complexity and cost of manufacture and that increase the reliability of the parts.

Conclusion, Ramification, and Scope

Accordingly, the reader will see that the present invention provides an easy to use, simple, lightweight, compact, portable, quiet, multi-use modular system for concealment and shelter.

While my above descriptions contain several specifics these should not be construed as limitations on the scope of the invention, but rather as examples of some of the preferred embodiments thereof. Many other variations are possible. For example, other embodiments of a means of connection shaft segments could be used, such as creating threads or locking slots using a smaller, machined metal sleeve glued on the end of an inserting end of a fiberglass shaft could be used. Further, different sizes of PVC pipes could be used as shafts and connectors. The various could be used without departing for the scope and spirit of the novel features of the present invention.

Accordingly, the scope of the invention should be determined not by the illustrated embodiments, but by the appended claims and their legal equivalents.

We claim:

1. An apparatus for concealment and shelter, comprising:

a first bracket having a unitary construction and at least three legs extending therefrom, including a first leg having a threaded end, a second leg extending from the first leg at a first angle that is perpendicular to obtuse with respect to the first leg, and a third leg extending from the first leg at a second angle that is perpendicular to acute with respect to the first leg;

wherein the first leg is threadedly attached to a tree using one of the other legs to apply a rotational force such that the first bracket is pivotable about the attachment;

a shaft of a predetermined length removably connected to one of the second or third legs of the first bracket; and a sheet of material having grommets at predetermined locations to receive the shaft therethrough to support the sheet of material;

wherein the connected shaft and sheet of material are held in an angular position by friction between the threaded end of the first leg and the tree, wherein the angular position may be varied by applying a rotational force to the first leg.

2. The apparatus of claim 1, further comprising:

a plurality of said sheets is attached to the shaft, wherein the shaft supports the plurality of sheets forming a hanging curtain having slits between said plurality of sheets, wherein the second leg and shaft of said first bracket supporting said hanging curtain is positioned at a plurality of angles at different times, and, wherein an operator is concealed by the hanging curtain and the tree.

3. An apparatus for concealment and shelter, comprising:

a first bracket and a second bracket, each bracket having a unitary construction and at least three legs extending therefrom, including a first leg having a threaded end, a second leg extending from the first leg at a first angle that is perpendicular to obtuse with respect to the first leg, and a third leg extending from the first leg at a second angle that is perpendicular to acute with respect to the first leg;

wherein the first legs of the first bracket and the second bracket are threadedly attached to a tree in separated locations using respective second legs to apply a rotational force such that the each bracket is pivotable about its attachment;

a first shaft of a predetermined length removably connected to one of the second or third legs of the first bracket;

a first sheet of material having grommets at predetermined locations to receive the first shaft therethrough to support the sheet of material;

a second shaft of a predetermined length removably connected to one of the second or third legs of the second bracket; and a second sheet of material having grommets at predetermined locations to receive the second shaft therethrough to support the sheet of material;

wherein the connected first shaft and first sheet of material are held in an angular position by friction between the threaded end of the first leg of the first bracket and the tree, wherein the angular position may be varied by applying a rotational force to the first leg of the first bracket.

4. The apparatus of claim 3, wherein the connected second shaft and second sheet of material are held in an angular position by friction between the threaded end of the second leg of the first bracket and the tree, wherein the angular position may be varied by applying a rotational force to the first leg of the second bracket.

5. The apparatus of claim 3, wherein at least one of said shafts is comprised of a plurality of shaft segments, each shaft segment having a receiving end and an inserting end, whereby the inserting end of any of the shaft segments can be removably connected to the receiving end of any other of the shaft segments.

6. The apparatus of claim 5, wherein at least one receiving end of said shaft segments comprises an inwardly protruding, substantially hemispherical dimple adapted to engage a feature of at least one of the inserting ends of another shaft segment when the inserting end is coupled with the receiving end.

7. The apparatus of claim 6, wherein the feature comprises threads, wherein the threaded inserting end is threadedly connected into the receiving end comprising the dimple to make the attachment.

8. The apparatus of claim 6, wherein the feature comprises a locking slot, wherein the slotted inserting end is inserted into the receiving end comprising the dimple and twisted so that the dimple follows the locking slot path to make the attachment.

9. The apparatus of claim 8, wherein the slotted inserting end further comprises a slot mark that is visible when the slotted inserting end is fully inserted into the receiving end so that the position of the locking slot is accessed.

10. The apparatus of claim 5, wherein each of said shafts comprises a plurality of shaft segments, wherein each shaft segment may be removably coupled to another shaft segment or to a bracket by a segment connector, wherein the segment connector may be partially removed to breakdown the connection while maintaining a configuration and completely removed to detach the configuration.

11. The apparatus of claim 10, wherein:

a) the shaft segment comprises a hollow shaft, b) at least one end comprises a hollow connector which fits over and receives said hollow shaft, and c) the segment connector comprises:

i) an elastic cord passing through the hollow shaft between the ends of the shaft segment, ii) a cord retainer held near the center of the hollow connector, iii) a cord attachment whereby one end of the elastic cord is permanently attached to the cord retainer, wherein the shaft segments are broken down by pulling the hollow shaft and the hollow connector apart and bending the hollow shaft and the hollow connector at an angle so that the hollow shaft is no longer inside the hollow connector but is only held together by the cord.

12. The apparatus of claim 3, further comprising a cap module, said cap module comprising:

h) a cover sheet of material with a predetermined shape, forming a cover, and i) at least two of said shafts, connected to the cover, forming cover shafts, wherein the cover shafts form a frame for said cover, and wherein said cap module is connected above an operator.

13. The apparatus of claim 12, wherein:

j) the cover shafts are configured as crossed arches, and k) the cover sheet is formed from four cover panels such that it has a rectangular dome shape, wherein the cap module forms a rectangular dome, forming a domed cover cap.

14. The apparatus of claim 12, wherein:

l) the cover shafts are configured with at least one angled connector in the middle forming a pyramid frame, m) the cover sheet is formed from four cover panels such that it has a pyramid shape wherein the cap module forms a pyramid cap.

15. The apparatus of claim 12, wherein:

n) the cover shafts are configured as parallel arches, and o) the cover sheet is rectangular in shape, and wherein the cap module forms a cylindrical arched roof, forming a cylindrical cap.

16. The apparatus of claim 12, wherein the cap module may be attached to a vehicle, such as an ATV, SUV, truck, trailer, or bicycle, wherein the system is moved over a distance greater than about five miles, while the operator remains inside the cap module.

17. The apparatus of claim 12, wherein the cap module may be attached to a vessel, such as a boat, wherein the system is moved over a wet area while the operator remains inside the cap module.

18. The apparatus of claim 12, wherein the cap module may be supported off the ground by at least three of said brackets, wherein the brackets are connected directly or indirectly to the ends of the cover shafts, whereby a configuration including the cap module is secured to the ground.

19. The apparatus of claim 18, further comprising a plurality of bracket extension shafts, wherein at least one of the brackets is connected to one end of a one of the extension shafts and the other end of the extension shaft is connected to one end of one of the cover shafts, whereby the operator has more room beneath the cap module.

20. The apparatus of claim 19, wherein at least one of the extension shafts is a segmented shaft comprising a plurality of shafts segments, each shaft segment having a receiving end and an inserting end whereby the inserting end of any of the shaft segments can be removably connected to the receiving end of any other of the shaft segments, wherein the operator adjusts the length of the extension shafts by adding or removing shaft segments, wherein the cap module is supported in a substantially horizontal position relative to the general surface of the earth while the configuration is located on a steep hillside, on rough, irregular terrain, or amid large obstacles.

21. The apparatus of claim 19, further comprising a removable floor module comprising one of said sheets of material, wherein the corners of the floor have grommets through which an inserting end of the shaft segments of the extension shafts can pass through and then attachment to the respective receiving end of adjacent shaft segment, wherein the sides of the floor are raised a substantial distance off the ground, and wherein the relatively high sides keep material, such as water, dirt, insects, and debris, out of the configuration, whereby the floor is removed for cleaning, and whereby the floor is removed for separate storage or transport.

22. The apparatus of claim 19, further comprising a removable skirt comprising one of said sheets of material, wherein the skirt is attached to the configuration and is held up with one of:

grommets through which an inserting end of the extension shafts pass through, or buckles that attach to a strap attached to the configuration, wherein said skirt forms walls on at least two sides of the configuration.

23. The apparatus of claim 22, wherein a portion of the skirt further comprises a skirt door with a skirt door attachment for removably attaching the skirt door to one of the extension shafts or cover shafts, wherein the skirt door attachment is briefly detached to open the door to enter or exit the configuration and then the skirt door attachment is reattached without having to detach any other connection within the configuration.

24. The apparatus of claim 18, further comprising a guyline module and at least one sliding panel, the guyline module comprising:

at least one guyline, and a means for holding each end of each guyline to one of the shafts or brackets in the corners of the configuration, wherein the guyline supports said sliding panel, and wherein said sliding panel slides along the direction of the guyline.

25. The apparatus of claim 24, wherein the direction of the guyline is substantially horizontal and wherein said sliding panel slides horizontally over an opening in the configuration.

26. The apparatus of claim 25, comprising plurality of horizontally sliding panels, wherein a gap between any two of said horizontally sliding panels forms a vertical slit, wherein the sliding panels slides to form the vertical slit whereby the operator sees and shoots through the vertical slit while maintaining concealment elsewhere in the opening.

27. The apparatus of claim 24, wherein the direction of the guyline is substantially vertical and wherein said sliding panel slides vertically over an opening in the configuration.

28. The apparatus of claim 24, wherein the sliding panel is one of a blackout panel or a shoot-through panel.

29. The apparatus of claim 12, wherein said cover further comprises at least one overhead window, and wherein each overhead window has a means of window attachment wherein the window is at least partially opened, whereby the operator sees out of the overhead window, and whereby the operator extends a portion of the operator's body through the overhead window.

30. A modular apparatus for concealment comprising multiple units of the system of claim 12, said multiple units connected together, wherein at least one unit comprises at least one curtain wall module having a second configuration, the second configuration comprising:

one leg of each of the first and second brackets is removably inserted into supporting surface, using another leg of each of the brackets to apply a mechanical force, wherein the first and second brackets are separated by a predetermined distance, a first and second of said shafts are each attached to a remaining leg of each of the first and second brackets, and a first of said sheets is attached between the first and second shafts forming a first wall curtain, wherein another unit comprises a cap module supported by at least two curtain wall modules having a third configuration, wherein the third configuration comprises the second configuration and further comprises:

p) a third bracket of said brackets, and q) a third shaft, wherein:

i) one leg of the third brackets is removably inserted into the supporting surface-using another leg of the third bracket to apply a mechanical force, wherein the third bracket is separated by a second predetermined distance from one of the other brackets, ii) the third shaft is connected to a remaining leg of the third bracket, iii) a second sheet of said sheets is removably attached between the third shaft and one of the other shafts forming a second wall curtain, wherein the connected multiple units provide a larger configuration.

31. The apparatus of claim 12, wherein at least one of the sheets further comprises a lower window, wherein the operator is provided a line of sight down the steep hillside.

32. The apparatus of claim 12, wherein:

the cover shafts are configured as parallel angled shafts, and the cover sheet is rectangular in shape, wherein the cap module forms a triangular prism, forming an A-frame configuration.

33. The apparatus of claim 3, wherein a third configuration includes the second configuration and further comprises:

a third bracket of said brackets, and a third shaft, wherein:

one leg of the third bracket is removeably inserted into the supporting surface using another leg of the third bracket to apply a mechanical force, wherein the third bracket is separated by a second predetermined distance from one of the other brackets, the third shaft is connected to a remaining leg of the third bracket, a second sheet of said sheets is removably attached between the third shaft and one of the other shafts forming a second wall curtain, wherein the operator is concealed by the wall curtains.

* * * * *